US010971038B2

(12) United States Patent
Shea

(10) Patent No.: US 10,971,038 B2
(45) Date of Patent: Apr. 6, 2021

(54) SIGNAGE SYSTEMS AND MERCHANDISING DISPLAY ASSEMBLIES

(71) Applicant: T.M. Shea Products, Inc., Troy, MI (US)

(72) Inventor: Thomas M. Shea, Troy, MI (US)

(73) Assignee: T.M. SHEA PRODUCTS, INC., Troy, MI (US)

( * ) Notice: Subject to any disclaimer, the term of this patent is extended or adjusted under 35 U.S.C. 154(b) by 0 days.

(21) Appl. No.: 15/471,404

(22) Filed: Mar. 28, 2017

(65) Prior Publication Data

US 2017/0278435 A1 Sep. 28, 2017

Related U.S. Application Data

(63) Continuation-in-part of application No. 15/044,336, filed on Feb. 16, 2016, now Pat. No. 9,867,483, which
(Continued)

(51) Int. Cl.
*A47F 5/00* (2006.01)
*G09F 7/18* (2006.01)
(Continued)

(52) U.S. Cl.
CPC ..... *G09F 7/18* (2013.01); *A47F 5/083* (2013.01); *A47F 5/0815* (2013.01);
(Continued)

(58) Field of Classification Search
CPC ..... G09F 7/18; G09F 7/08; G09F 7/10; G09F 23/06; G09F 2007/1856; A47F 5/0815; A47F 5/0823; A47F 5/083; A47F 5/101; A47F 2005/0075; A47F 1/00; A47F 5/00; A47F 7/00; A47B 43/00; A47B 45/00; A47B 46/00; A47B 47/00; A47B 49/00; A47B 51/00; A47B 53/00; A47B 55/00; A47B 57/00; A47B 61/00; A47B 63/00; A47B 65/00; A47B 73/00; A47B 81/00; A47B 87/00; A47B 96/00; B62H 1/00;
(Continued)

(56) References Cited

U.S. PATENT DOCUMENTS 2,588,635 A * 3/1952 Junkin ..... G09F 3/20 40/618
4,215,784 A * 8/1980 Perkins ..... A47F 5/08 211/105.2

(Continued)

*Primary Examiner* — Cassandra Davis
(74) *Attorney, Agent, or Firm* — Harness, Dickey & Pierce, P.L.C.; Stephen T. Olson

(57) ABSTRACT

A merchandising display for attachment to a gondola includes a frame and at least one display panel. The frame includes first and second vertically extending members both having an L-shape with a first side for positioning against the gondola and a second side extending perpendicular outward therefrom. The at least one display panel is curved in a horizontal direction and includes one of a plurality of apertures for receiving hooks for the display of retail product and a sign. The display panel includes first and second lateral sides. The first and second lateral sides are attached to the second side of the first and second vertically extending member, respectively.

10 Claims, 78 Drawing Sheets

Related U.S. Application Data is a continuation of application No. 14/019,658, filed on Sep. 6, 2013, now abandoned.

(60) Provisional application No. 62/313,881, filed on Mar. 28, 2016.

(51) Int. Cl.

| | |
|---|---|
| ***G09F 7/08*** | (2006.01) |
| ***A47F 5/08*** | (2006.01) |
| ***G09F 23/06*** | (2006.01) |
| ***G09F 7/10*** | (2006.01) |
| *A47F 5/01* | (2006.01) |
| *A47F 5/10* | (2006.01) |

(52) U.S. Cl.

CPC ..... *A47F 5/0823* (2013.01); *G09F 7/08* (2013.01); *G09F 7/10* (2013.01); *G09F 23/06* (2013.01); *A47F 5/01* (2013.01); *A47F 5/0869* (2013.01); *A47F 5/101* (2013.01); *A47F 2005/0075* (2013.01); *G09F 2007/1856* (2013.01)

(58) Field of Classification Search

CPC ..... B62H 3/00; A47L 15/50–507; A47L 19/00–04

See application file for complete search history.

(56) References Cited

U.S. PATENT DOCUMENTS

| | | | | | |
|---|---|---|---|---|---|
| 4,611,866 | A * | 9/1986 | Everett | A47F 5/00 | 211/175 |
| 4,672,757 | A * | 6/1987 | Field | G09F 3/18 | 40/618 |
| 4,762,235 | A * | 8/1988 | Howard | A47B 57/46 | 108/109 |
| 5,379,976 | A * | 1/1995 | DeGirolamo | A47F 5/0815 | 248/220.43 |
| 5,437,116 | A * | 8/1995 | Hardy | F16B 12/26 | 211/189 |
| 5,718,072 | A * | 2/1998 | Garfinkle | G09F 3/204 | 40/606.15 |
| 6,427,857 | B1 * | 8/2002 | Adams | A47F 5/10 | 211/162 |
| 2015/0036326 | A1 * | 2/2015 | Maciulewicz | A47F 11/10 | 362/133 |

* cited by examiner

1000

1806
1806A
1008
1008
1802B
1806B
1804
GRAPHIC
1802A
1010
1800

2200
2200
2200
2200
2202
2202
2202
2202

2200
2200

2400
2406
2402
2406

2400
2406
2402
2406

2400
2402

2400
2406
2402
2406

2400
2406
2402

2400
2402
2406

2500
2504

2500
2502
2502

2504
2506
2506

SIGNAGE SYSTEMS AND MERCHANDISING DISPLAY ASSEMBLIES

CROSS-REFERENCE TO RELATED APPLICATIONS

This application claims priority to U.S. Provisional Application No. 62/313,881 filed 28 Mar. 2016, which application is expressly incorporated by reference as if fully set forth herein.

FIELD

The present teachings generally relate to retail signage systems and merchandising display assemblies.

DISCUSSION

A multitude of product and product categories crowd the aisles and merchandise displays of retail stores. Signage systems can be used to showcase products or product categories, attract attention and provide guidance to different sections of the store. For example, various signage systems are shown and described in commonly owned U.S. Publication No. 2012/0240436, U.S. Publication No. 2012/0240436 is incorporated by reference as if fully disclosed herein.

Merchandising display assemblies can be used to more effectively position merchandise within the store. For example, one known merchandise display assembly is shown and described in commonly owned U.S. Pat. No. 5,957,422. U.S. Pat. No. 5,957,422 is incorporated by reference as if fully disclosed herein.

While existing signage systems and merchandising display assemblies have proven to be satisfactory for their intended purposes, there remains a need for continuous improvement within the relevant art.

SUMMARY

In accordance with one particular aspect, the present teachings provide various merchandising display assemblies.

In accordance with another particular aspect, the present teachings provide various signage systems.

In accordance with yet another particular aspect, the present teachings provide various merchandising display brackets.

In accordance with yet another particular aspect, the present teachings provide various merchandising support members.

In accordance with still yet another particular aspect, the present teachings provide various ornamental designs for merchandising display assemblies, merchandising display brackets and signage systems.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The present invention will become more fully understood from the detailed description and the accompanying drawings, wherein:

FIG. 22B is another perspective view of the merchandising display of FIG. 22A

FIG. 25B is another perspective view of the merchandising display assembly similar to FIG. 25A, but including an alternative mounting structure.

FIG. 25C is a left side view of the merchandising display assembly of FIG. 25A.

FIG. 25D is a right side view of the merchandising display assembly of FIG. 25A.

FIG. 25E is a front view of the merchandising display assembly of FIG. 25A.

FIG. 25F is a rear view of the merchandising display assembly of FIG. 25A.

FIG. 25G is a top view of the merchandising display assembly of FIG. 25A.

FIG. 25H is a bottom view of the merchandising display assembly of FIG. 25A.

FIG. 26A is a perspective view of another signage assembly in accordance with the present teachings.

FIG. 26B is an exploded perspective view of the signage assembly of FIG. 26A.

FIG. 26C is a left view of the signage assembly of FIG. 26A.

FIG. 26D is a right side view of the signage assembly of FIG. 26A.

FIG. 26E is front view of the signage assembly of FIG. 26A.

Figure 26B:
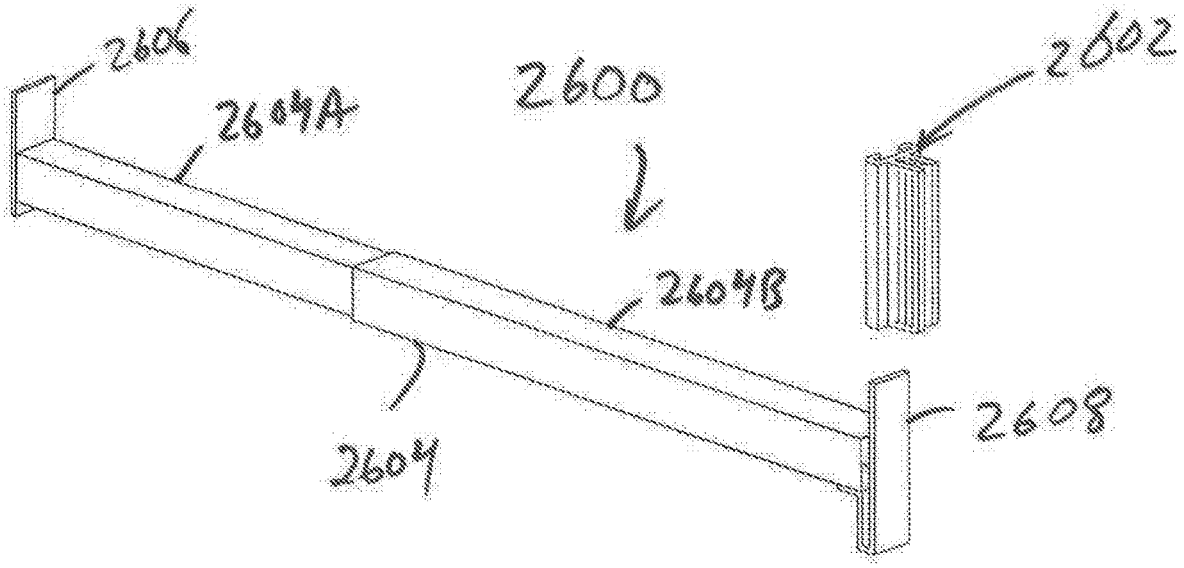
Figure 26A:
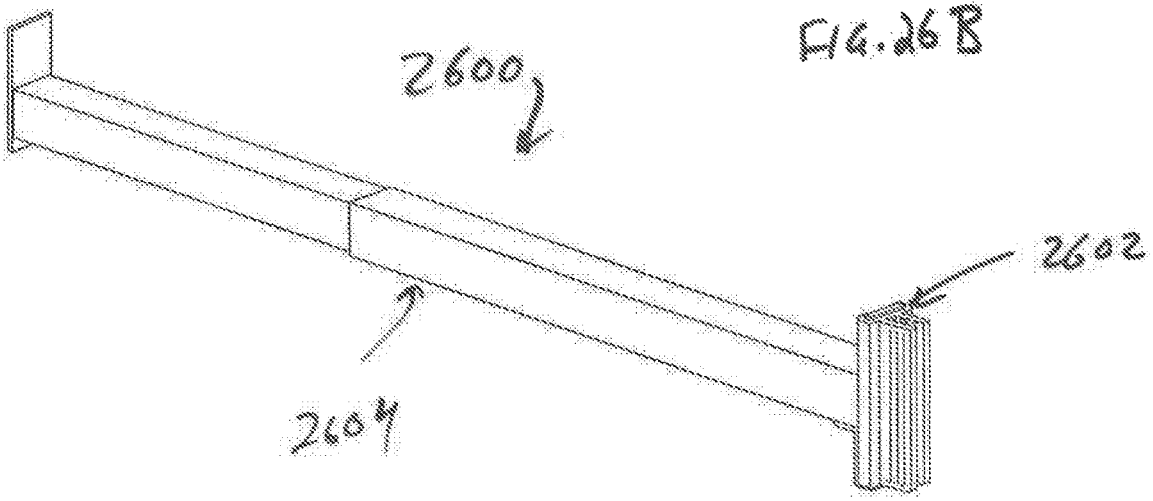
Figure 26C:
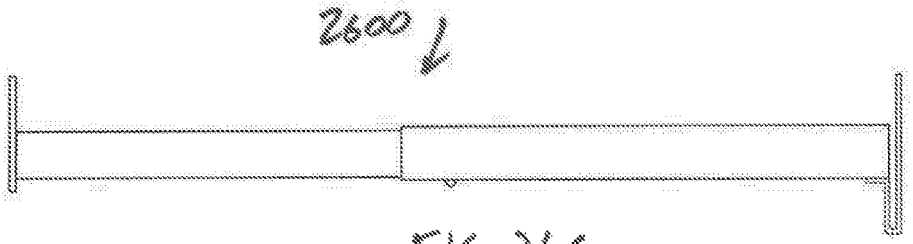
Figure 26E:
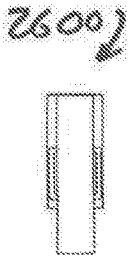
Figure 26D:
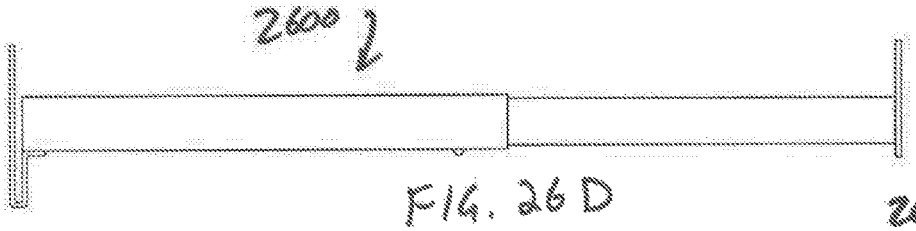
Figure 26F:
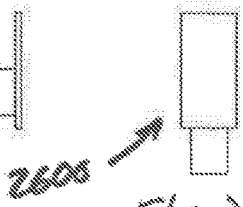

FIG. 26F is a rear view of the signage assembly of FIG. 26A.

Figure 26G:
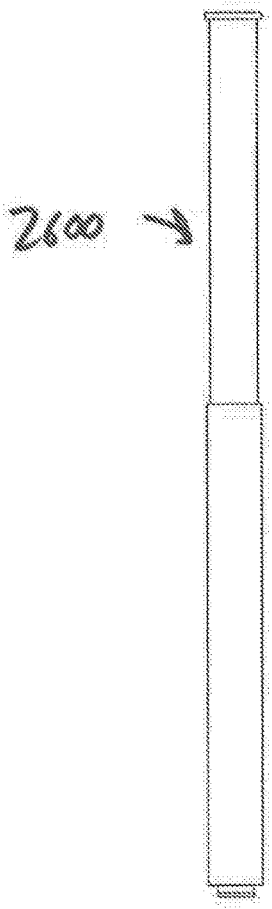

FIG. 26G is a top view of the signage assembly of FIG. 26A.

Figure 26H:
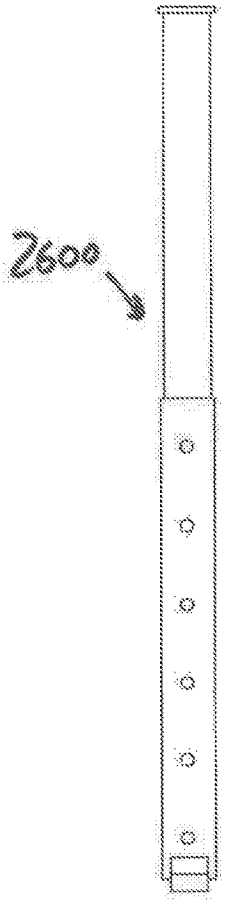

FIG. 26H is a bottom view of the signage assembly of FIG. 26A.

Figures 27A, 27B:
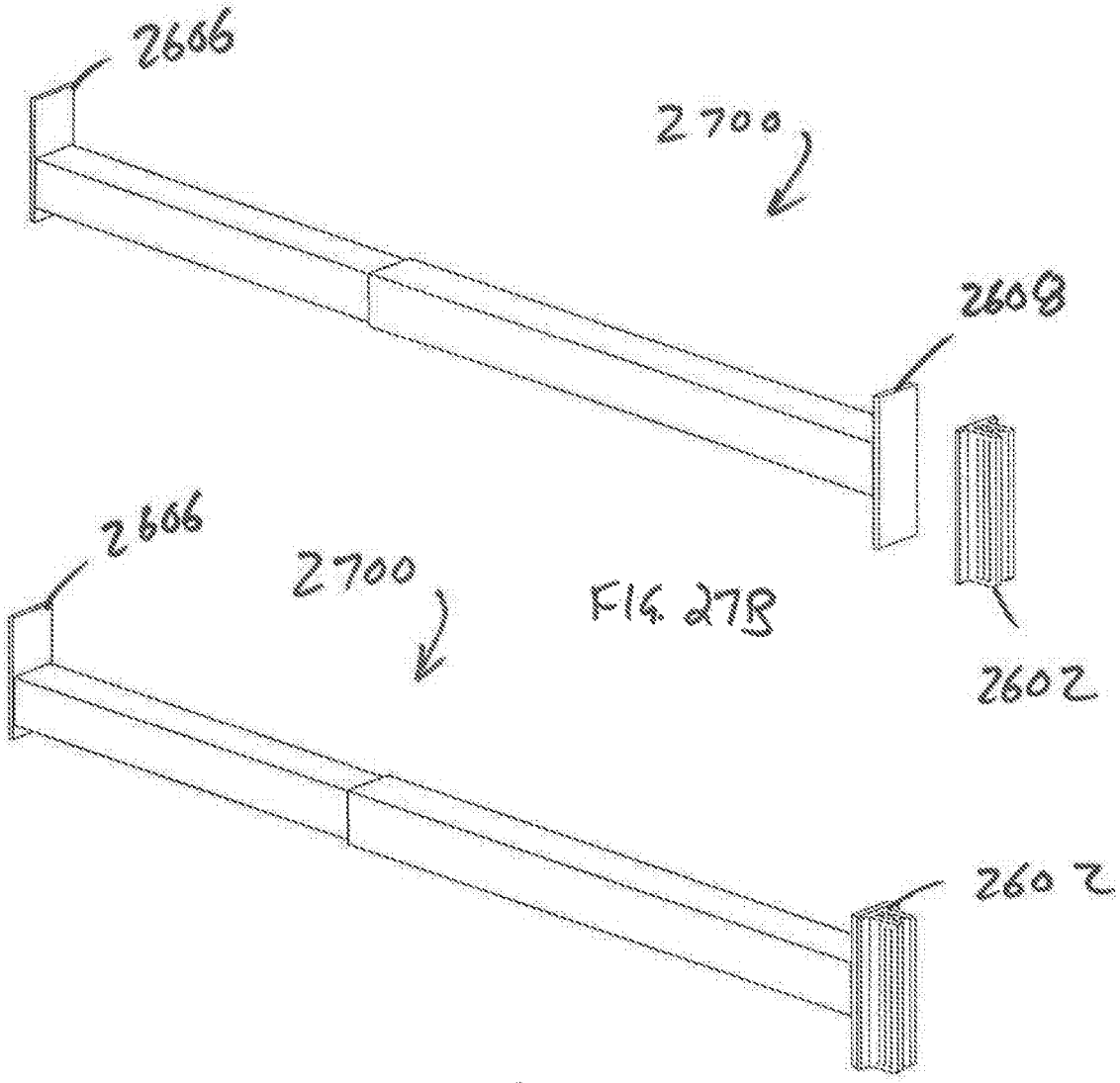

FIG. 27A is a perspective view of another signage assembly in accordance with the present teachings.

FIG. 27B is an exploded perspective view of the signage assembly of FIG. 27A.

Figure 27C:
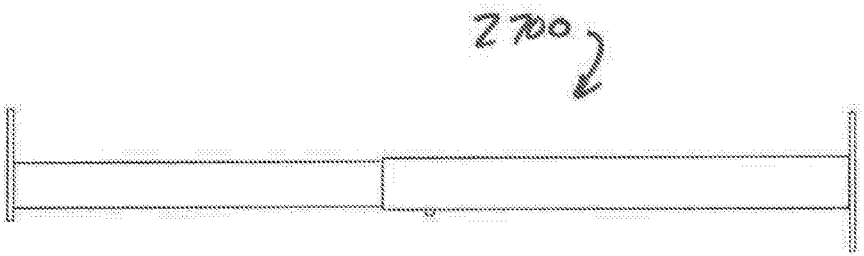

FIG. 27C is a left view of the signage assembly of FIG. 27A.

Figure 27E:
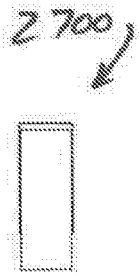
Figure 27D:
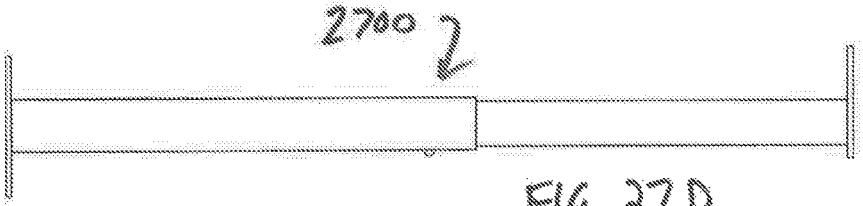

FIG. 27D is a right side view of the signage assembly of FIG. 27A.

FIG. 27E is front view of the signage assembly of FIG. 27A.

Figure 27F:
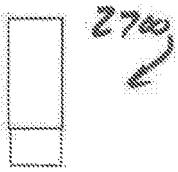

FIG. 27F is a rear view of the signage assembly of FIG. 27A.

Figure 27G:
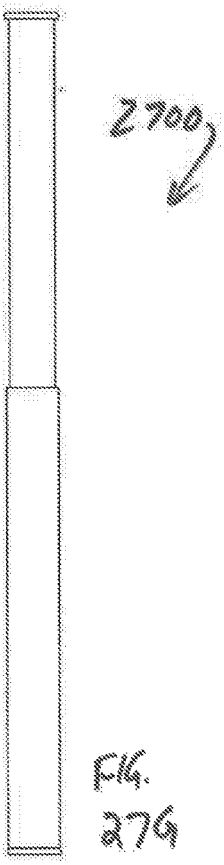

FIG. 27G is a top view of the signage assembly of FIG. 27A.

Figure 27H:
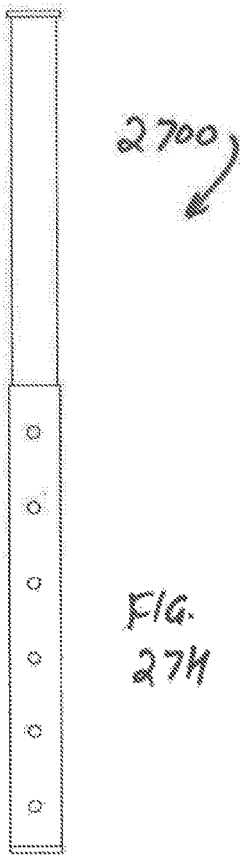

FIG. 27H is a bottom view of the signage assembly of FIG. 27A.

Figure 28B:
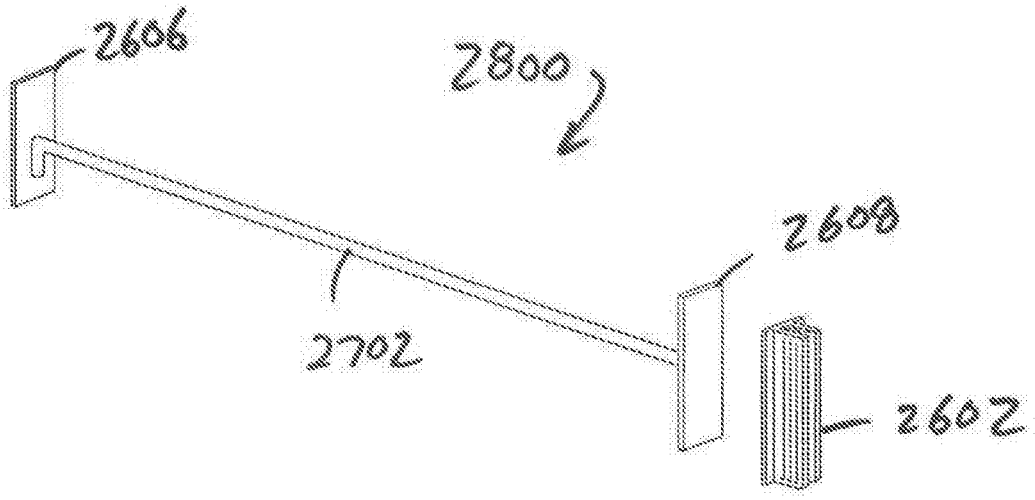
Figure 28A:
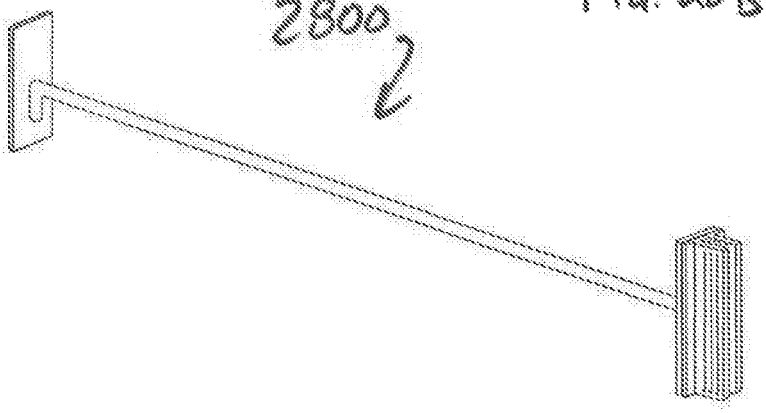

FIG. 28A is a perspective view of another signage assembly in accordance with the present teachings.

FIG. 28B is an exploded perspective view of the signage assembly of FIG. 28A.

Figure 28C:
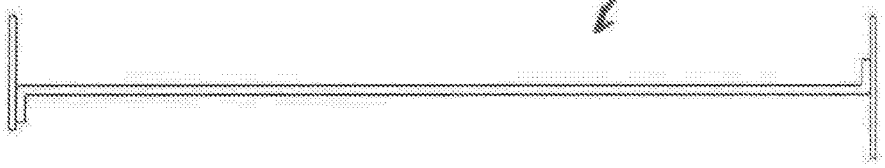

FIG. 28C is a left view of the signage assembly of FIG. 28A.

Figure 28E:
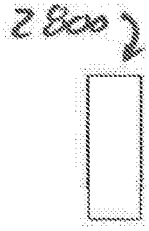
Figure 28D:
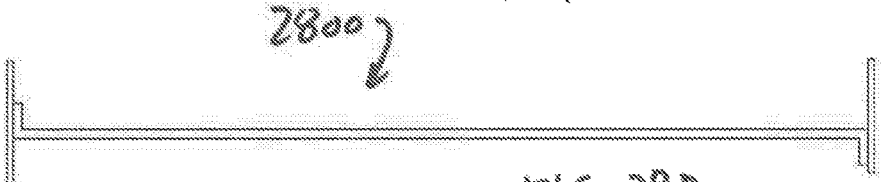

FIG. 28D is a right side view of the signage assembly of FIG. 28A.

FIG. 28E is front view of the signage assembly of FIG. 28A.

Figure 28F:
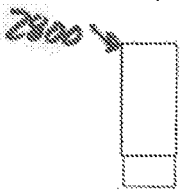

FIG. 28F is a rear view of the signage assembly of FIG. 28A.

Figure 28G:
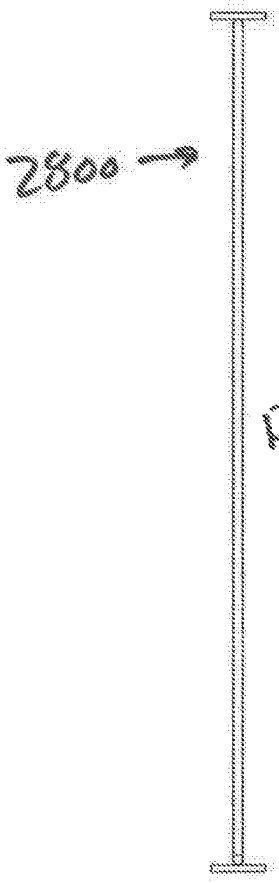

FIG. 28G is a top view of the signage assembly of FIG. 28A.

Figure 28H:
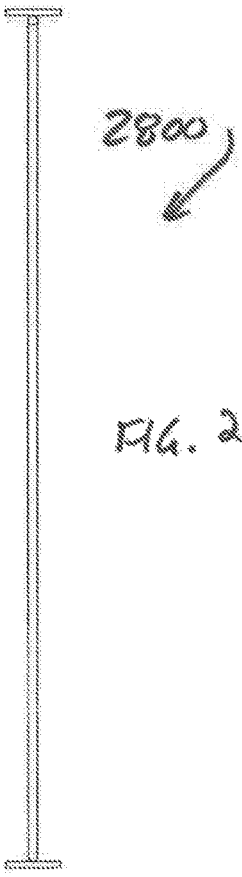

FIG. 28H is a bottom view of the signage assembly of FIG. 28A.

Figures 29, 30, 31A:
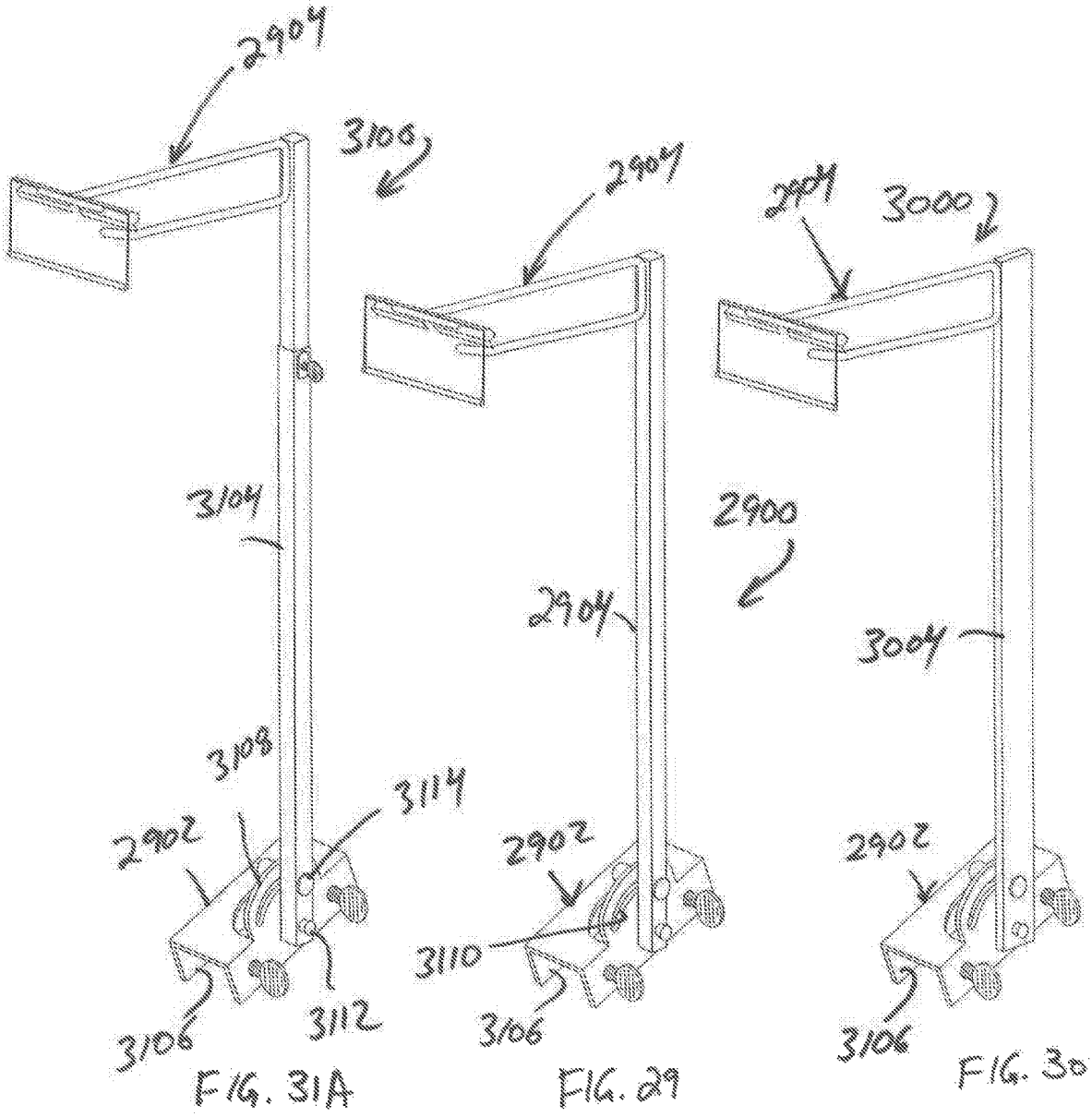

FIG. 29 is a perspective view of another merchandising display assembly in accordance with the present teachings.

FIG. 30 is a perspective view of another merchandising display assembly in accordance with the present teachings.

FIG. 31A is a perspective view of another merchandising display assembly in accordance with the present teachings.

Figure 31B:
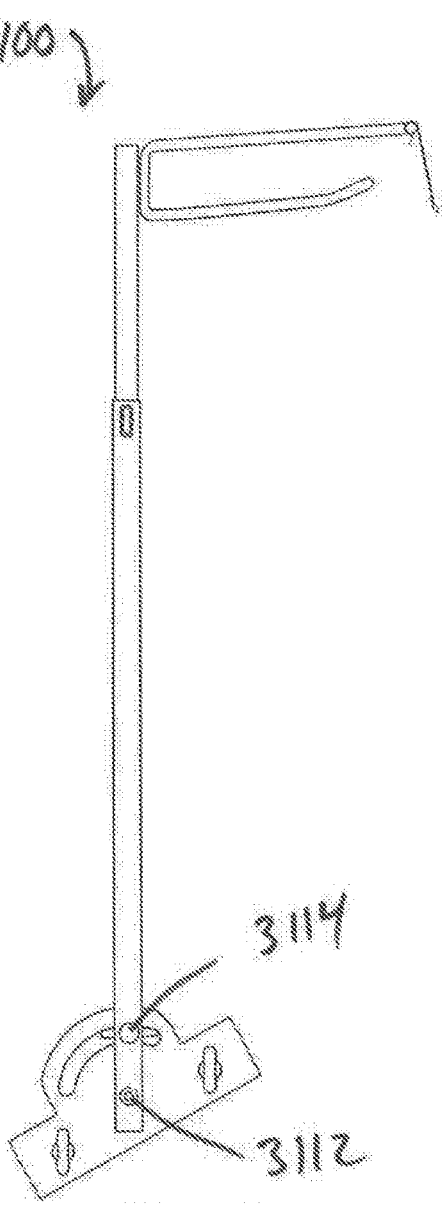

FIG. 31B is a right side view of the merchandising display assembly of FIG. 31A.

Figure 31C:
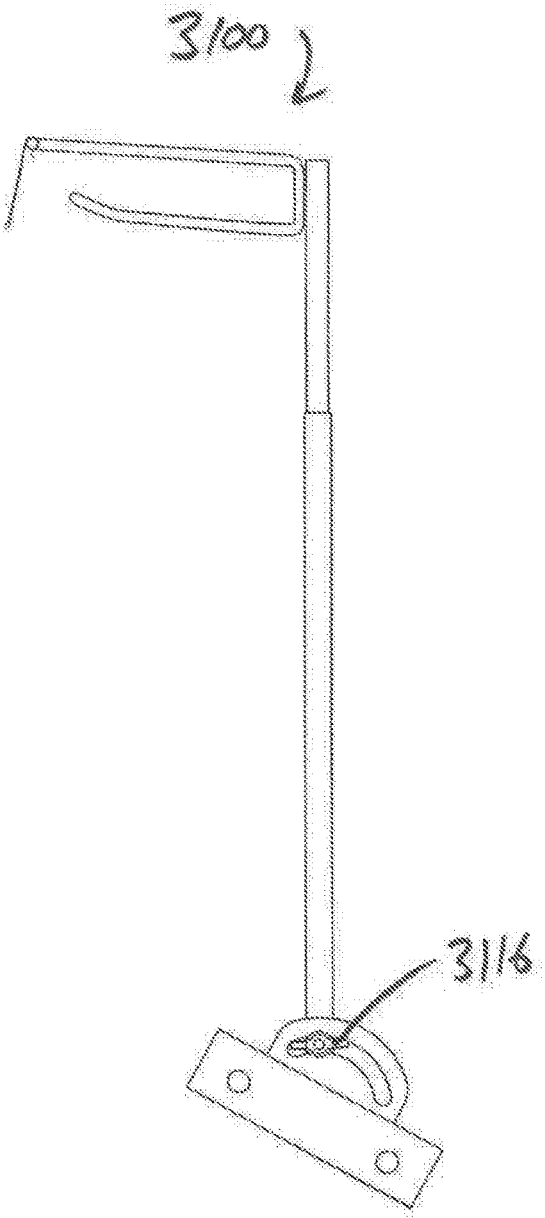

FIG. 31C is a left side view of the merchandising display assembly of FIG. 31A.

Figure 31D:
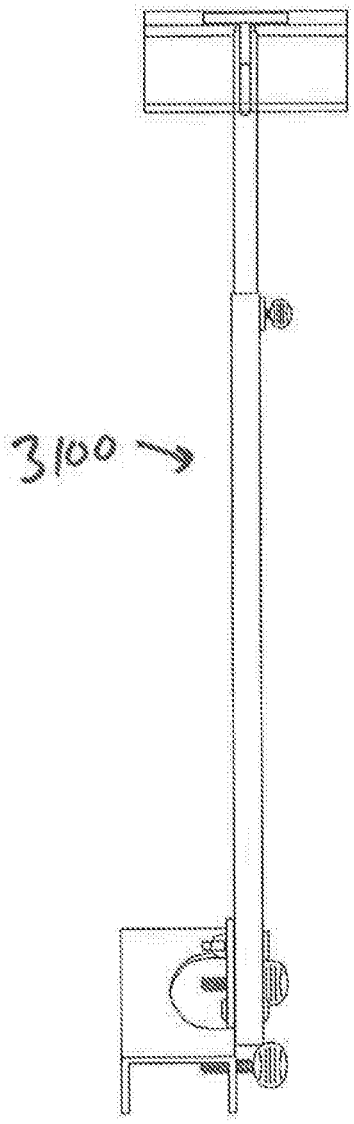

FIG. 31D is a front view of the merchandising display assembly of FIG. 31A.

Figure 31E:
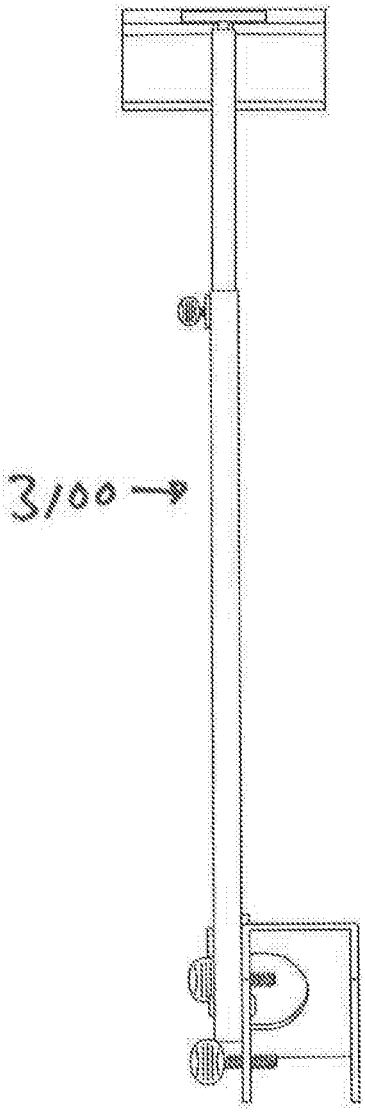

FIG. 31E is a rear view of the merchandising display assembly of FIG. 31A.

Figure 31F:
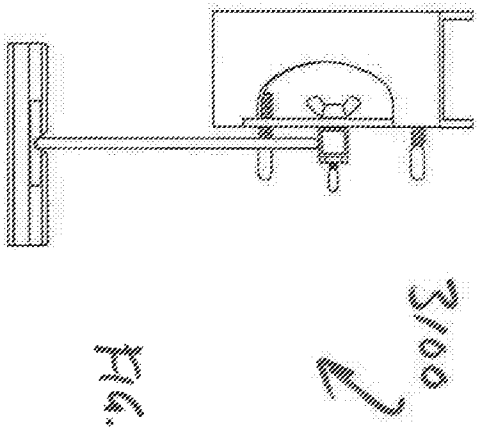

FIG. 31F is a top view of the merchandising display assembly of FIG. 31A.

Figure 31G:
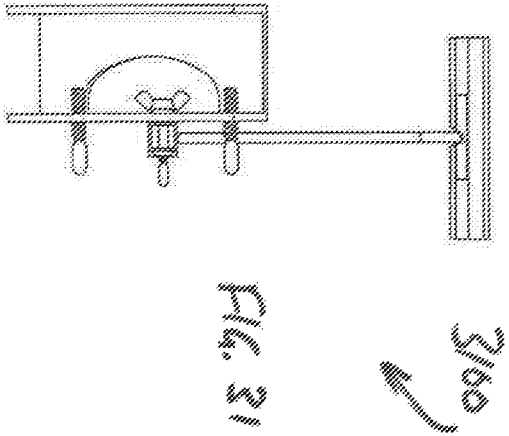

FIG. 31G is a bottom view of the merchandising display assembly of FIG. 31A.

Figure 32A:
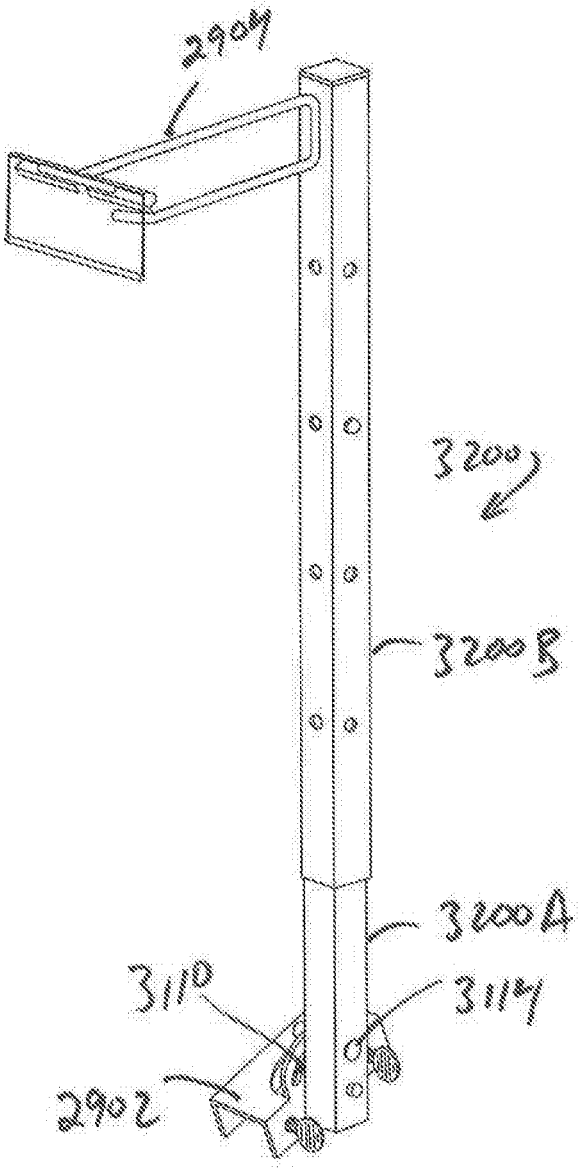
Figure 32B:
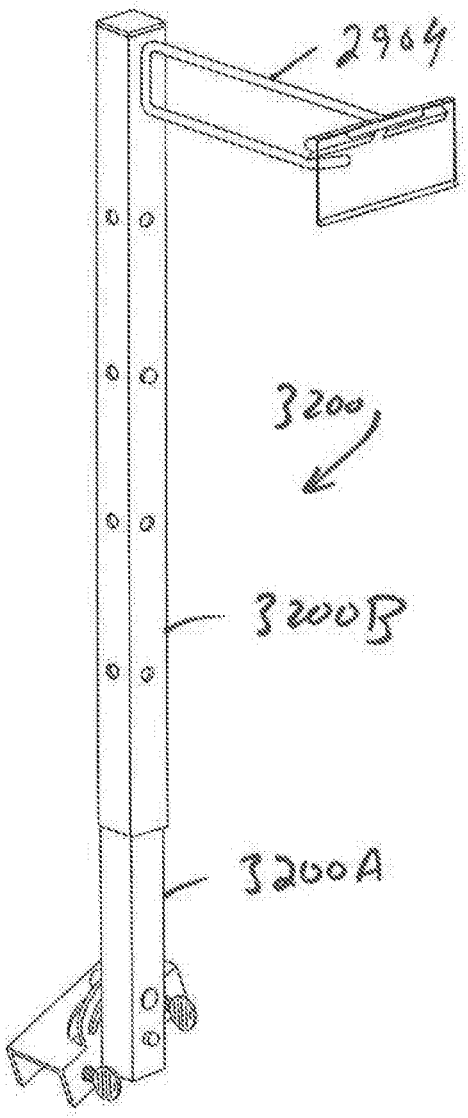

FIGS. 32A and 32B are perspective views of another merchandising display assembly in accordance with the present teachings.

Figure 32C:
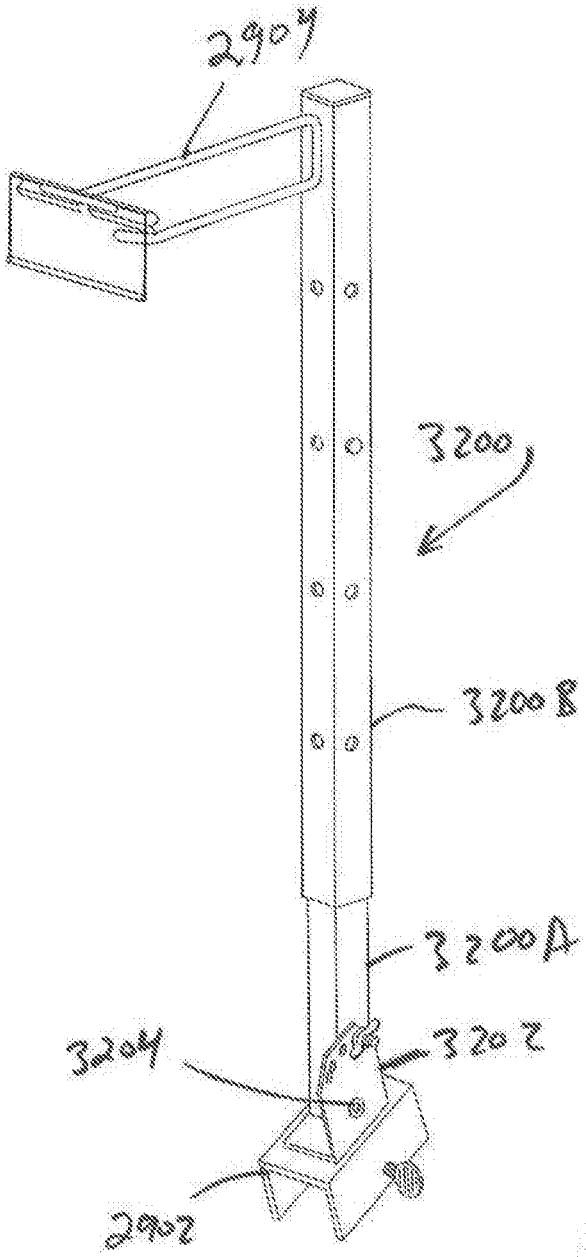
Figure 32D:
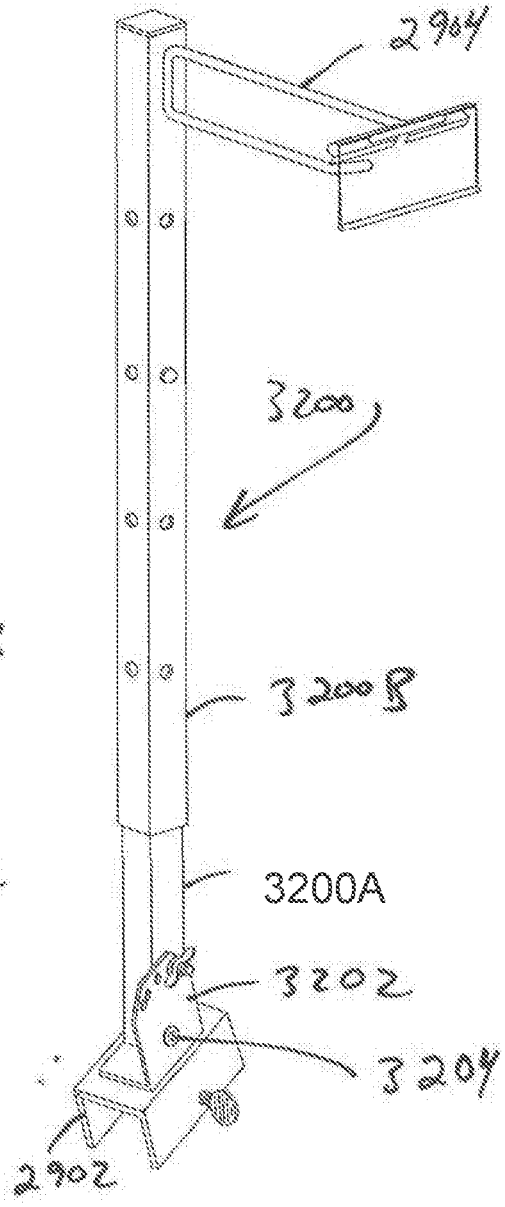

FIGS. 32C and 32D are perspective views of another merchandising display assembly in accordance with the present teachings.

Figure 32E:
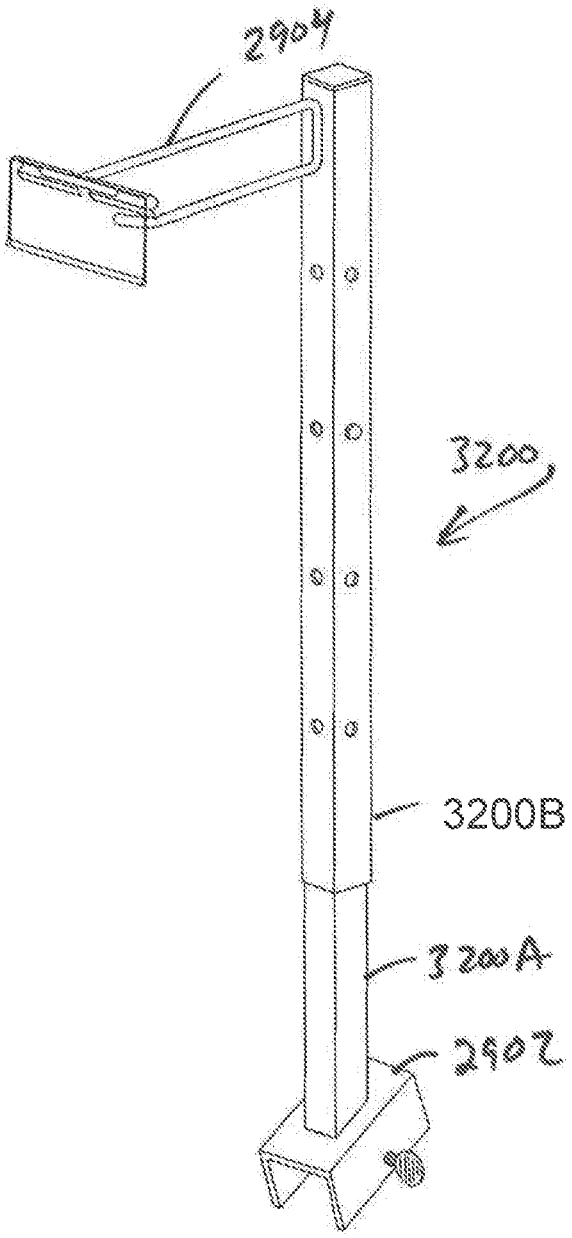
Figure 32F:
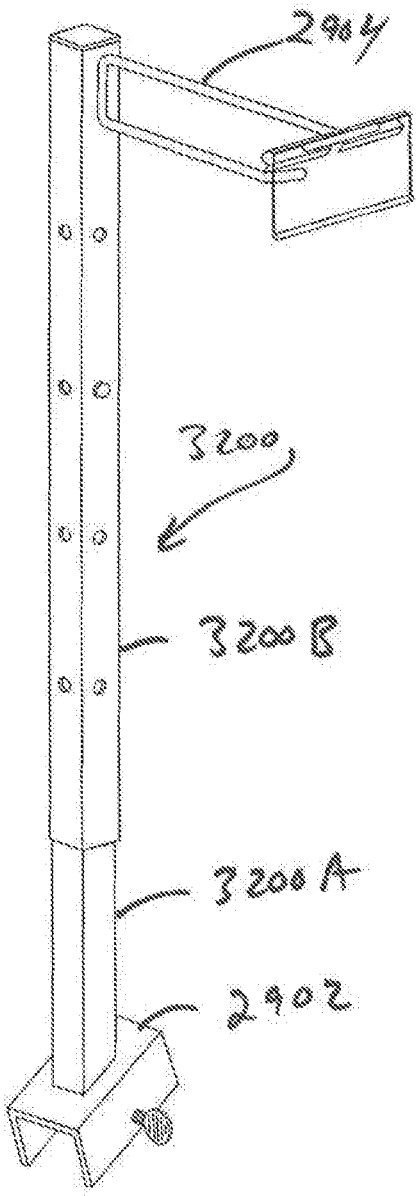

FIGS. 32E and 32F are perspective views of another merchandising display assembly in accordance with the present teachings.

Figure 32G:
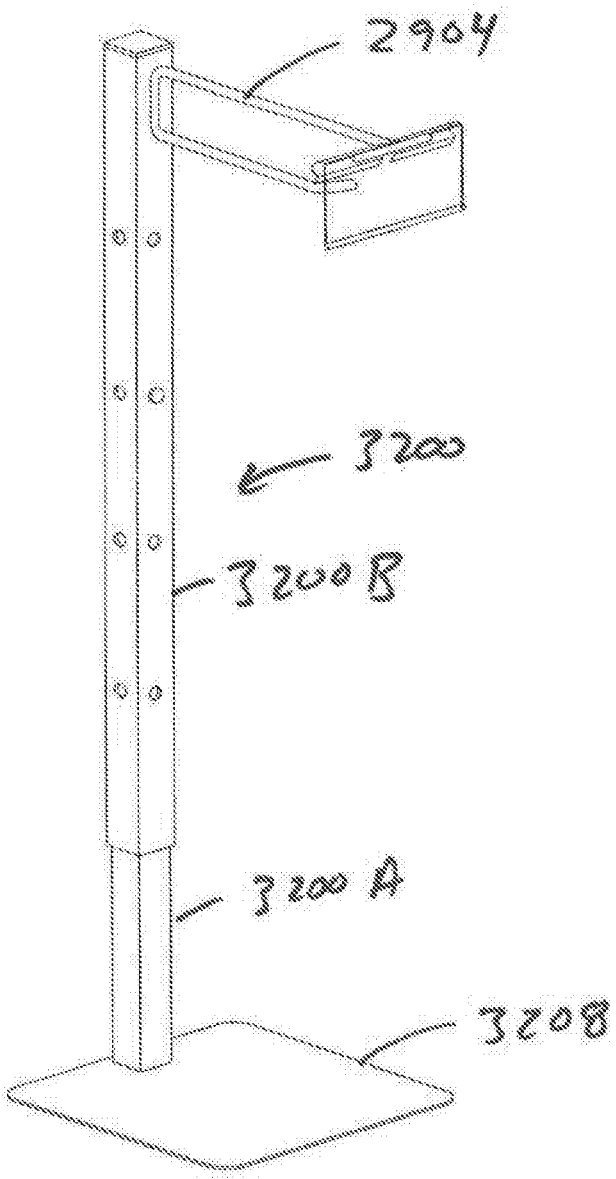

FIG. 32G is a perspective view of another merchandising display assembly in accordance with the present teachings.

Figures 33A, 33B, 33C:
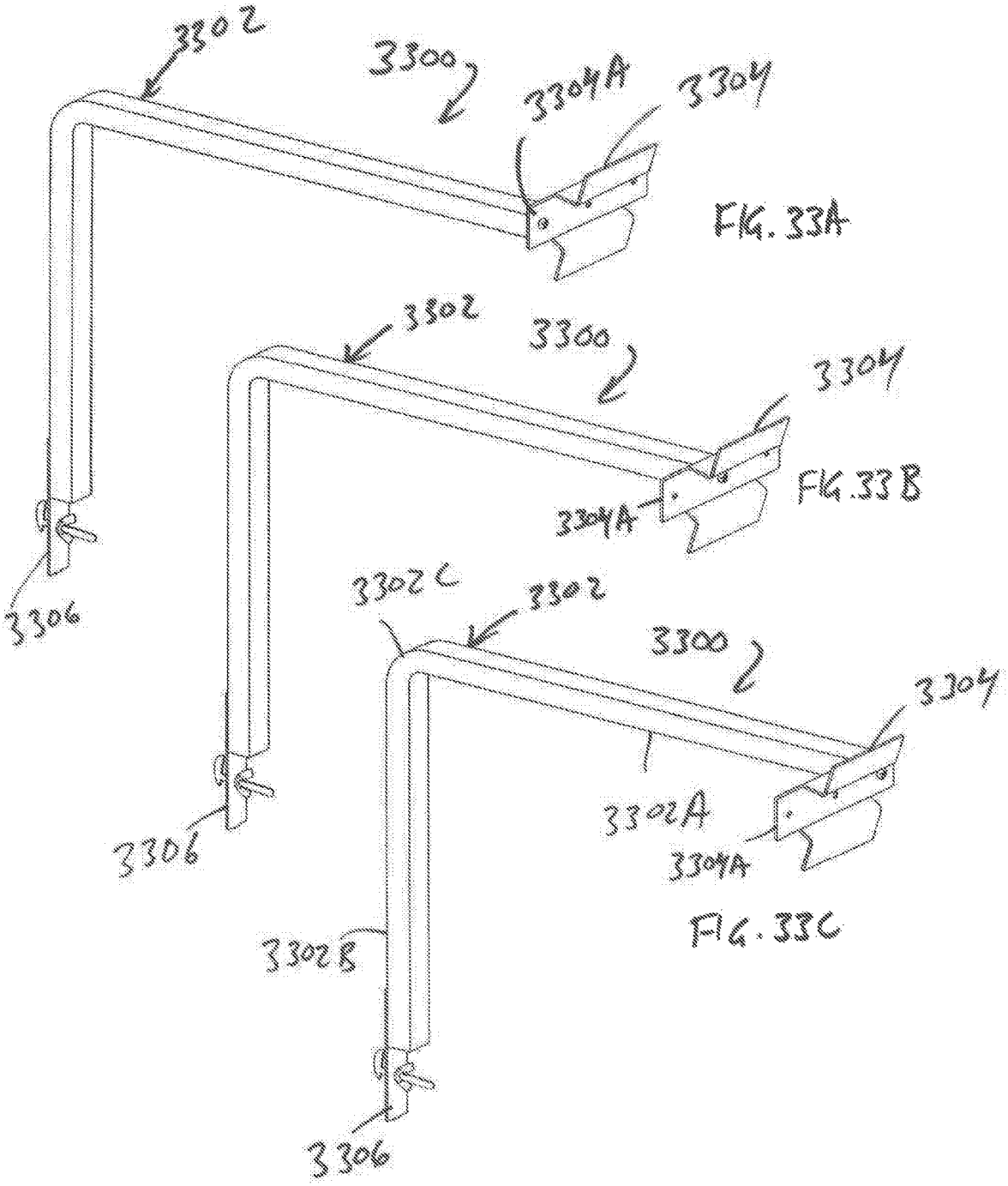

FIG. 33A is a perspective view of another signage assembly in accordance with the present teachings.

FIG. 33B is another perspective view of the signage assembly of FIG. 33A.

FIG. 33C is another perspective view of the signage assembly of FIG. 33A.

Figure 33D:
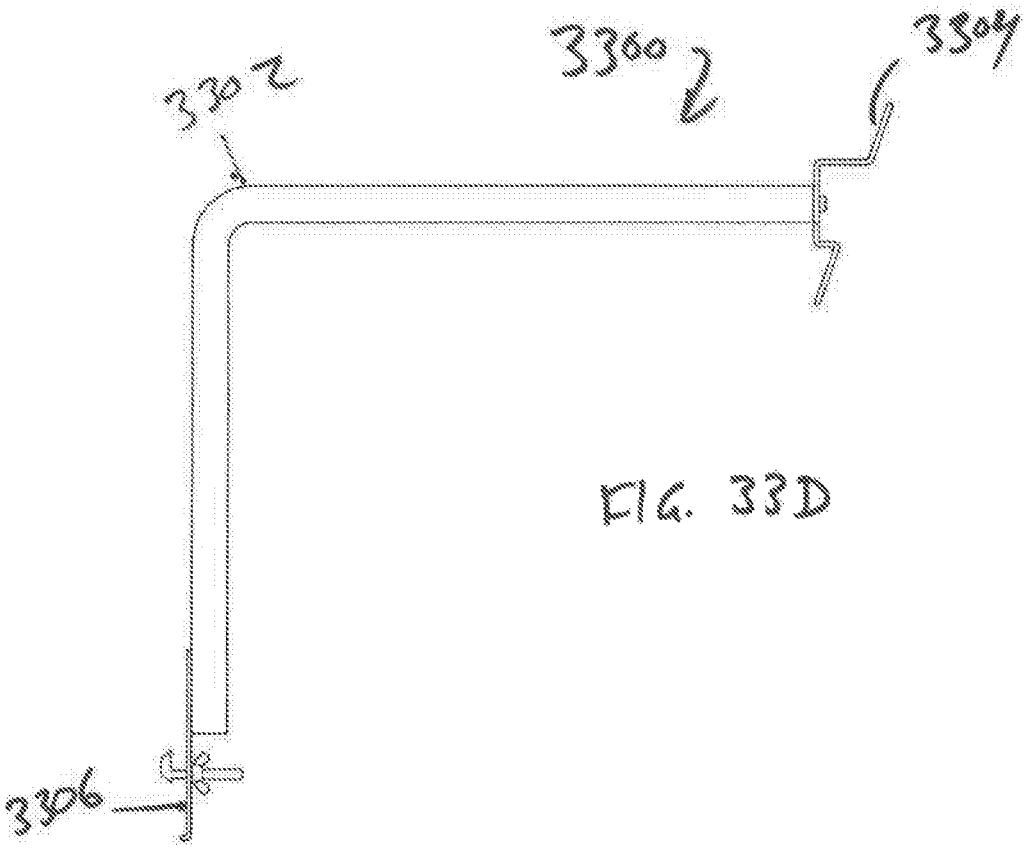

FIG. 33D is a left side view of the signage assembly of FIG. 33A.

Figure 33E:
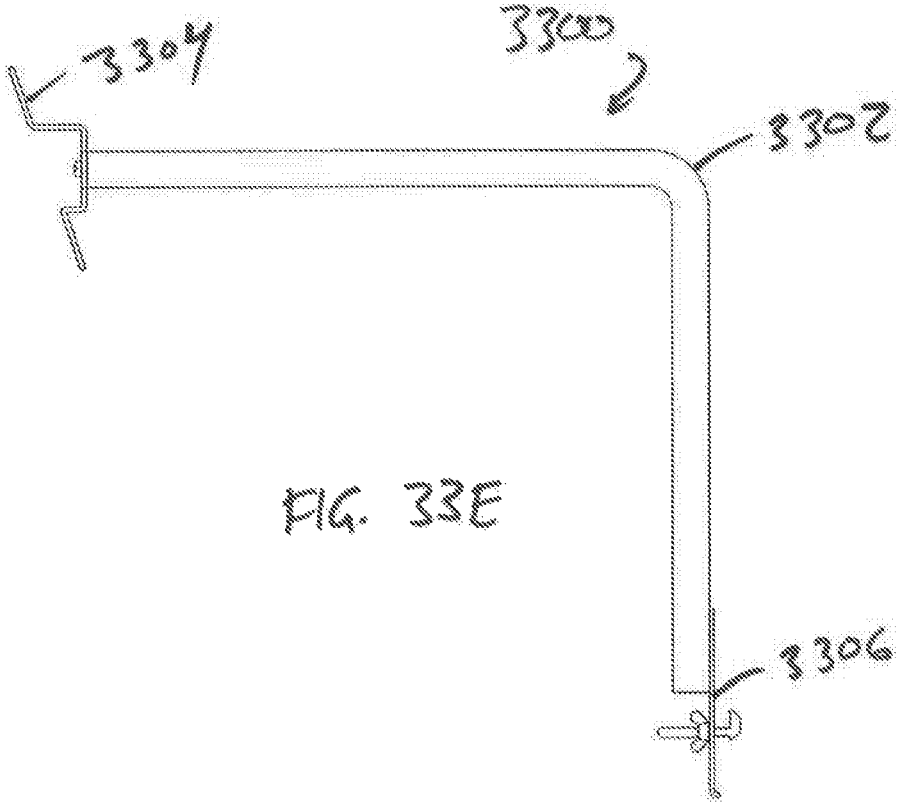

FIG. 33E is a right side view of the signage assembly of FIG. 33A.

Figure 33F:
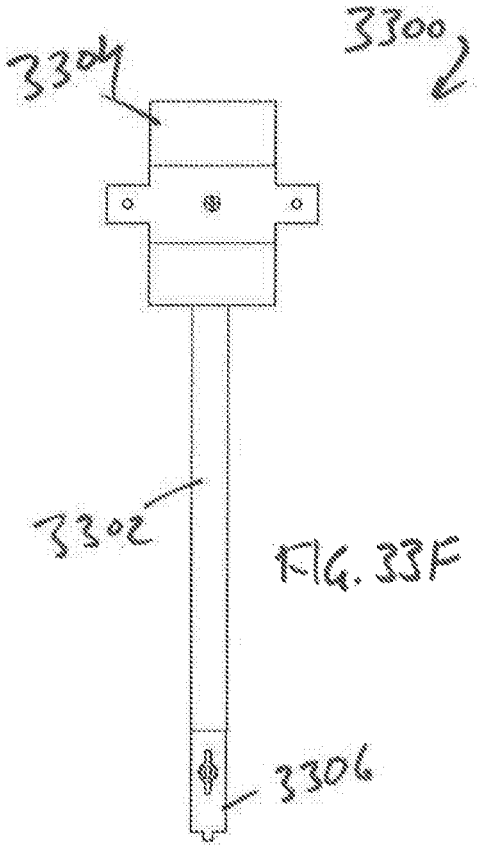

FIG. 33F is a front view of the signage assembly of FIG. 33A.

Figure 33G:
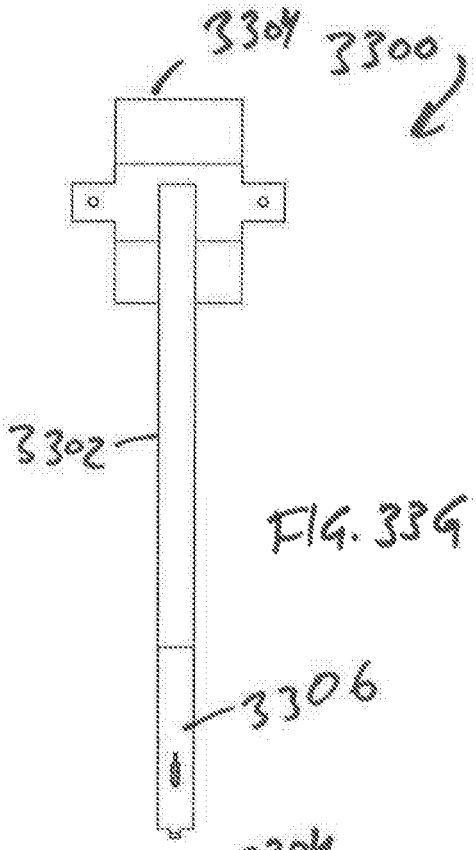

FIG. 33G is a rear view of the signage assembly of FIG. 33A.

Figure 33H:
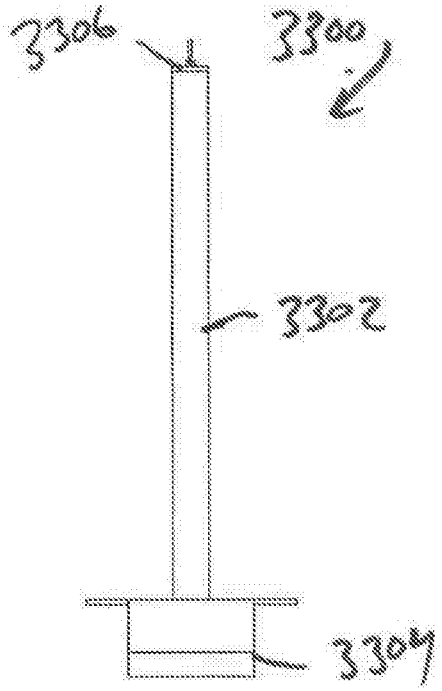

FIG. 33H is a top view of the signage assembly of FIG. 33A.

Figure 33I:
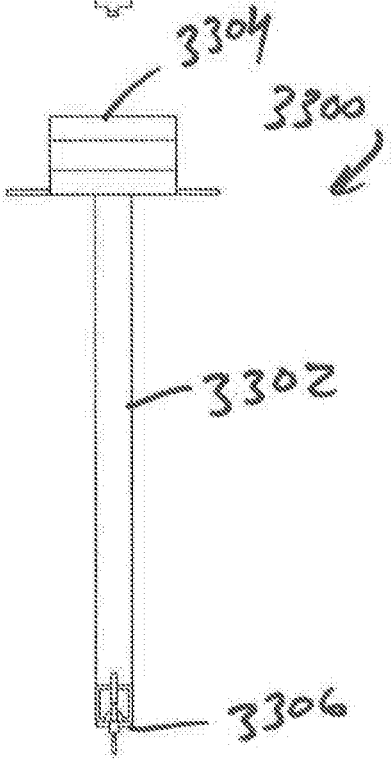

FIG. 33I is a bottom view of the signage assembly of FIG. 33A.

Figure 34A:
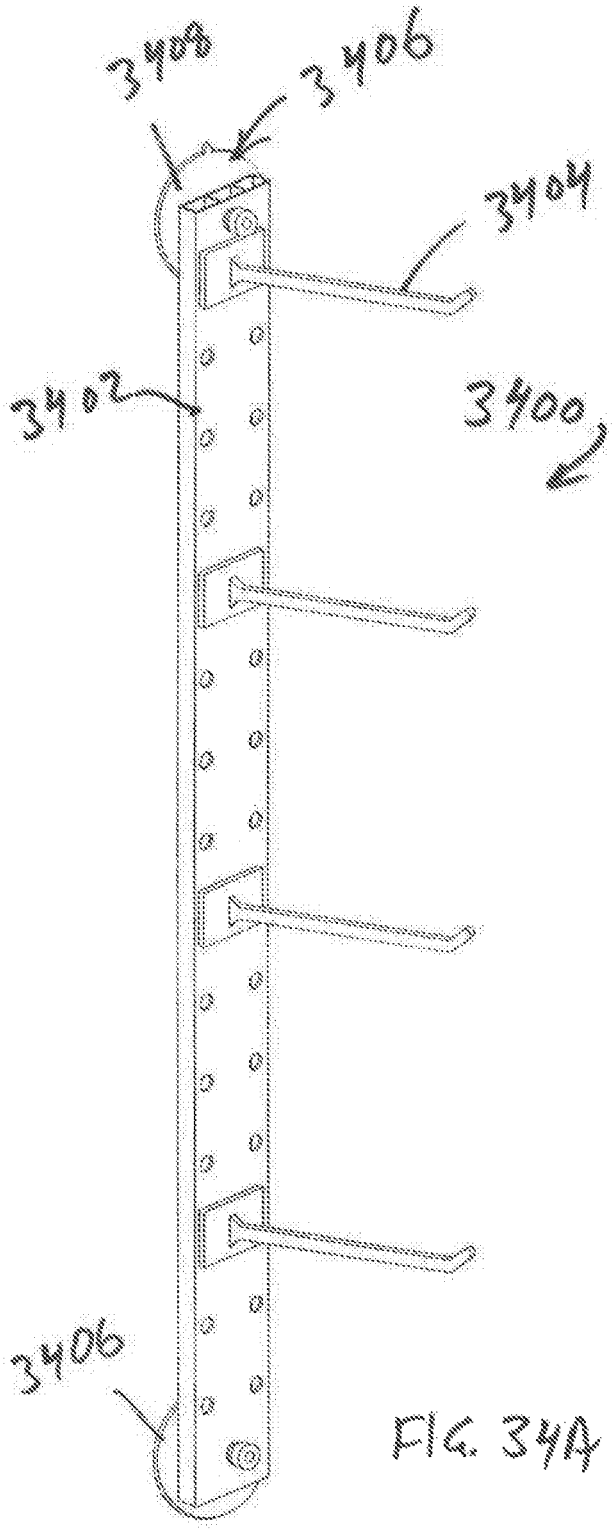

FIG. 34A is a perspective view of another merchandising display assembly in accordance with the present teachings.

Figures 34B, 34C, 34D, 34E, 34F, 34G:
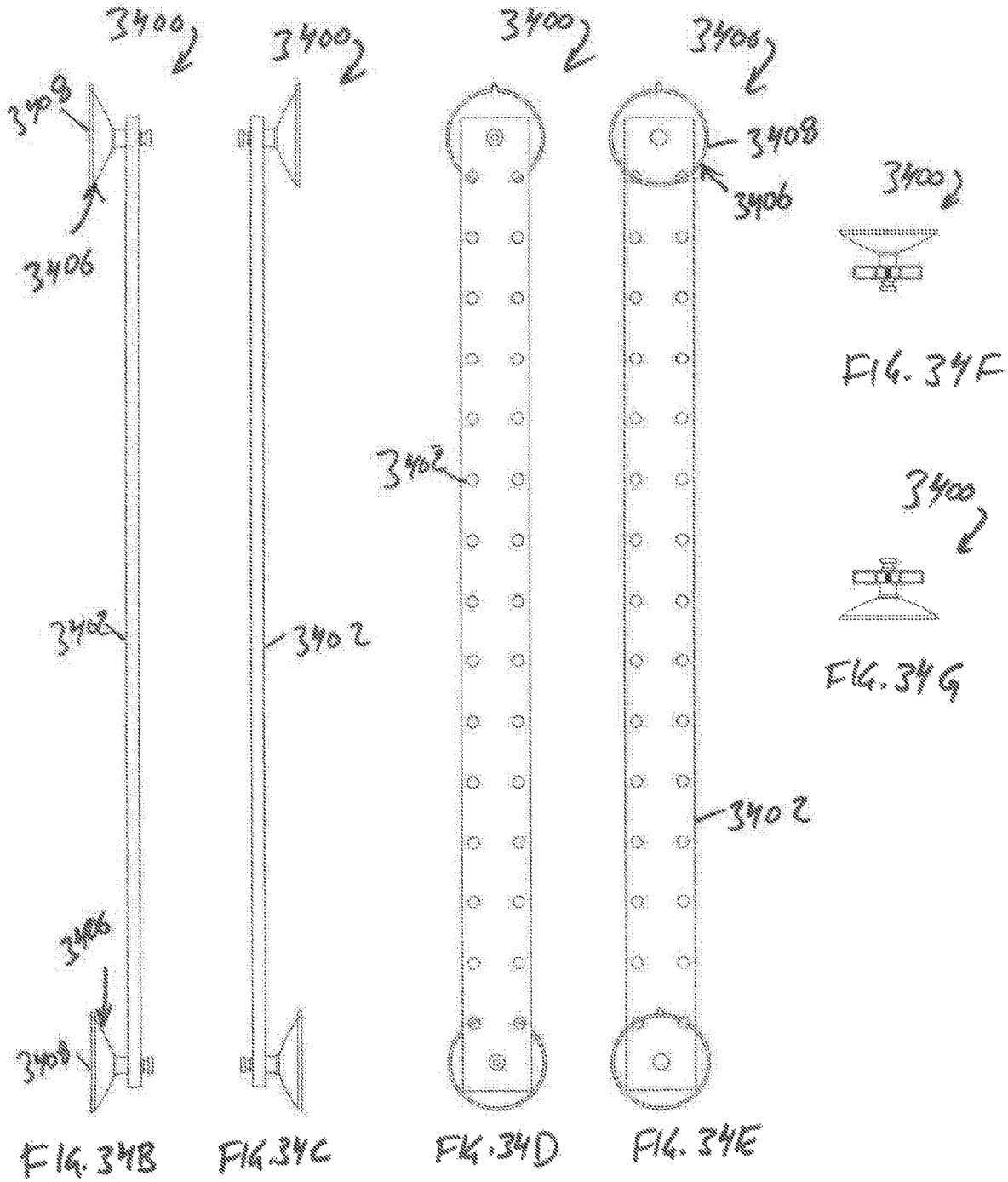

FIG. 34B is a left side view of the merchandising display assembly of FIG. 34A.

FIG. 34C is a right side view of the merchandising display assembly of FIG. 34A.

FIG. 34D is a front view of the merchandising display assembly of FIG. 34A.

FIG. 34E is a rear view of the merchandising display assembly of FIG. 34A.

FIG. 34F is a top view of the merchandising display assembly of FIG. 34A.

FIG. 34G is a bottom view of the merchandising display assembly of FIG. 34A.

Figure 35A:
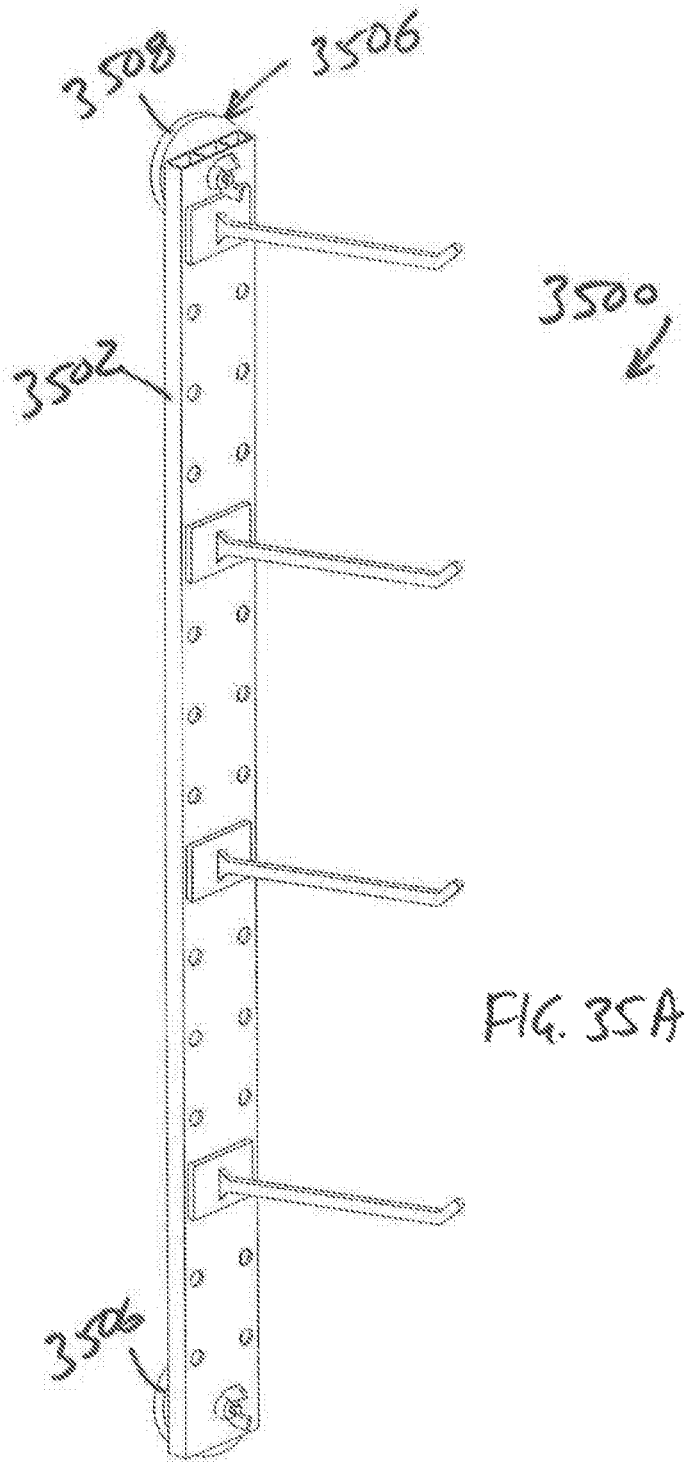

FIG. 35A is a perspective view of another merchandising display assembly in accordance with the present teachings.

Figures 35B, 35C, 35D, 35E, 35F, 35G:
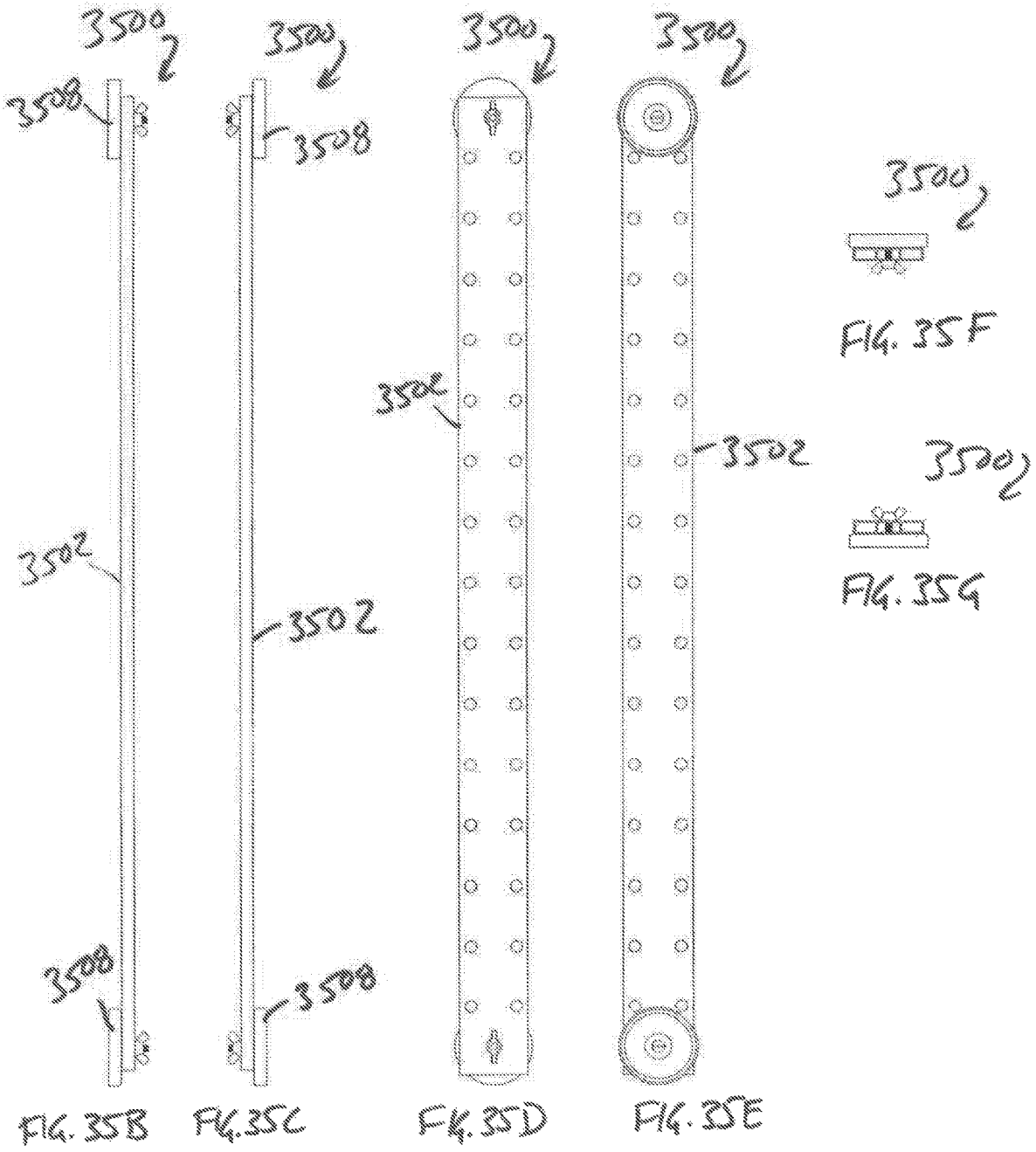

FIG. 35B is a left side view of the merchandising display assembly of FIG. 35A.

FIG. 35C is a right side view of the merchandising display assembly of FIG. 35A.

FIG. 35D is a front view of the merchandising display assembly of FIG. 35A.

FIG. 35E is a rear view of the merchandising display assembly of FIG. 35A.

FIG. 35F is a top view of the merchandising display assembly of FIG. 35A.

FIG. 35G is a bottom view of the merchandising display assembly of FIG. 35A.

It will be understood that the various embodiments shown throughout the application are drawn to scale. Like reference characters have been used throughout the various views to identify like elements.

DESCRIPTION OF VARIOUS ASPECTS

The following description is merely exemplary in nature and is in no way intended to limit the invention, its application, or uses.

With initial reference to FIGS. 1A-1H, a signage system in accordance with the present teachings is illustrated and generally identified at reference character 100. The signage system may be an overhead signage system 100. The system 100 may include a sign holding member 102 having a front panel 104 and a pair of side panels 106. The side panels 106 may be substantially identical. In the embodiment illustrated, the front panel 104 may define a single channel for receiving a single sign and the side panels 106 may include a plurality of channels for receiving a plurality of signs. As will be described below in connection with FIGS. 6A-6G, the signage system 100 may additionally include a frame 600 for mounting the sign holding member 102 to uprights of a conventional gondola 10. The sign holding member 102 may be secured to the frame 600 with conventional fasteners.

Figure 1A:
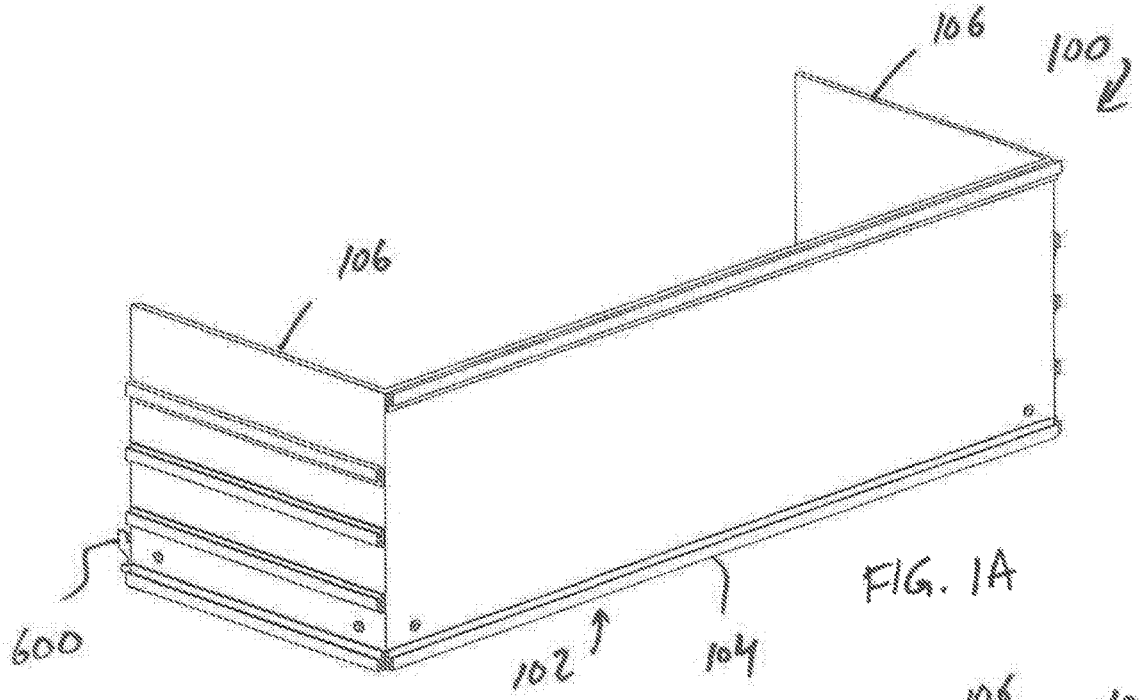
FIG. 1A is a perspective view of a signage system in accordance with the present teachings.
Figure 1B:
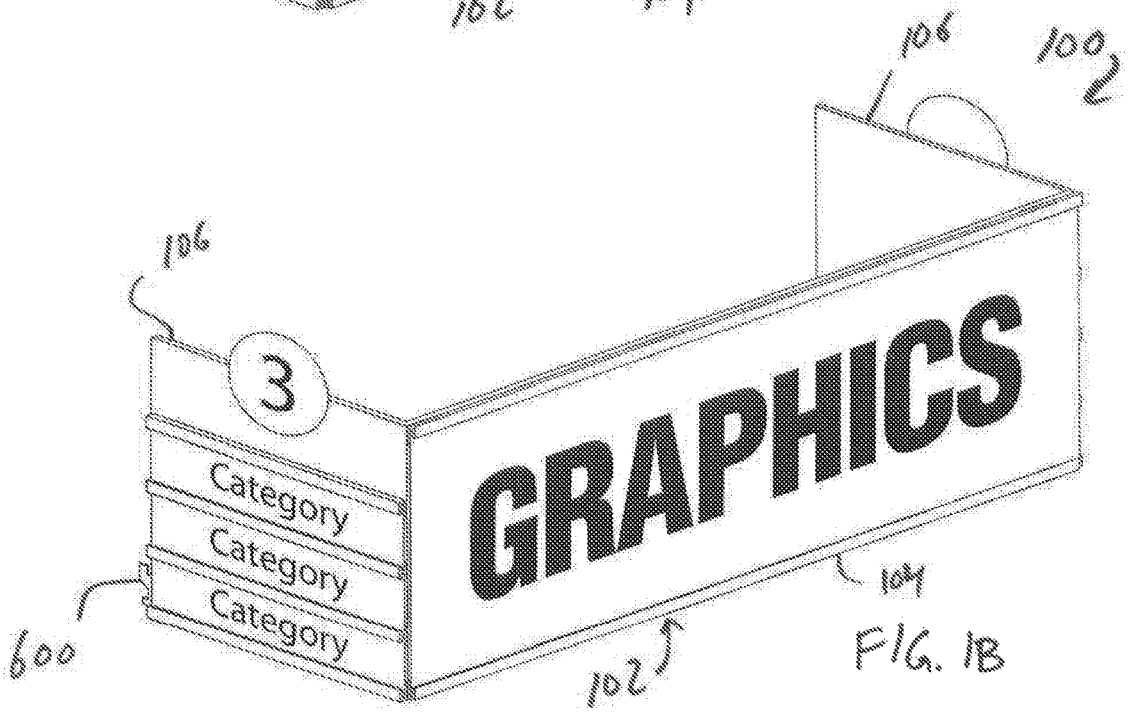
FIG. 1B is another perspective view of the signage system of FIG. 1A.
Figure 1C:
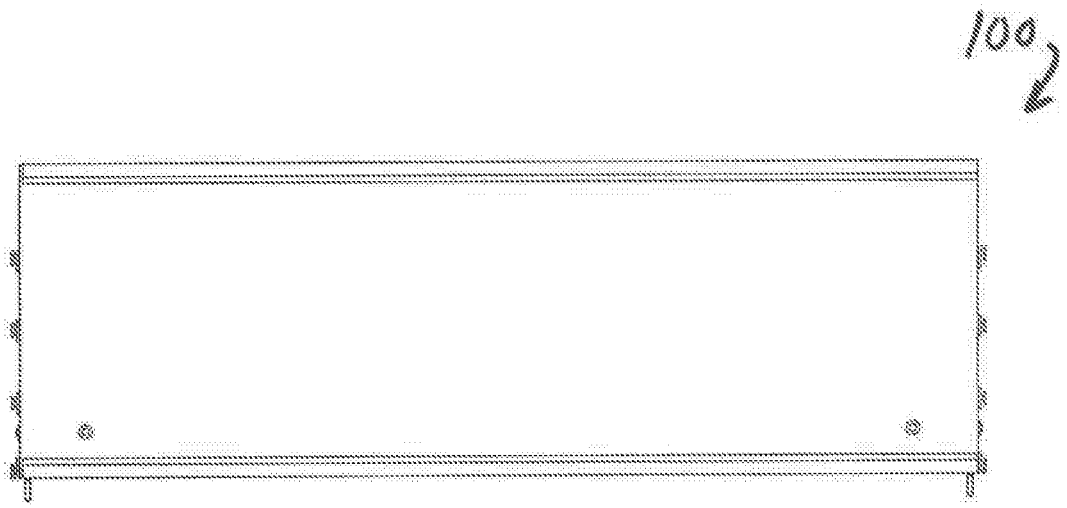
FIG. 1C is front view of the signage system of FIG. 1A.
Figure 1D:
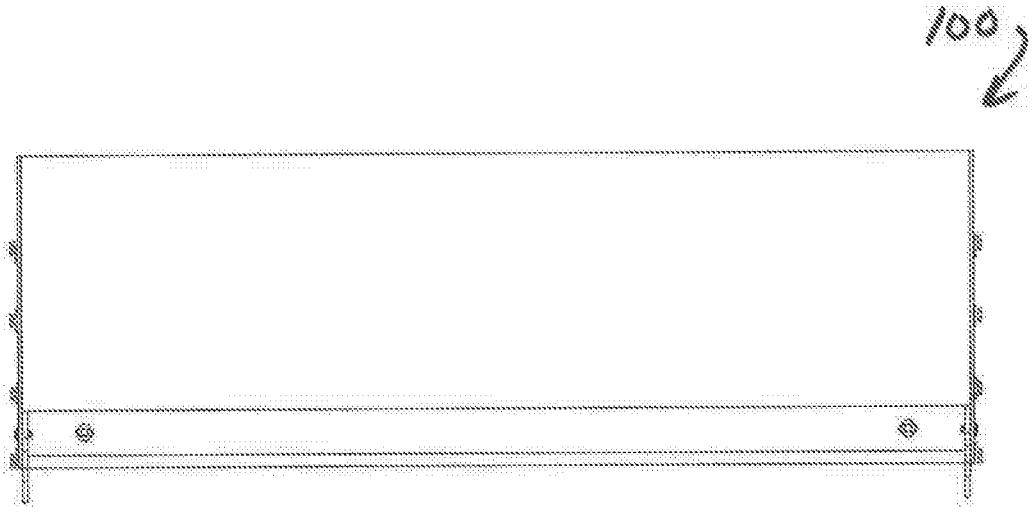
FIG. 1D is rear view of the signage system of FIG. 1A.
Figure 1E:
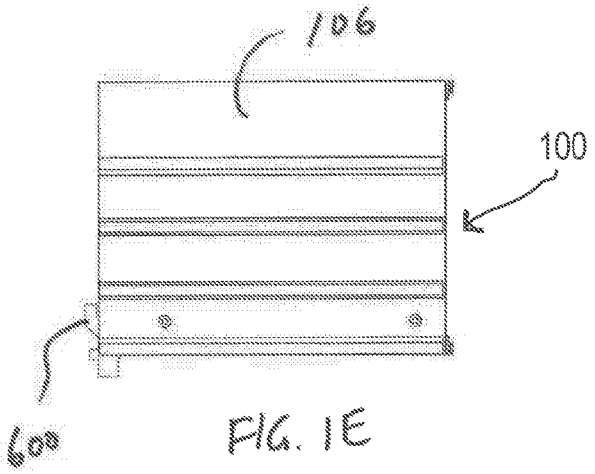
FIG. 1E is a left side view of the signage system of FIG. 1A.
Figure 1F:
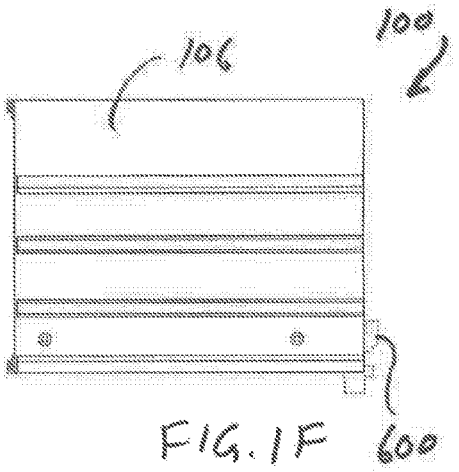
FIG. 1F is right side view of the signage system of FIG. 1A.
Figure 1G:
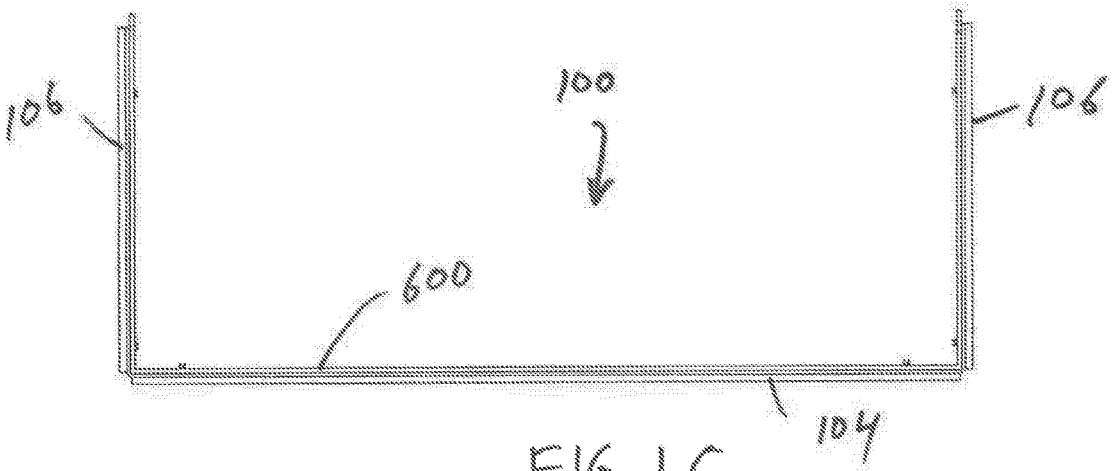
FIG. 1G is top view of the signage system of FIG. 1A.
Figure 1H:
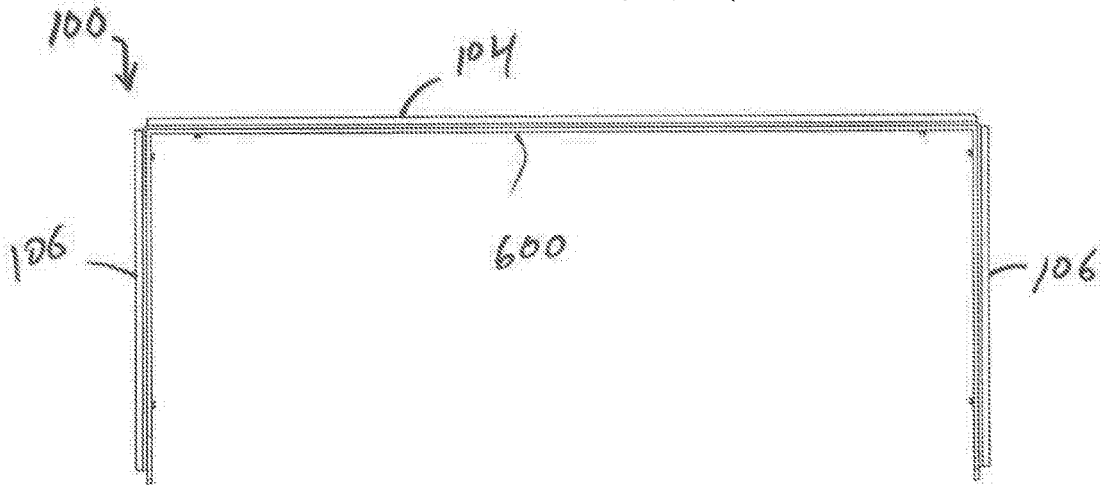
FIG. 1H is bottom view of the signage system of FIG. 1A.
Figure 2:
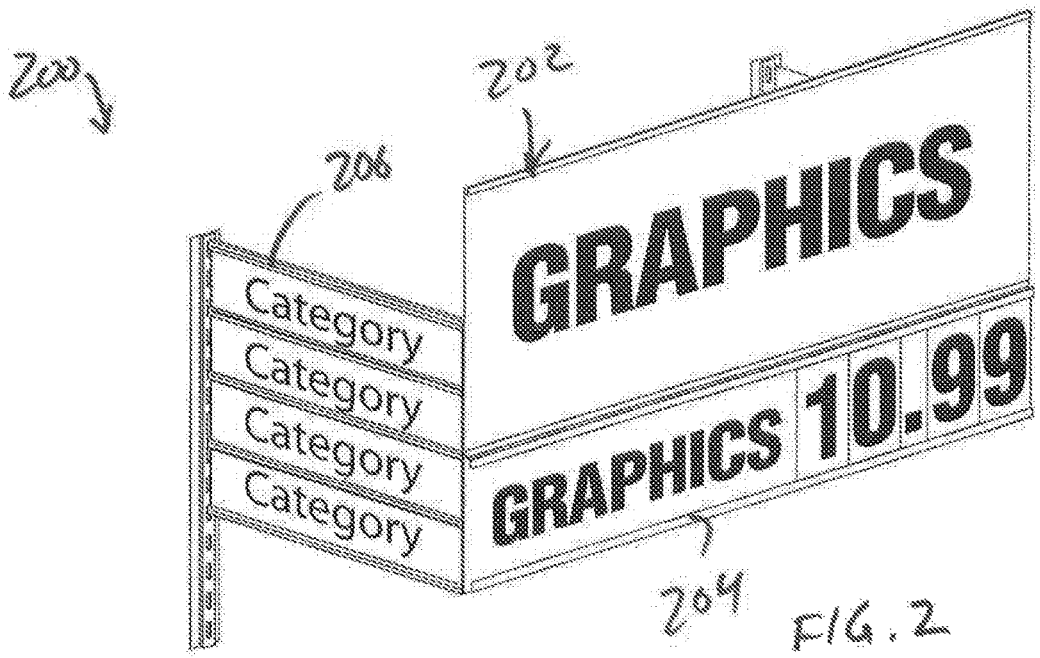
FIG. 2 is a perspective view of another signage system in accordance with the present teachings.
Figure 2A:
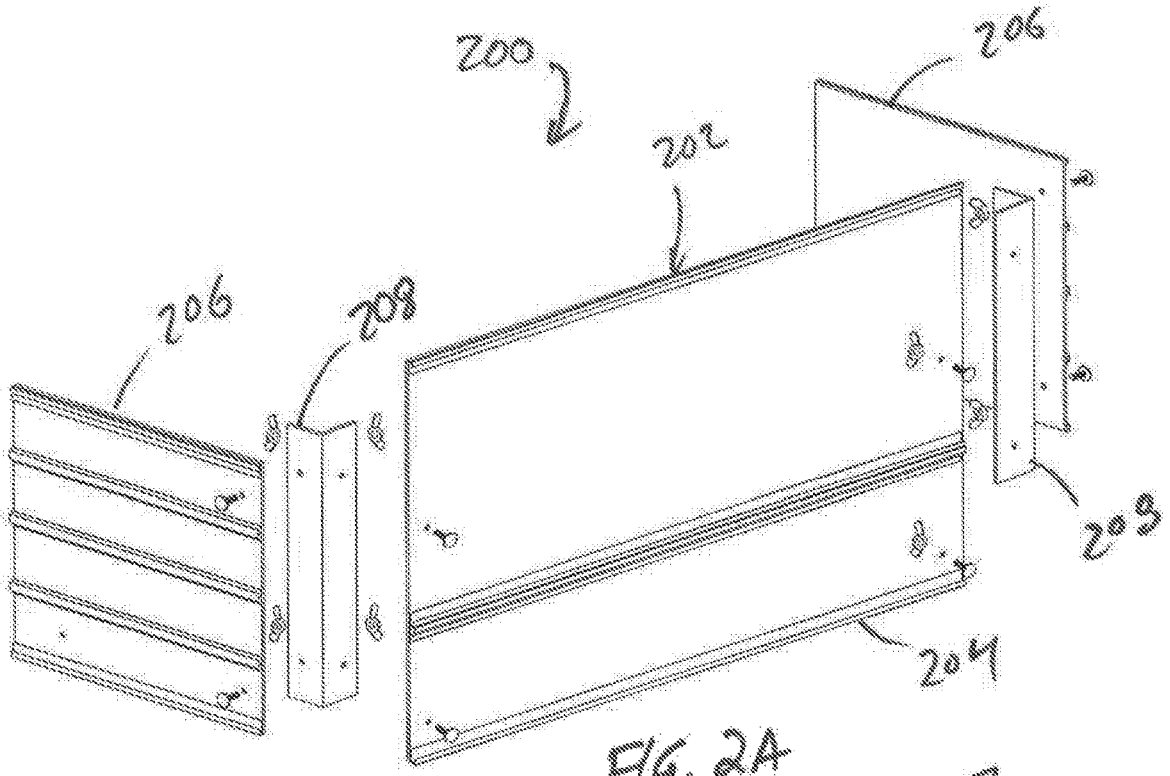
FIG. 2A is an exploded view of the signage system of FIG. 2.
Figure 2B:
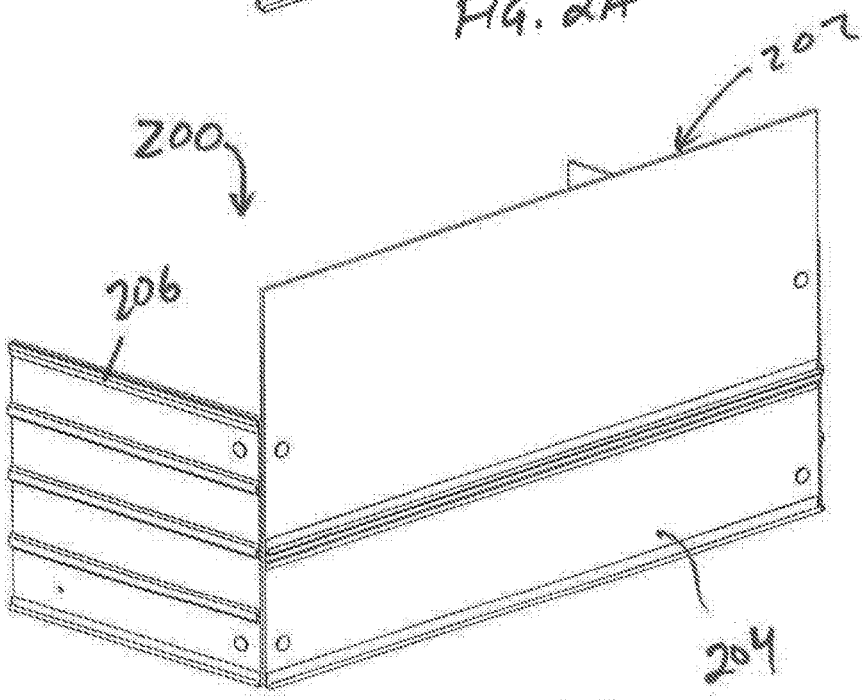
FIG. 2B is a perspective view of the signage system of FIG. 2A.

Turning to FIGS. 2, 2 and 2B, another signage system in accordance with the present teachings is shown and generally identified at reference character 200. The signage system 200 includes an alternative sign holding member 202 having a front panel 204 and a pair of side panels 206. The side panels 206 may be coupled to the front panel 204 through a pair of vertically extending braces 208. The braces 208 may be L-shaped. Attachment of the front and side panels 204 and 206 to the braces 208 may be done with conventional fasteners.

Figure 3:
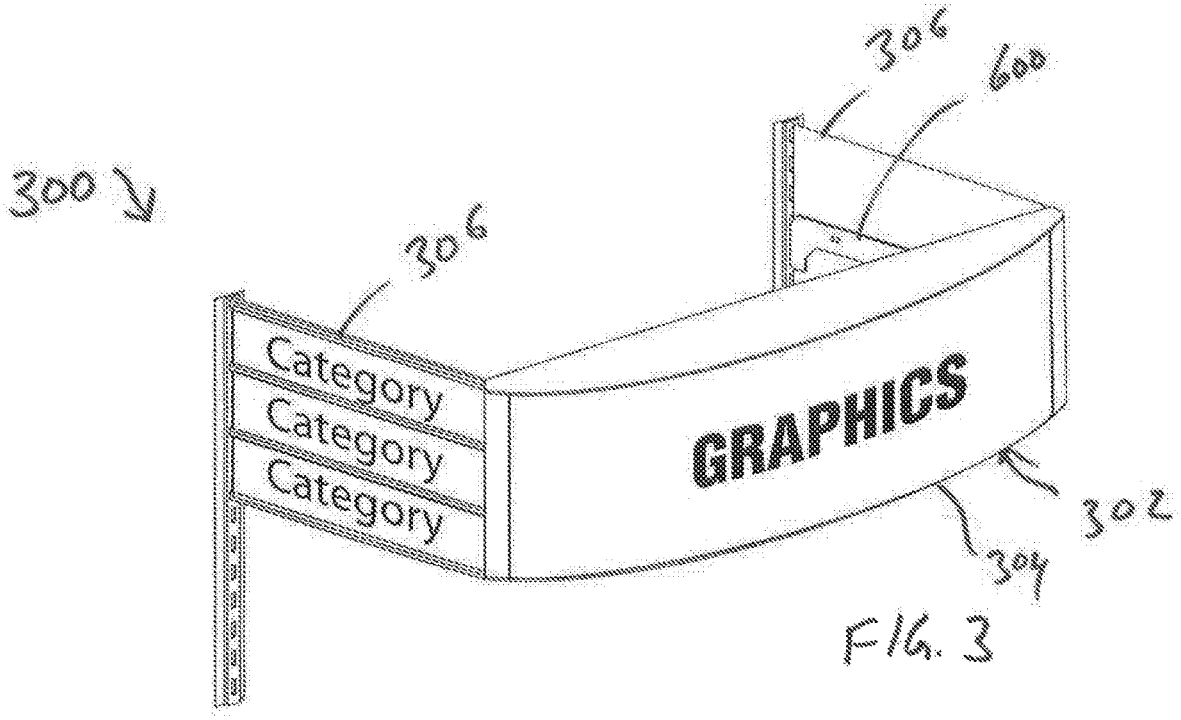
FIG. 3 is a perspective view of another signage system in accordance with the present teachings.

Turning to FIG. 3, another signage system in accordance with the present teachings is illustrated and generally identified at reference character 300. The signage system 300 includes an alternative sign holding member 302 again having a front panel 304 and a pair of side panels 306.

Figure 4:
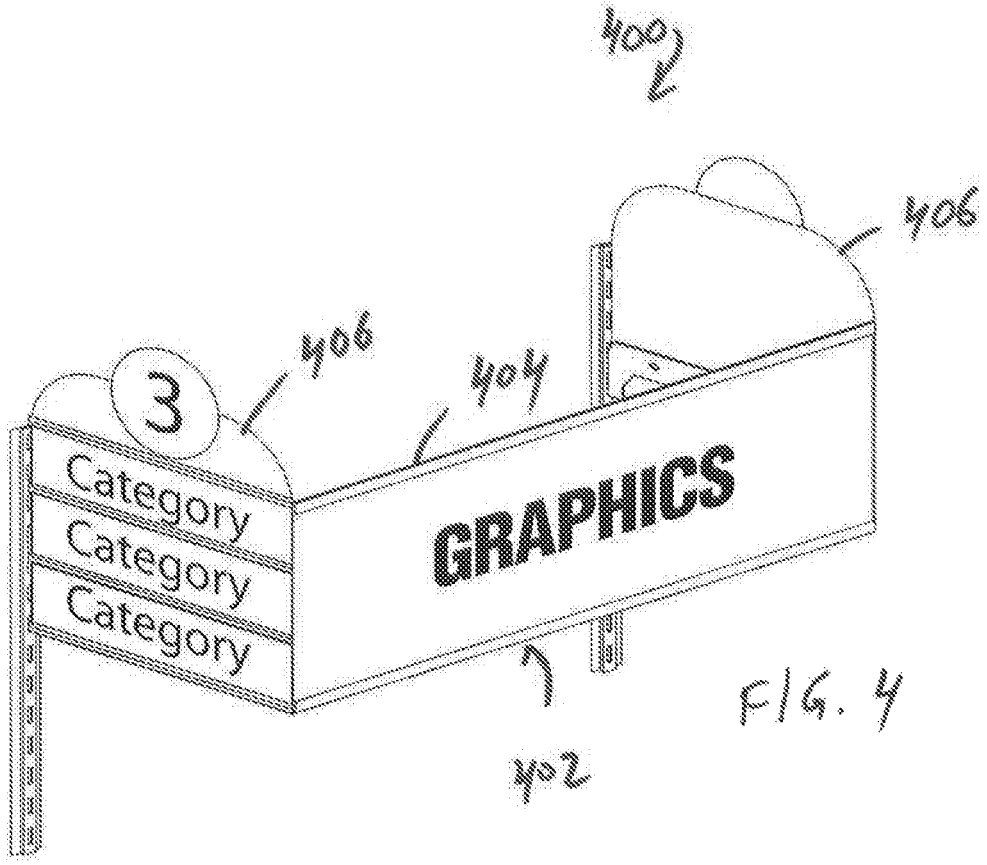
FIG. 4 is a perspective view of another signage system in accordance with the present teachings.

Turning to FIG. 4, another signage system in accordance with the present teachings is illustrated and generally identified at reference character 400. The signage system 400 includes an alternative sign holding member 402 again having a front panel 404 and a pair of side panels 406.

Figure 5:
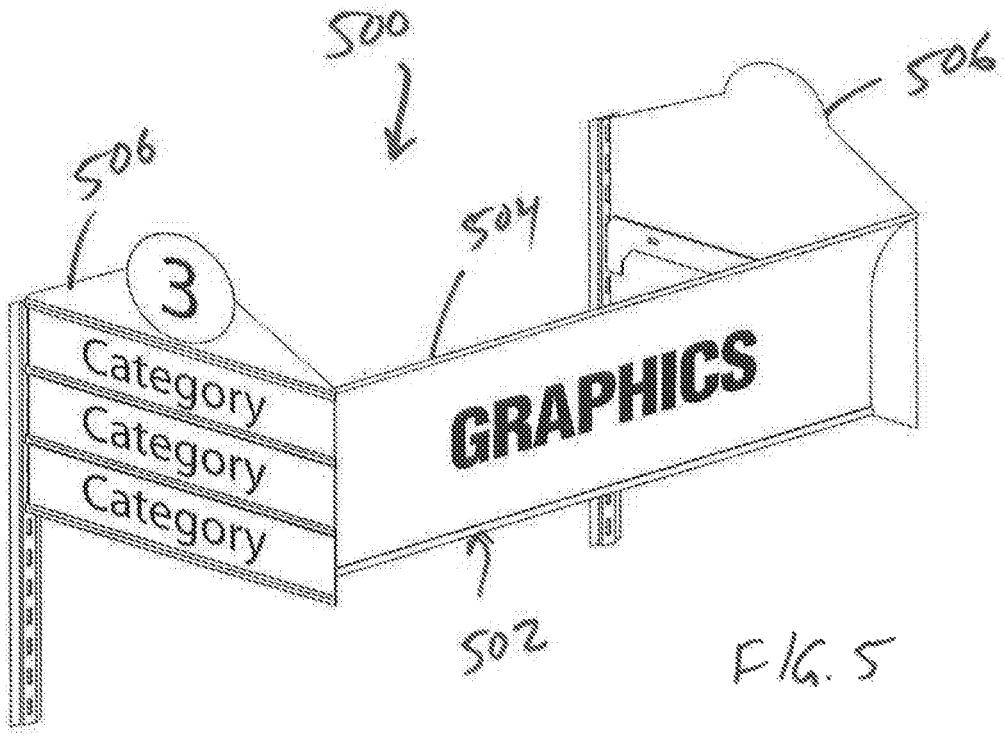
FIG. 5 is a perspective view of another signage system in accordance with the present teachings.
Figure 6A:
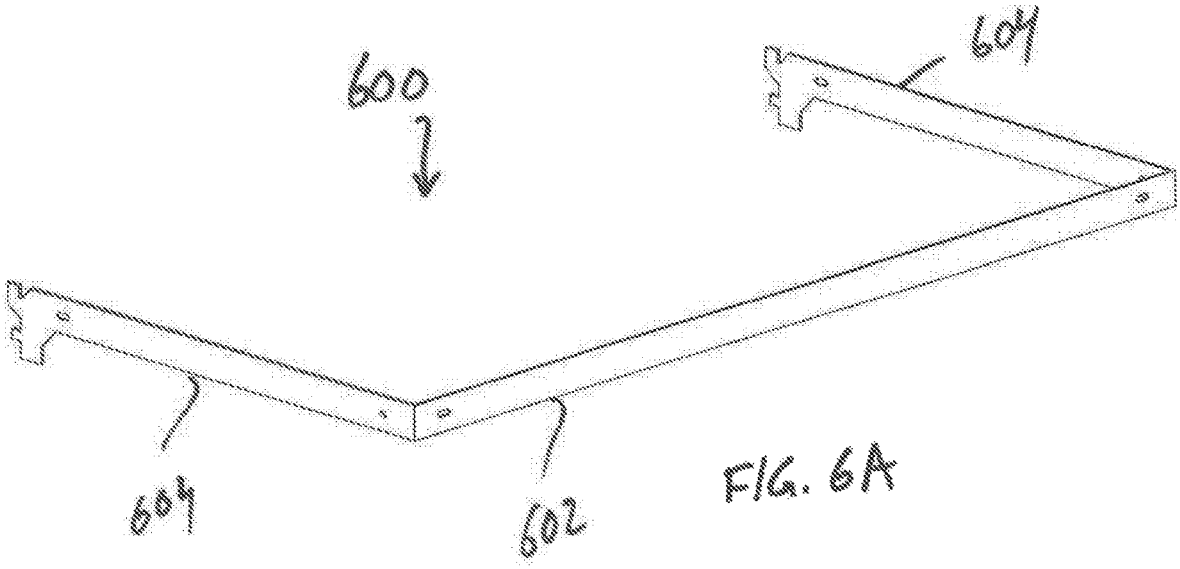
FIG. 6A is a perspective view of bracket for use with the signage systems of FIGS. 2 through 5.
Figure 6B:
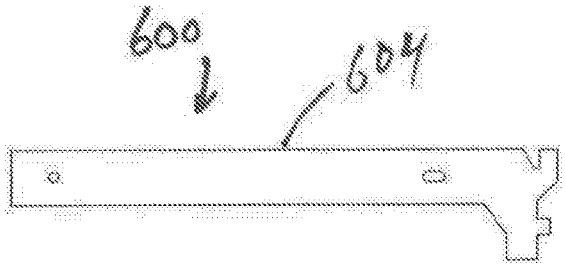
FIG. 6B is a right side view of the bracket of FIG. 6A.
Figure 6C:
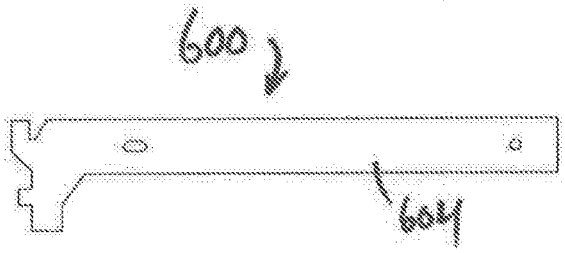
FIG. 6C is a left side view of the bracket of FIG. 6A.
Figure 6D:
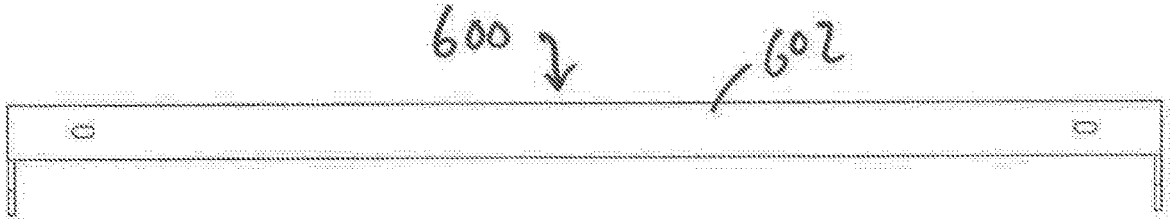
FIG. 6D is front view of the bracket of FIG. 6A.
Figure 6E:
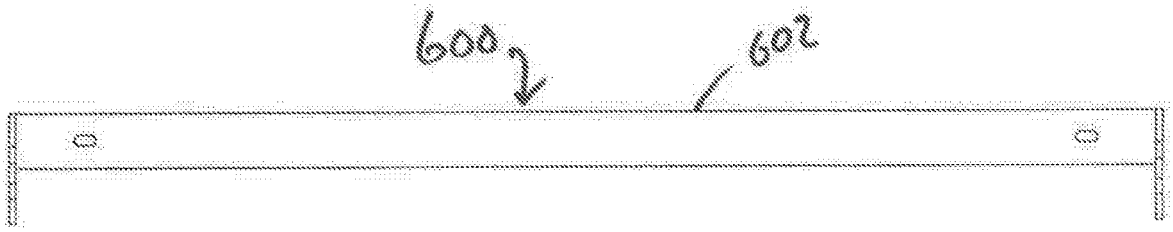
FIG. 6E is rear view of the bracket of FIG. 6A.
Figure 6F:
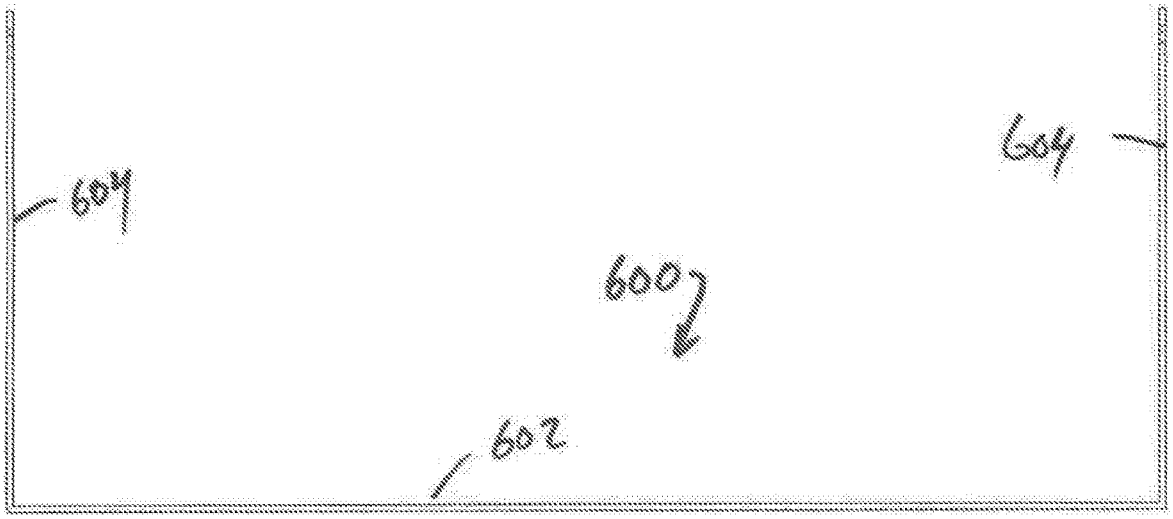
FIG. 6F is a top view of the bracket of FIG. 6A.
Figure 6G:
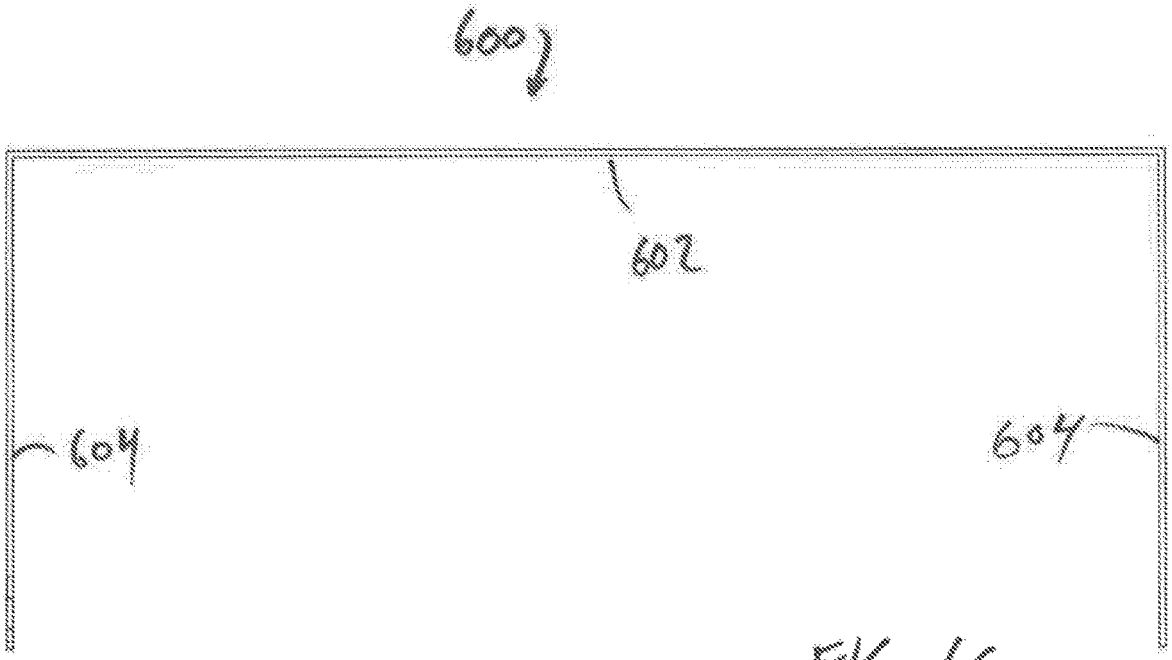
FIG. 6G is a bottom view of the bracket of FIG. 6A.
Figure 7A:
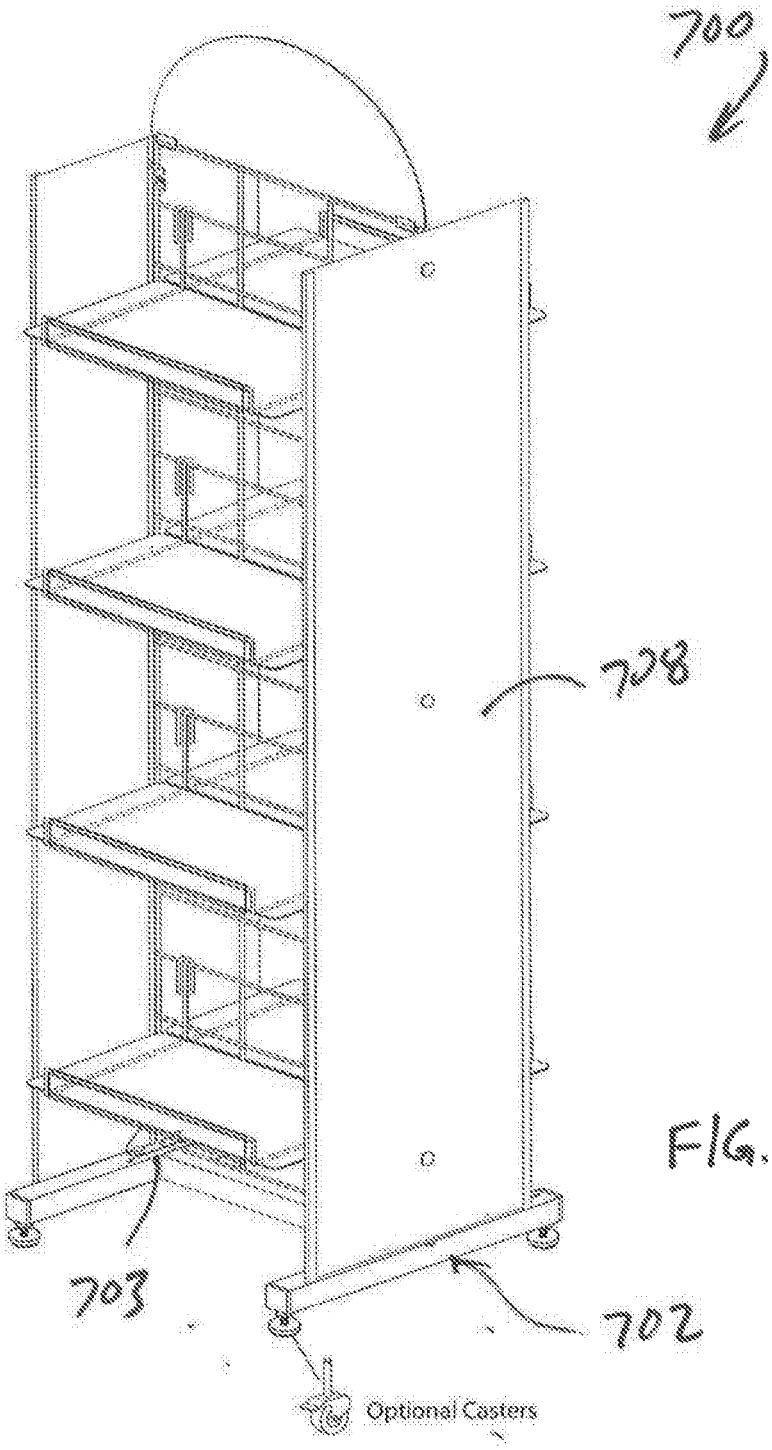
FIG. 7A is a perspective view of a merchandising display in accordance with the present teachings.
Figure 7B:
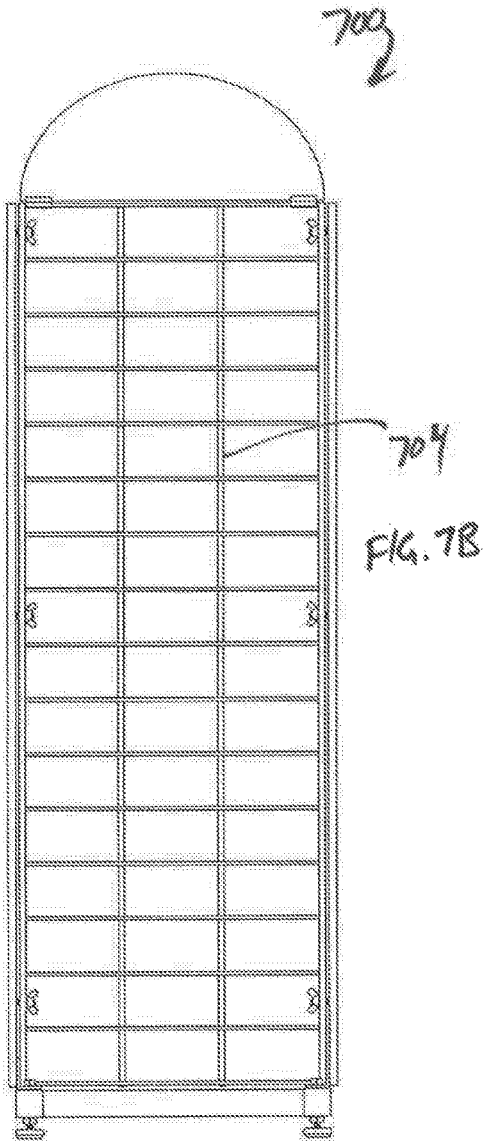
FIG. 7B is a front view of the merchandising display of FIG. 7A, it being understood that the view opposite thereof is a mirror image.
Figure 7C:
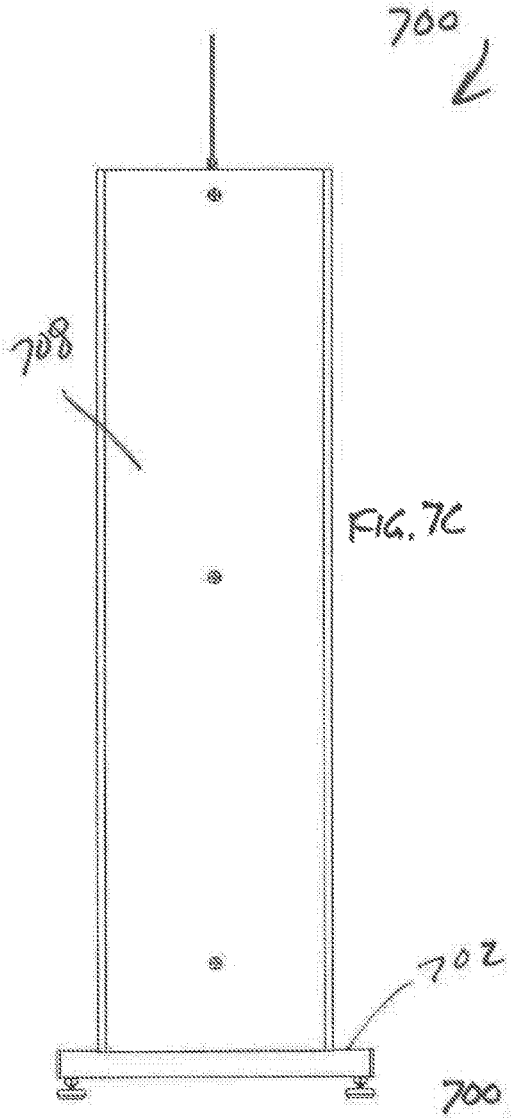
FIG. 7C is a left side view of the merchandising display of FIG. 7A, it being understood that the view opposite thereof is a mirror image.
Figure 7D:
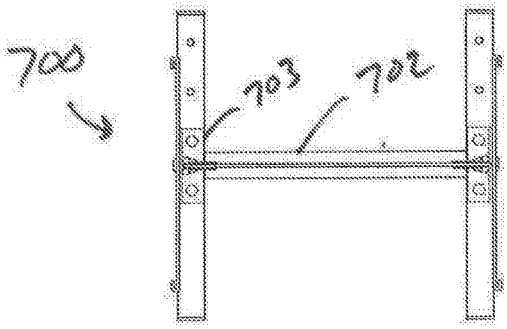
FIG. 7D is a top view of the merchandising display of FIG. 7A.
Figure 7E:
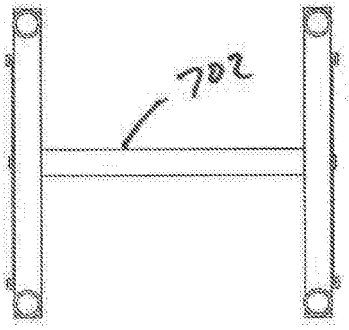
FIG. 7E is a bottom view of the merchandising display of FIG. 7A.
Figure 7F:
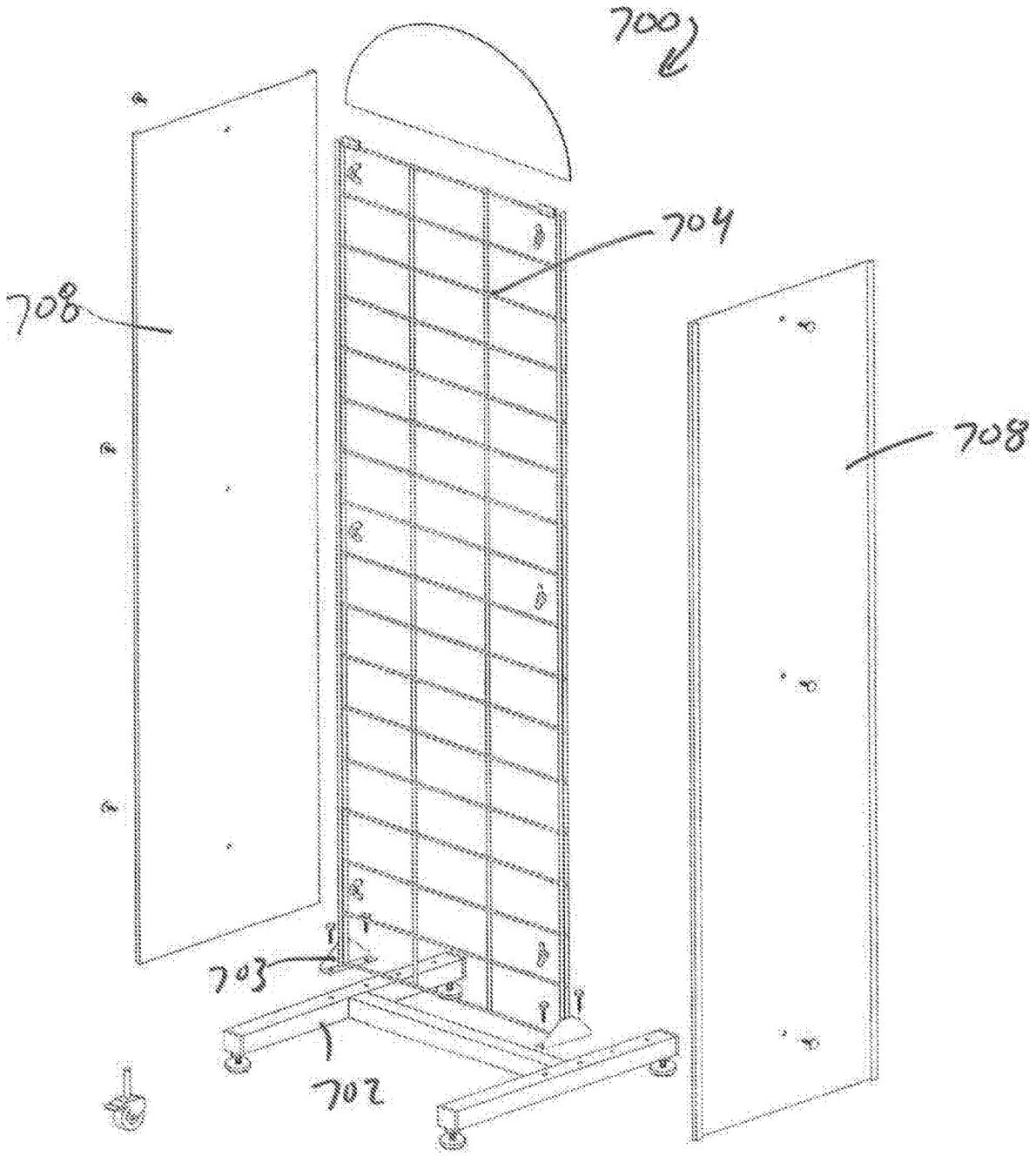
FIG. 7F is an exploded view of the merchandising display of FIG. 7A.
Figure 7G:
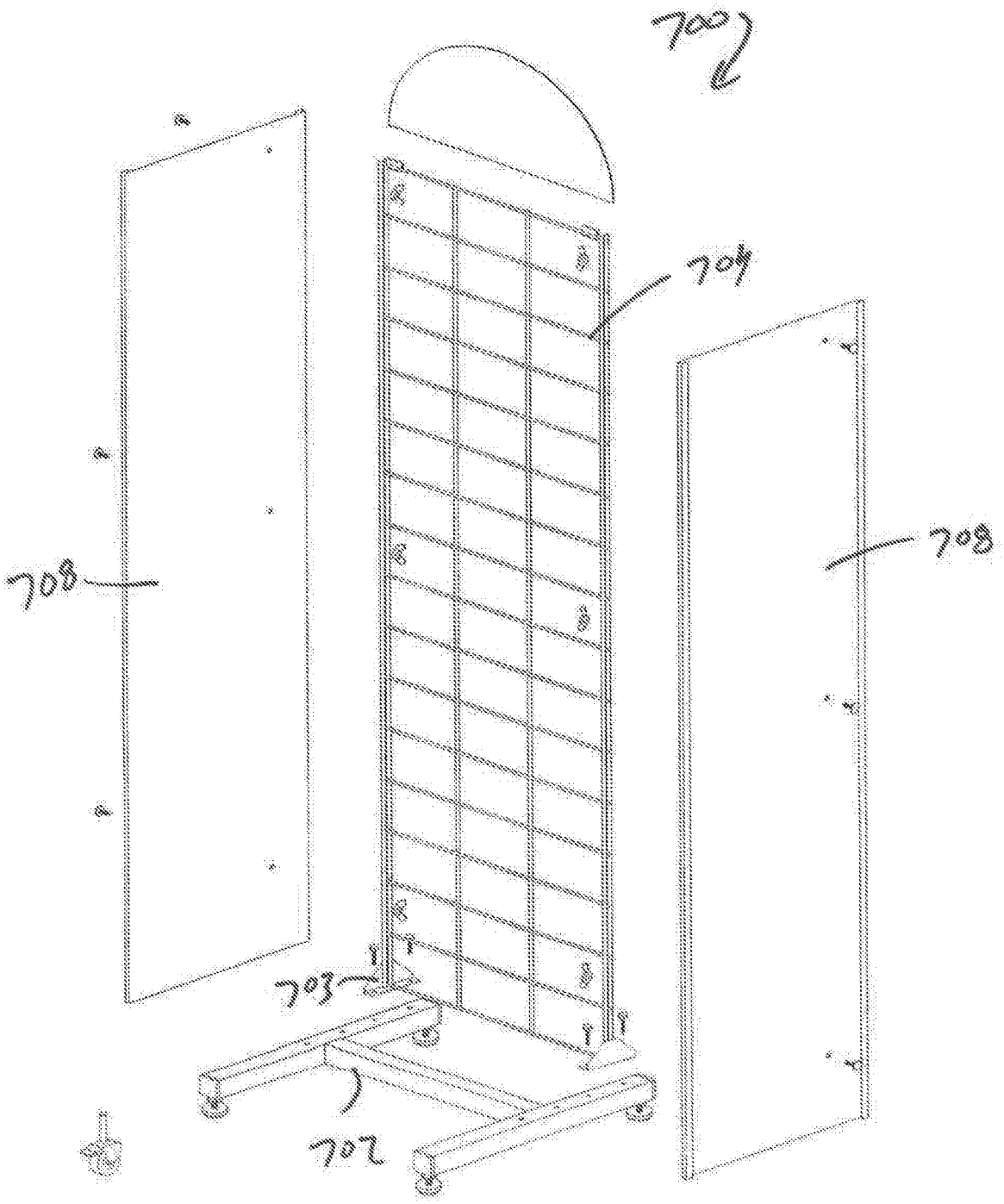
FIG. 7G is another exploded view of the merchandising display of FIG. 7A.

Turning to FIG. 5, another signage system in accordance with the present teachings is illustrated and generally identified at reference character 500. The signage system 500 includes an alternative sign holding member 502 again having a front panel 504 and a pair of side panels 506.

Turning to FIGS. 6A through 6G, the frame 600 for use with the signage systems of FIGS. 2 through 5 is further illustrated. The frame 600 may be formed of a single piece of metal or other suitable material and may be bent to include a front portion 602 and a pair of side portions 604. As with other holes shown throughout the various views, the front and side portions 602 and 604 are formed with holes to receive the conventional fasteners for attachment of the sign holding members of FIGS. 2 through 5. The free ends of both side portions 604 may be configured to conventionally engage uprights of a gondola.

Turning to FIGS. 7A through 7G, a merchandising display in accordance with the present teachings is illustrated and generally identified at reference character 700. The merchandising display 700 is shown to generally include a base 702, a pair of vertically extending uprights 703 and a wire frame 704. The base 702 may include a pair of side members and laterally extending member. The side members and the laterally extending member may each have a square or rectangular cross section. The side members may be welded or otherwise suitable secured to the laterally extending member. The display 700 may include a plurality of feet or may alternatively include a plurality of casters.

The vertically extending uprights 703 may be secured to the side members of the base 702 with conventional fasteners. In the embodiment illustrated, the uprights 703 may be selectively secured to the side members of the base 702 in a plurality of positions. In this regard, the side members are formed to include a plurality of pairs of apertures to receive the fasteners. In the embodiment illustrated in FIGS. 7A through 7F, the uprights 703 are positioned in the middle of the side members of the base 702. An alternative mounting is shown in the exploded view of FIG. 7G. The uprights 703 receive lateral sides of the wire frame 704. Shelves may be carried by the wire frame 704. A pair of side panels 708 may be secured to the uprights 703 with conventional fasteners. The side panels 708 may be configured to receive one or more signs.

Figure 8:
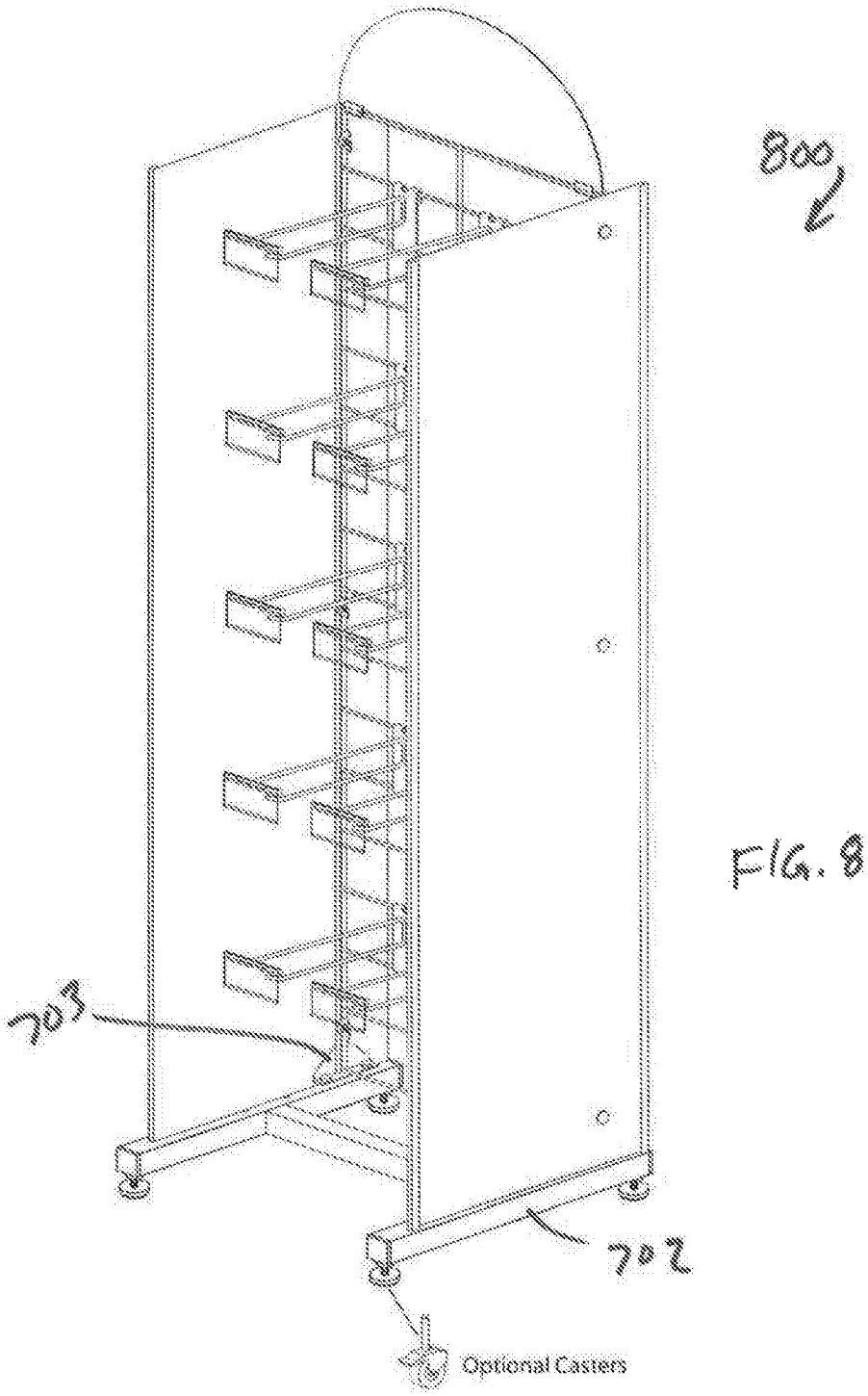
FIG. 8 is a perspective view of another merchandising display in accordance with the present teachings.

Turning to FIG. 8 another merchandising display in accordance with the present teachings is illustrated and generally identified at reference character 800. The display 800 will be understood to be identical to the display 700 except that the uprights 703 are secured to the alternate mounting areas of the base 702.

Figure 9:
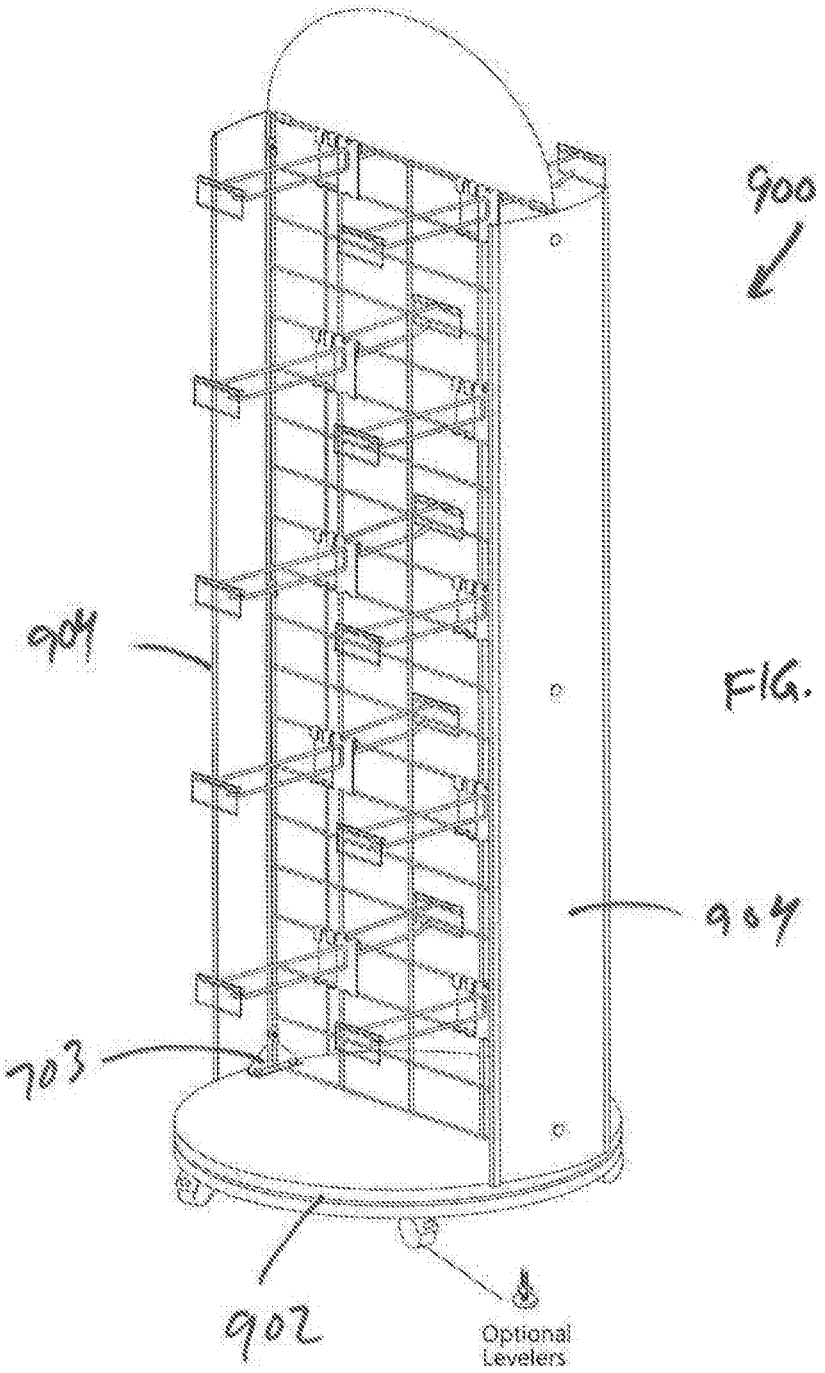
FIG. 9 is a perspective view of another merchandising display in accordance with the present teachings.

Turning to FIG. 9 another merchandising display in accordance with the present teachings is illustrated and generally identified at reference character 900. The display 900 will be understood to be identical to the display 700 except that the display 900 includes a round base 902 to which the uprights 703 are secured and includes alternative side panels 904.

Figure 10A:
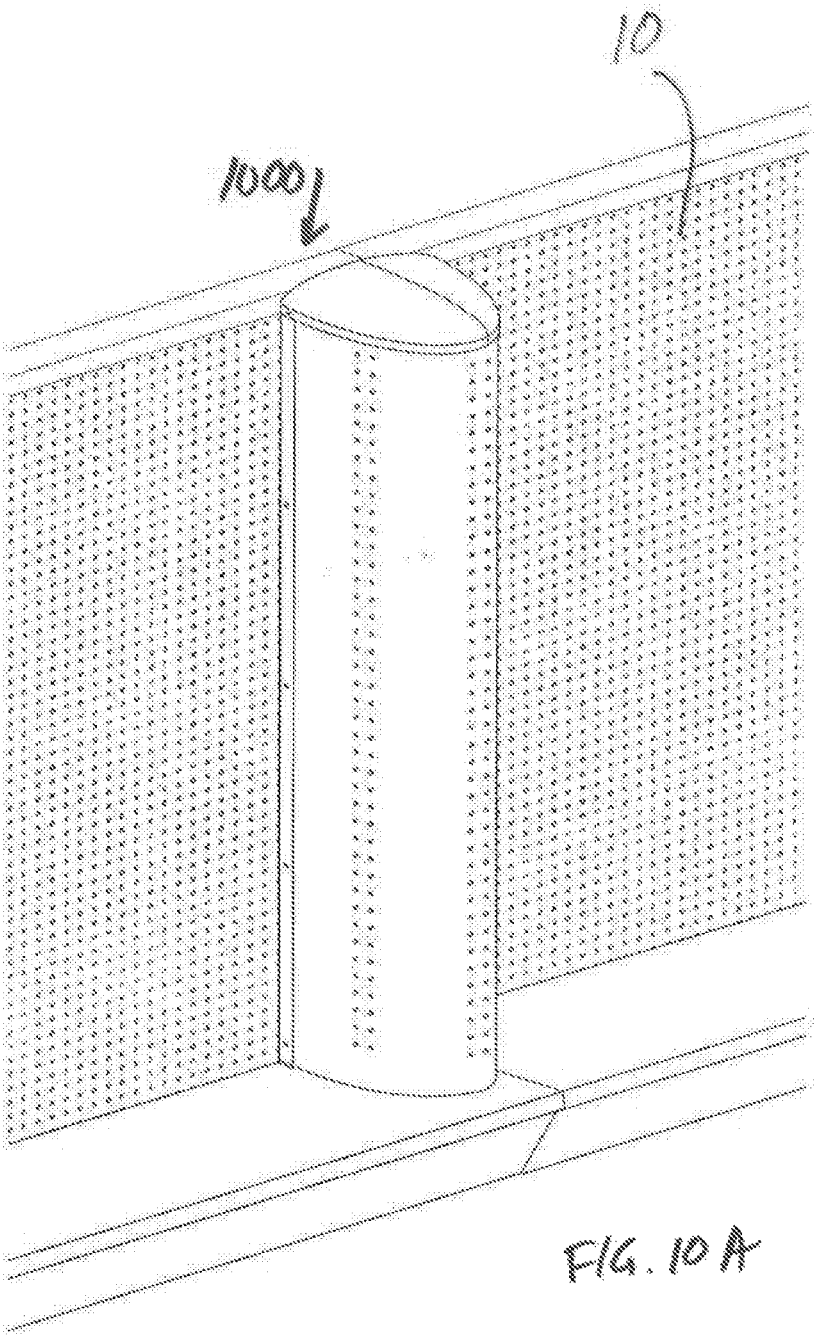
FIG. 10A is a perspective view of another merchandising display in accordance with the present teachings, the merchandising display shown operatively associated with a gondola.
Figure 10B:
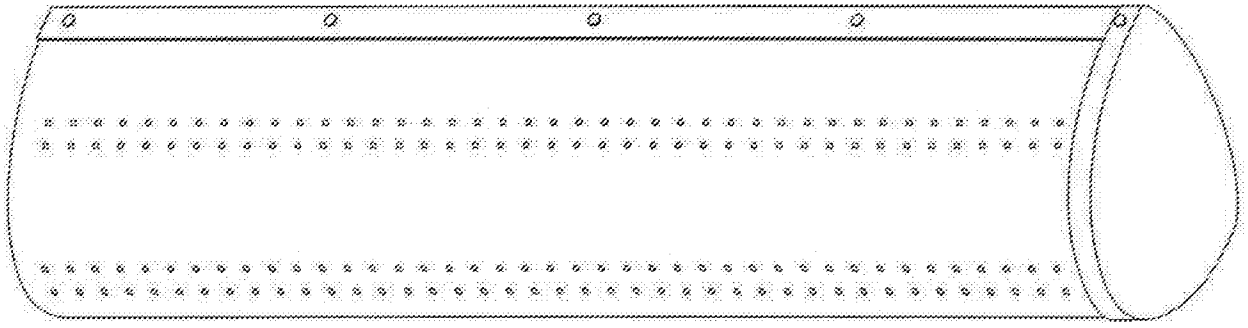
FIG. 10B is another perspective view of the merchandising display of FIG. 10A.
Figure 10C:
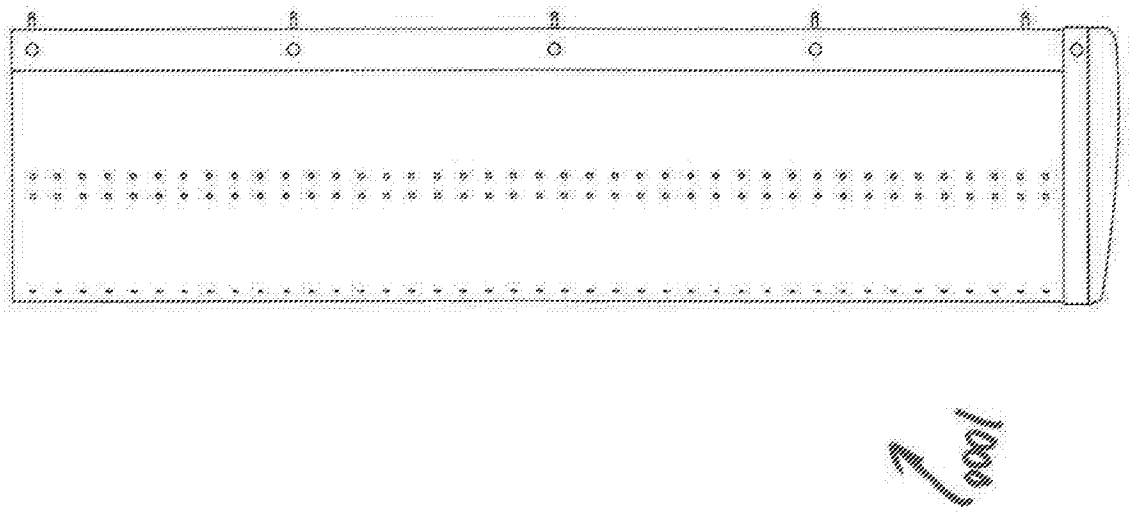
FIG. 10C is a left side view of the merchandising display of FIG. 10A.
Figure 10D:
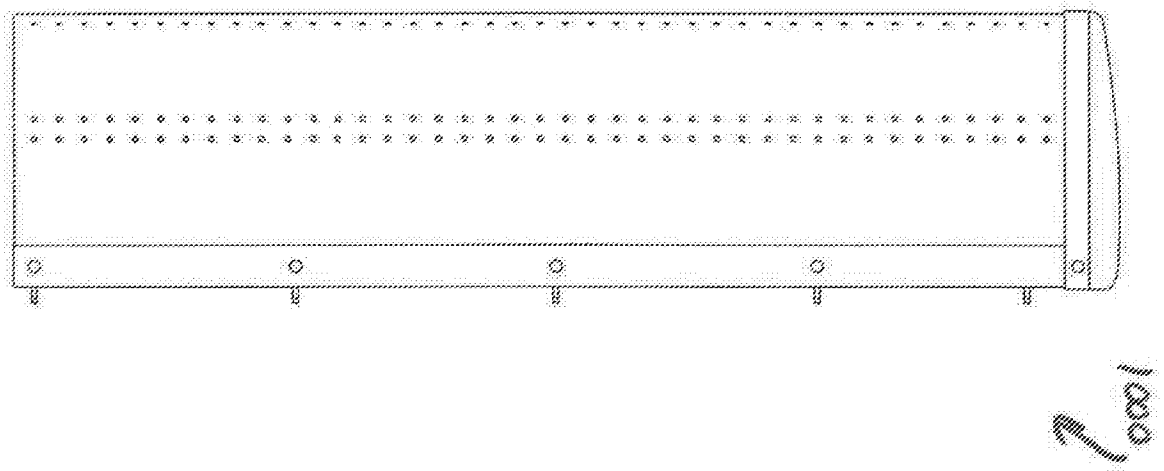
FIG. 10D is a right side view of the merchandising display of FIG. 10A.
Figure 10E:
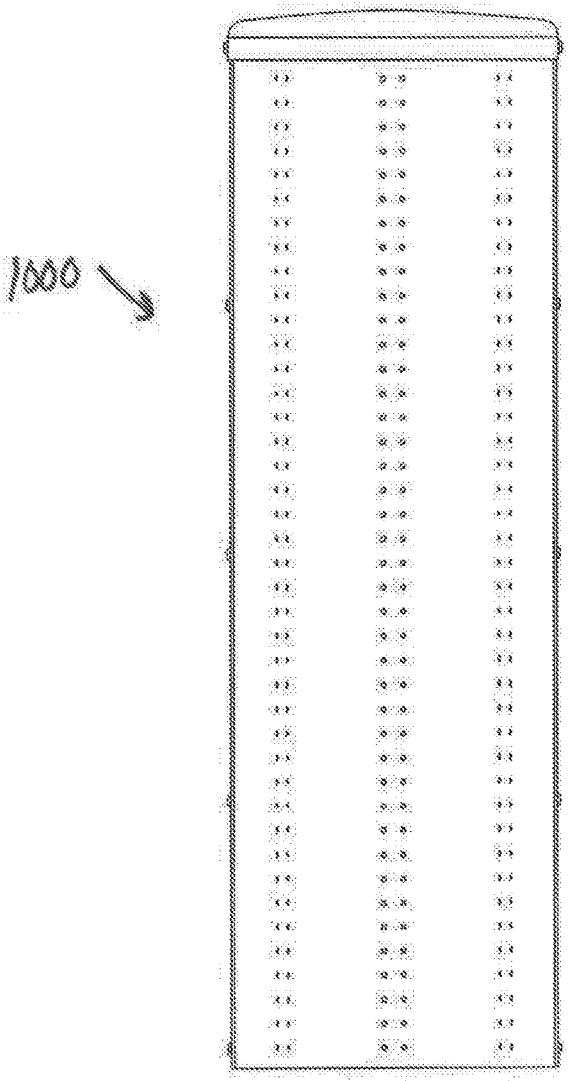
FIG. 10E is a front view of the merchandising display of FIG. 10A.
Figure 10F:
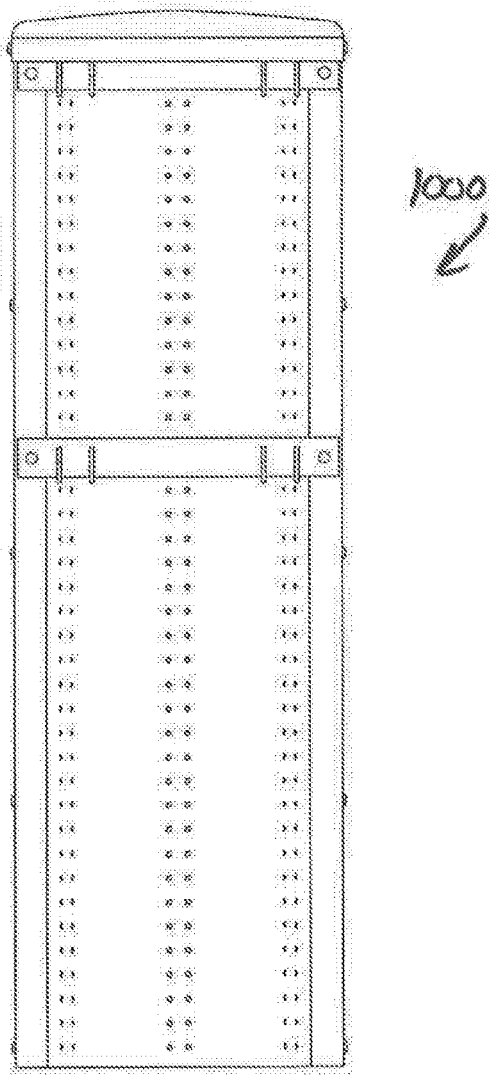
FIG. 10F is a rear view of the merchandising display of FIG. 10A.

Turning to FIGS. 10A through 10I, another merchandising display in accordance with the present teachings is illustrated and generally identified at reference character 1000. In FIG. 10A, the merchandising display 1000 is shown coupled to a conventional gondola 10. The merchandising display 1000 is shown to generally include a display panel 1002, a cap 1004 and a frame 1006. For some applications, it may be desirable to print the display panel 1002 with graphics.

The display panel 1002 may be constructed of a flexible plastic material and may include a plurality of apertures for conventional engagement with a bracket for the display of retail product. The frame 1006 may generally include a pair of vertically extending members 1008 and a pair of horizontally extending members 1010. The pair of vertically extending members 1008 may be L-shaped and may be secured along vertically extending edges of the display panel 1002 with conventional fasteners. The horizontally extending members 1010 may be secured to the vertically extending members 1008 with conventional fasteners.

The merchandising display 1000 may be secured to the gondola 10 with clips 1012. The clips 1012 may be inserted into holes in the gondola 10. In the embodiment illustrated, the merchandising display 1000 may be secured to the gondola 10 with four clips 1012. The horizontally extending members 1010 of the frame 1006 may be placed over the clips 1012. The cap 1004 may be placed over the top of the display panel 1002 and secured thereto with conventional fasteners.

Figure 10G:
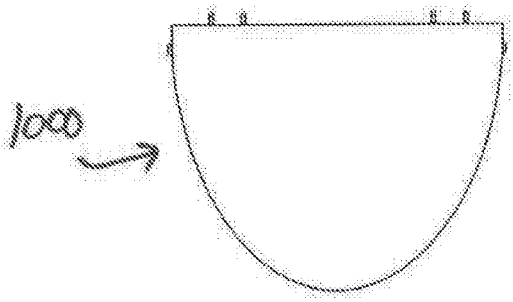
FIG. 10G is a top view of the merchandising display of FIG. 10A.
Figure 10H:
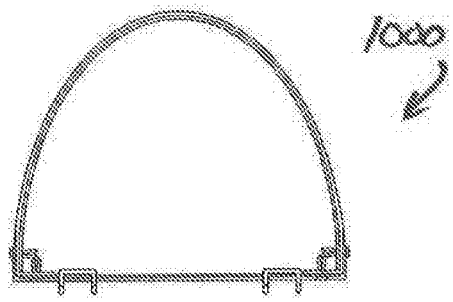
FIG. 10H is a bottom view of the merchandising display of FIG. 10A.
Figure 10I:
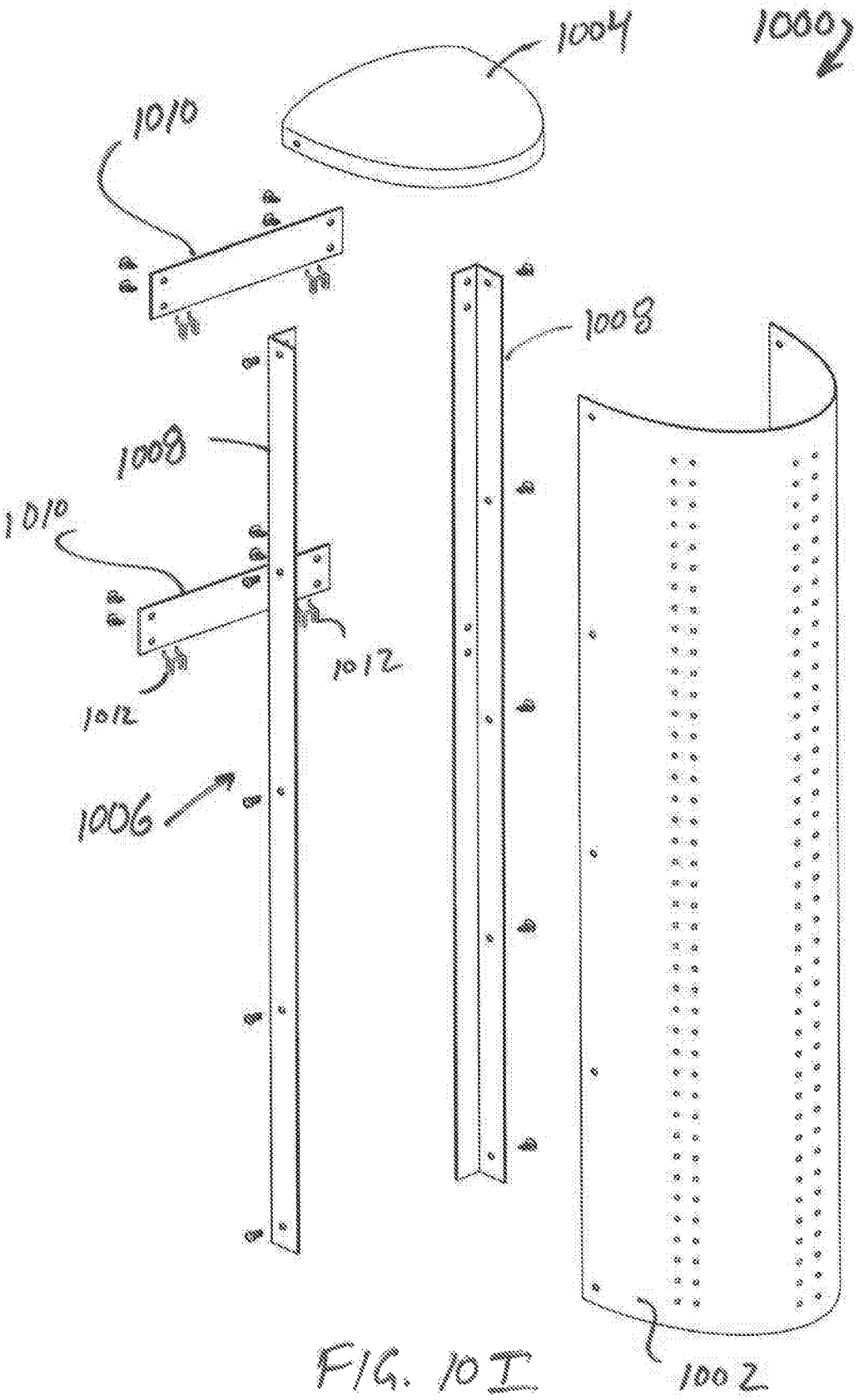
FIG. 10I is a perspective view of the merchandising display of FIG. 10A.
Figure 11A:
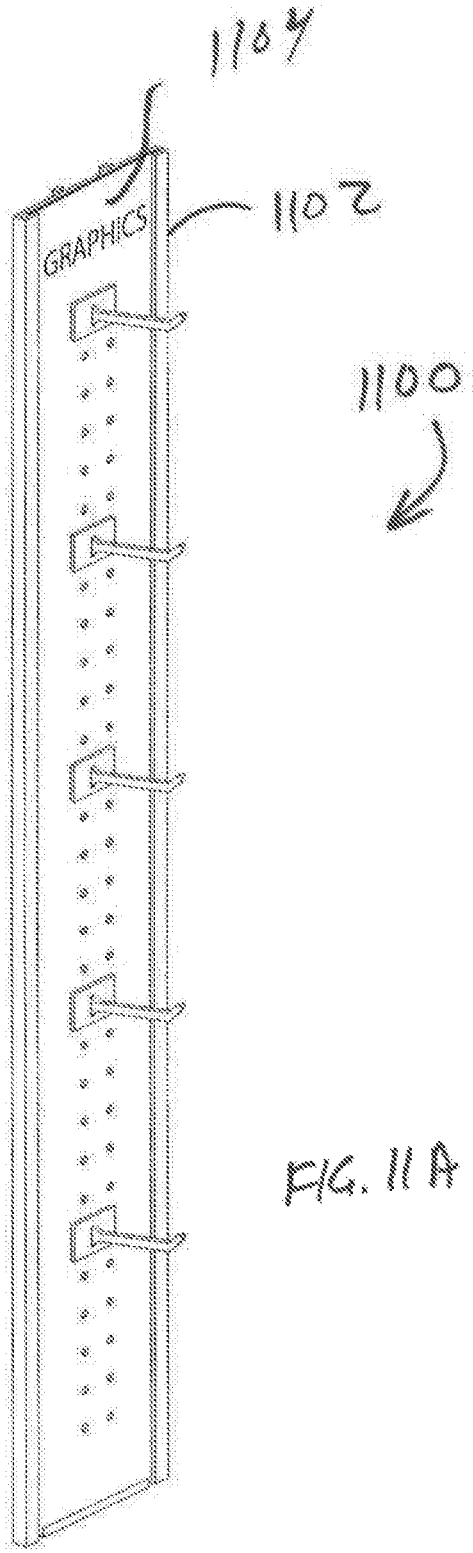
FIG. 11A is a perspective view of another merchandising display in accordance with the present teachings.
Figure 11D:
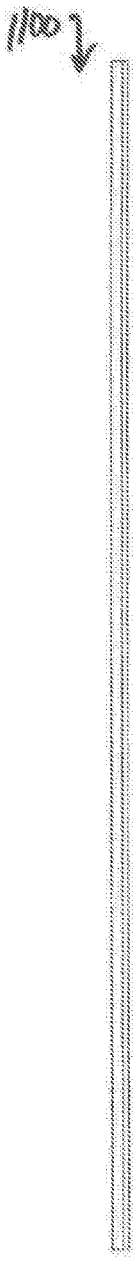
FIG. 11D is a right side view of the merchandising display of FIG. 11A.
Figure 11E:
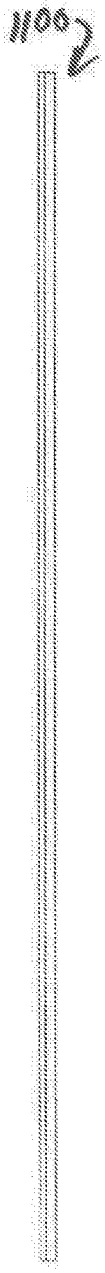
FIG. 11E is a left side view of the merchandising display of FIG. 11A.
Figure 11B:
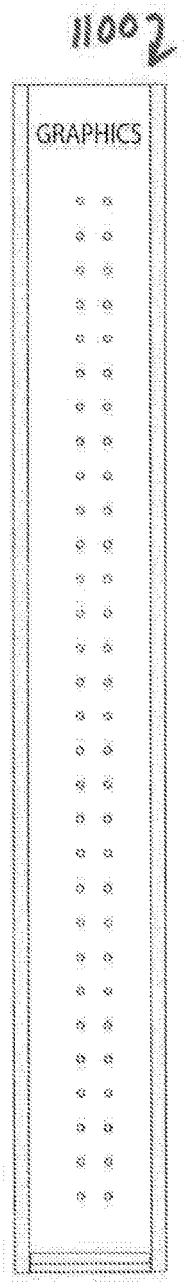
FIG. 11B is a front view of the merchandising display of FIG. 11A.
Figure 11C:
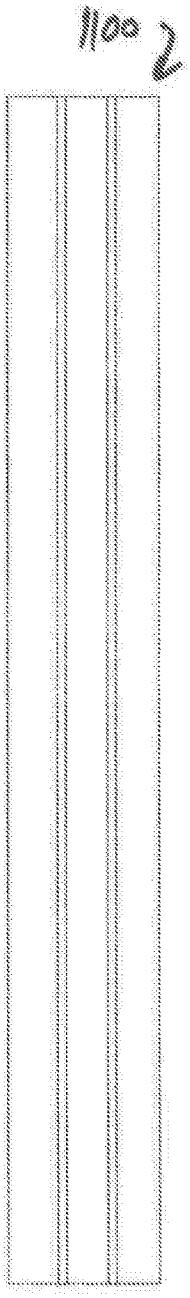
FIG. 11C is a rear side view of the merchandising display of FIG. 11A.
Figure 11F:
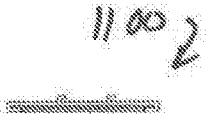
FIG. 11F is a top view of the merchandising display of FIG. 11A.
Figure 11G:
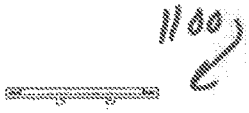
FIG. 11G is a bottom view of the merchandising display of FIG. 11A.
Figure 12A:
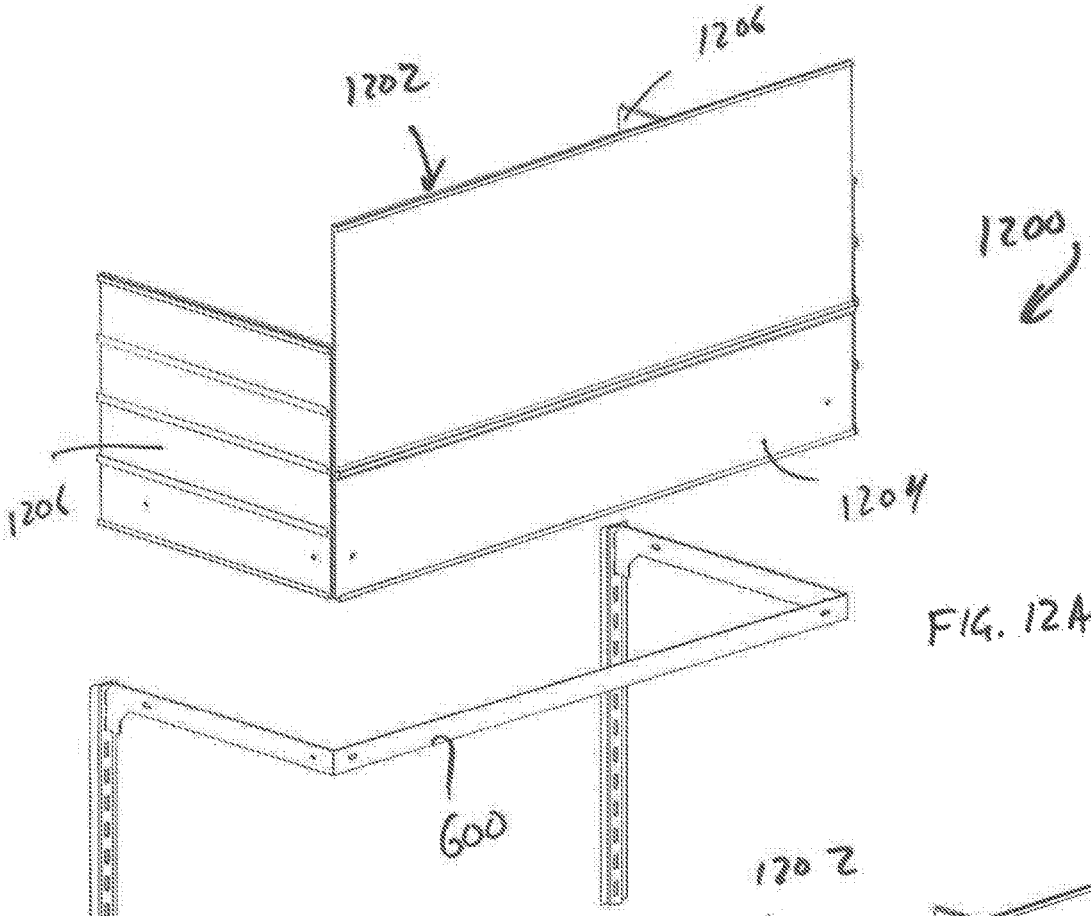
FIG. 12A is an exploded perspective view of another signage system in accordance with the present teachings.
Figure 12B:
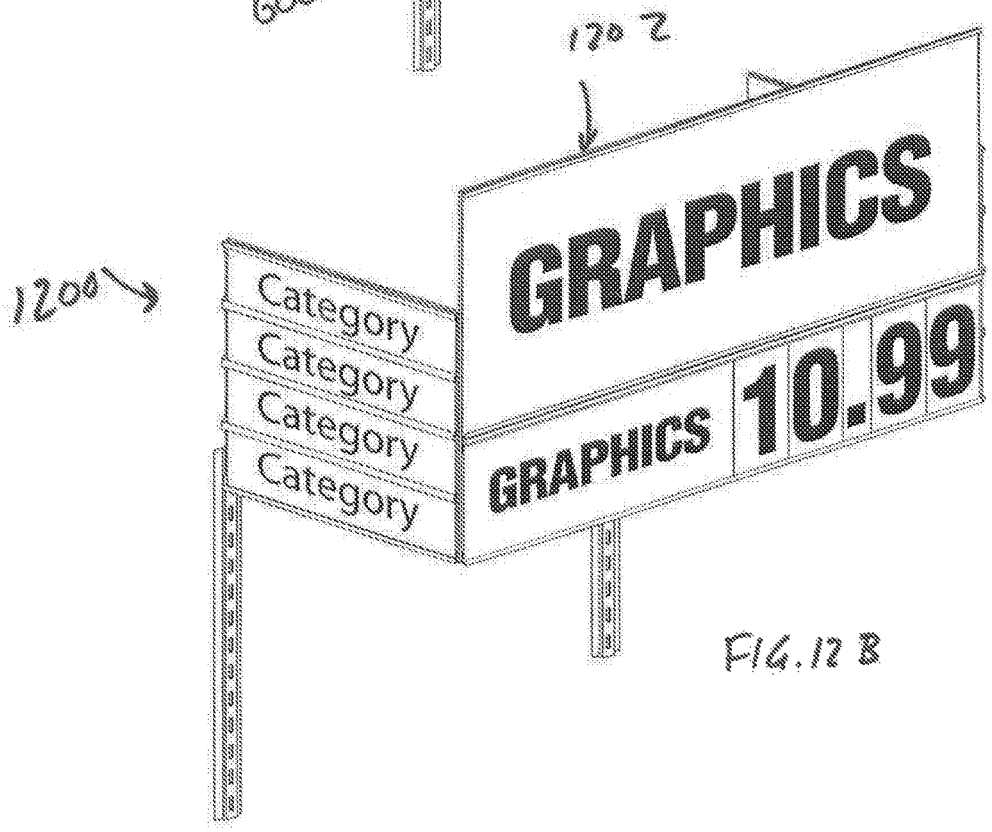
FIG. 12B is a perspective view of the signage system of FIG. 12A.
Figure 12C:
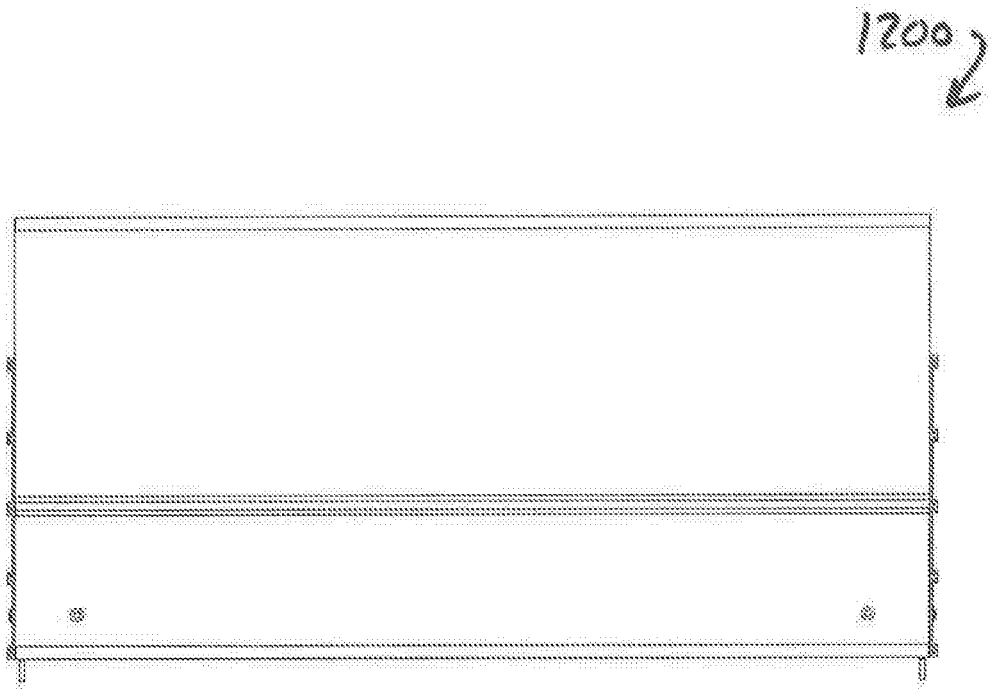
FIG. 12C is a front view of the signage system of FIG. 12A.
Figure 12D:
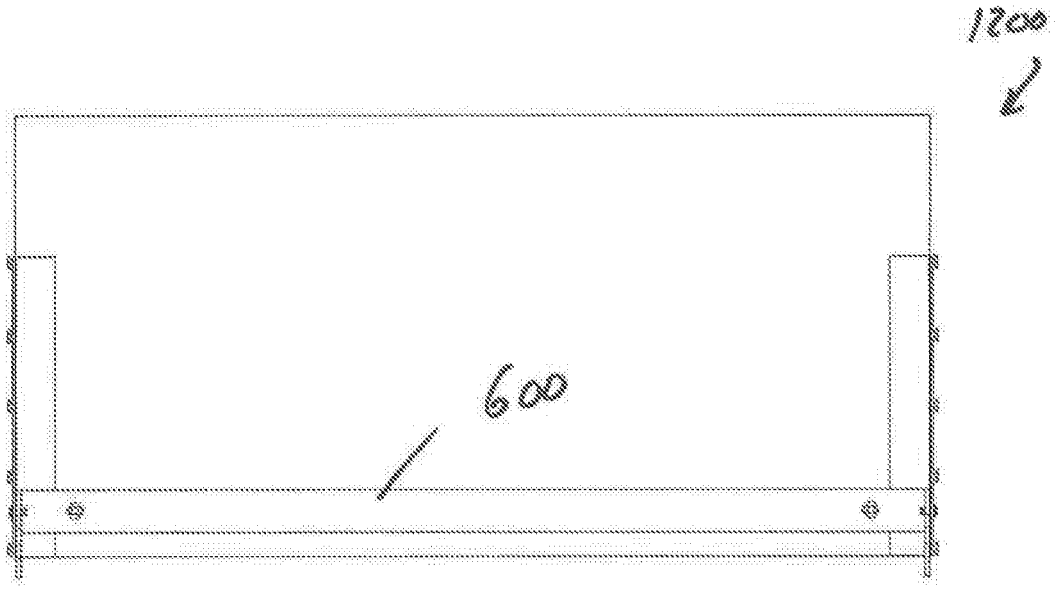
FIG. 12D is a rear view of the signage system of FIG. 12A.
Figure 12E:
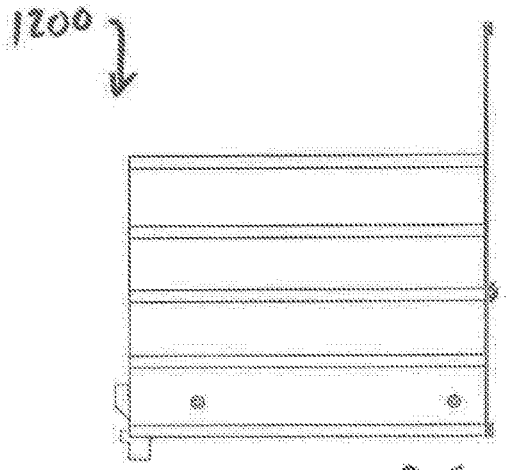
FIG. 12E is a left side view of the signage system of FIG. 12A.
Figure 12F:
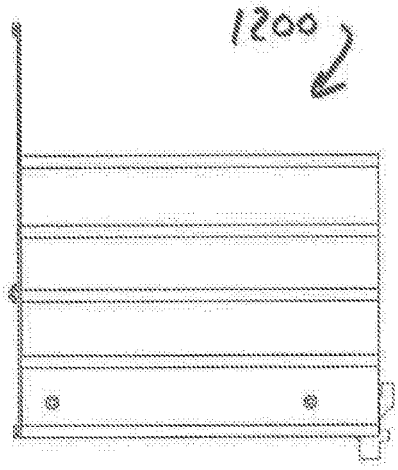
FIG. 12F is a right side view of the signage system of FIG. 12A.
Figure 12G:
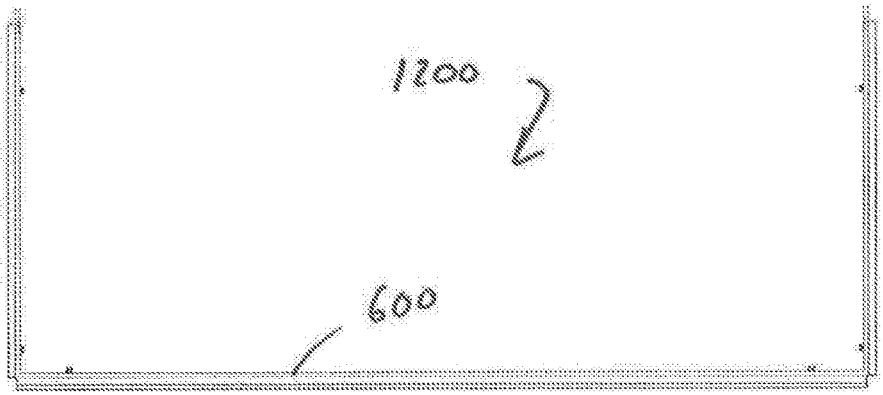
FIG. 12G is a top view of the signage system of FIG. 12A.
Figure 12H:
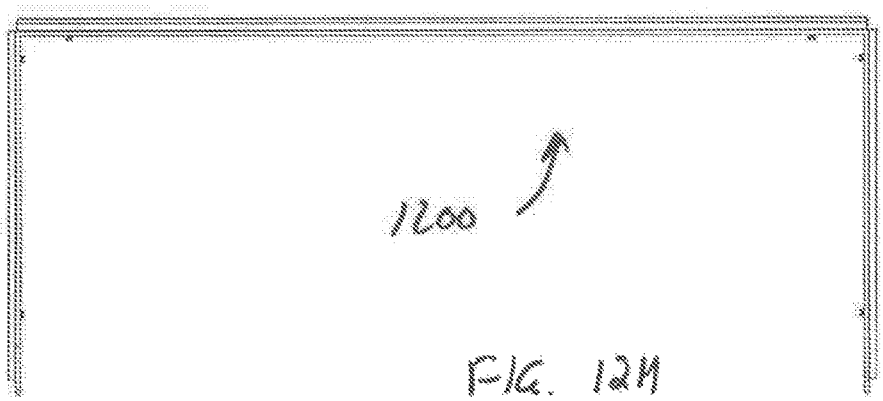
FIG. 12H is a bottom view of the signage system of FIG. 12A.
Figure 12I:
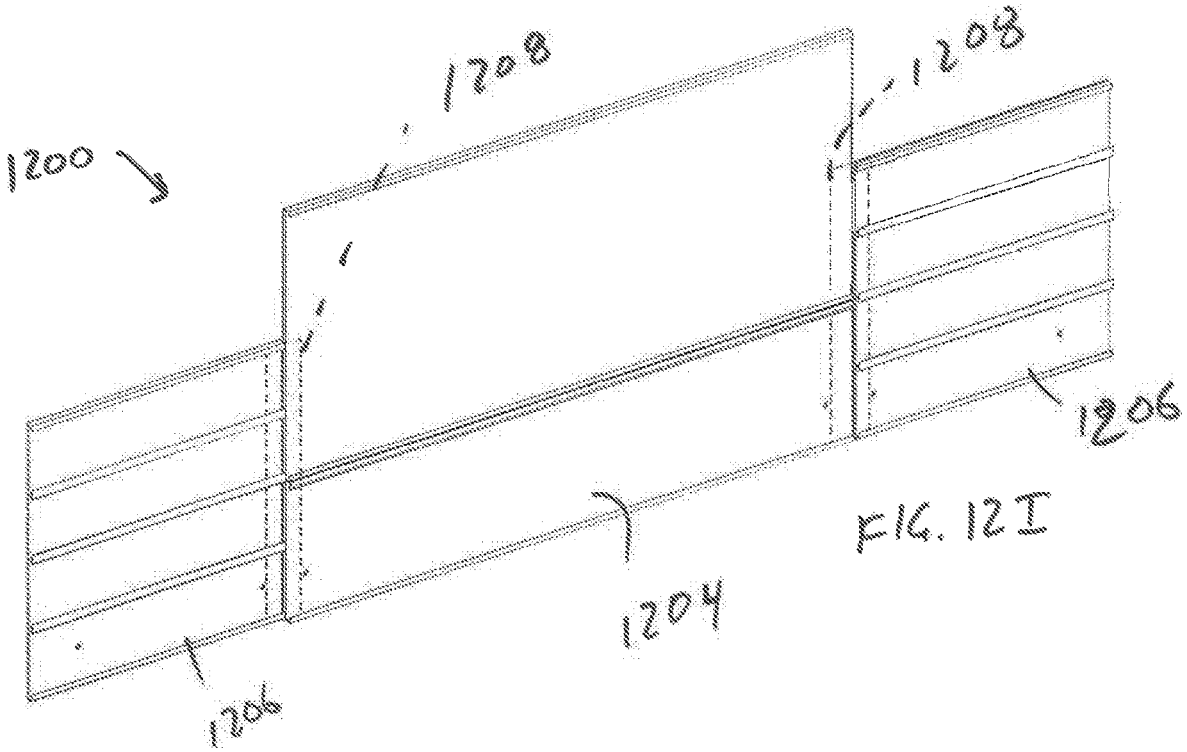
FIG. 12I is a perspective view of the shroud of the signage system of FIG. 12A.
Figure 12J:
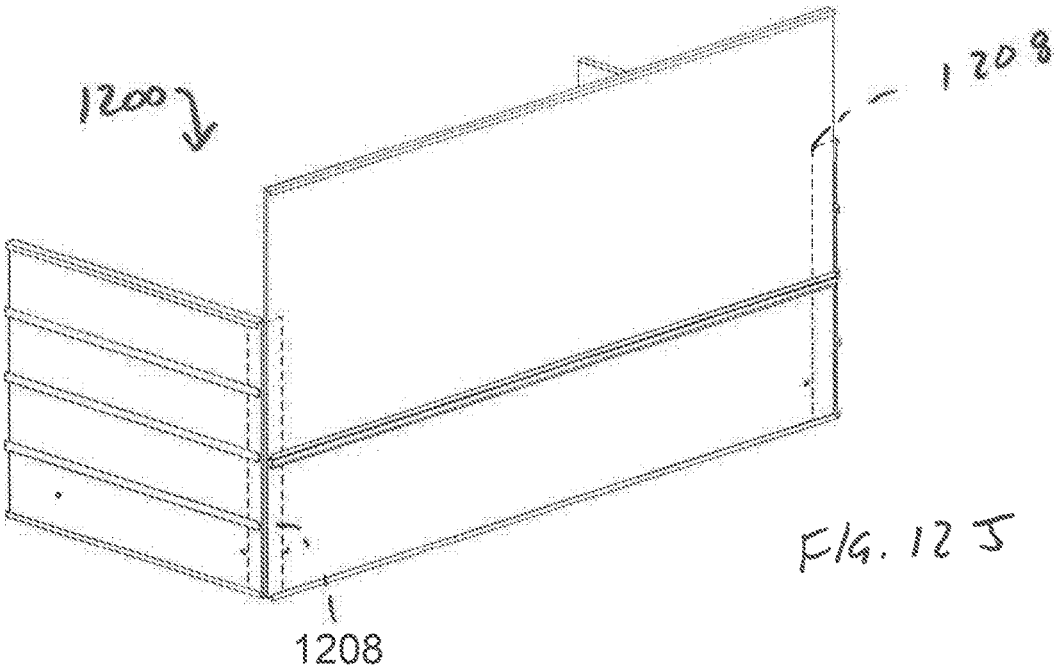
FIG. 12J is another perspective view of the shroud of the signage system of FIG. 12A.

Turning to FIGS. 11A through 10G, another merchandising display in accordance with the present teachings is illustrated and generally identified at reference character 1100. The merchandising display 1100 may include a holder portion 1102 and a panel 1104. The holder portion 1102 may be constructed of plastic. The panel 1104 may be constructed of cardstock, for example. The panel 1104 may be provided with a plurality of apertures for receiving a peg for the suspension of retail product.

Turning to FIGS. 12A through 12J, another merchandising display in accordance with the present teachings is illustrated and generally identified at reference character 1200. The signage system may be an overhead signage system 1200. As with the system 100, the system 1200 may include a sign holding member 1202 having a front panel 1204 and a pair of side panels 1206. The side panels 1206 may be substantially identical. In the embodiment illustrated, the front panel 1204 and the side panels 1206 may be individually extruded and secured to one another with tape 1208. The signage system 1200 may be used with the frame 600 for mounting the sign holding member 1202 to uprights of a conventional gondola 10. As above, the sign holding member 1202 may be secured to the frame 600 with conventional fasteners.

Figure 13:
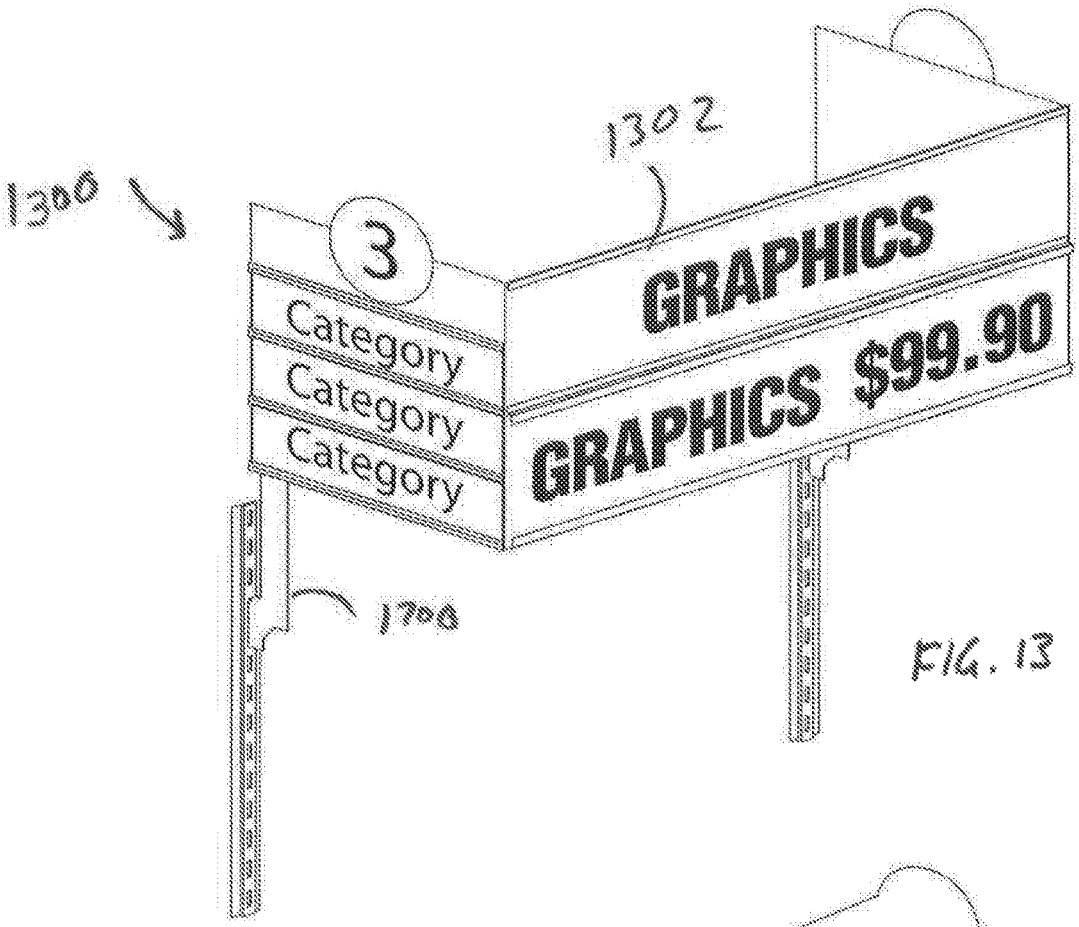
FIG. 13 is a perspective view of another signage system in accordance with the present teachings.

Turning to FIG. 13 another merchandising display in accordance with the present teachings is illustrated and generally identified at reference character 1300. The merchandising display 1300 generally includes a sign holding member 1302 similar to the sign holding members described above and an alternate frame 1700 for mounting the sign holding member 1302 to uprights of a gondola 10.

Figure 14:
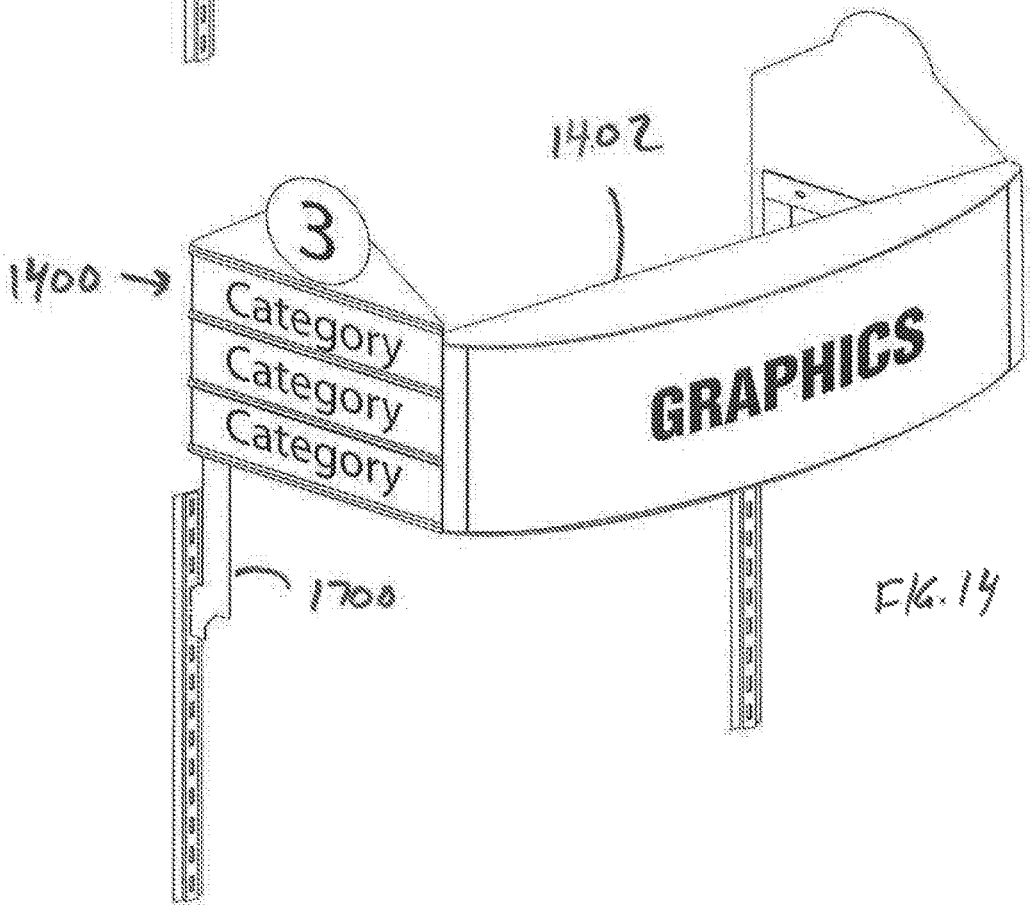
FIG. 14 is a perspective view of another signage system in accordance with the present teachings.

Turning to FIG. 14 another merchandising display in accordance with the present teachings is illustrated and generally identified at reference character 1400. Again, the merchandising display 1300 generally includes a sign holding member 1402 similar to the sign holding members described above but incorporates an alternate frame 1700 for mounting the sign holding member 1402 to uprights of a gondola 10.

Figure 15:
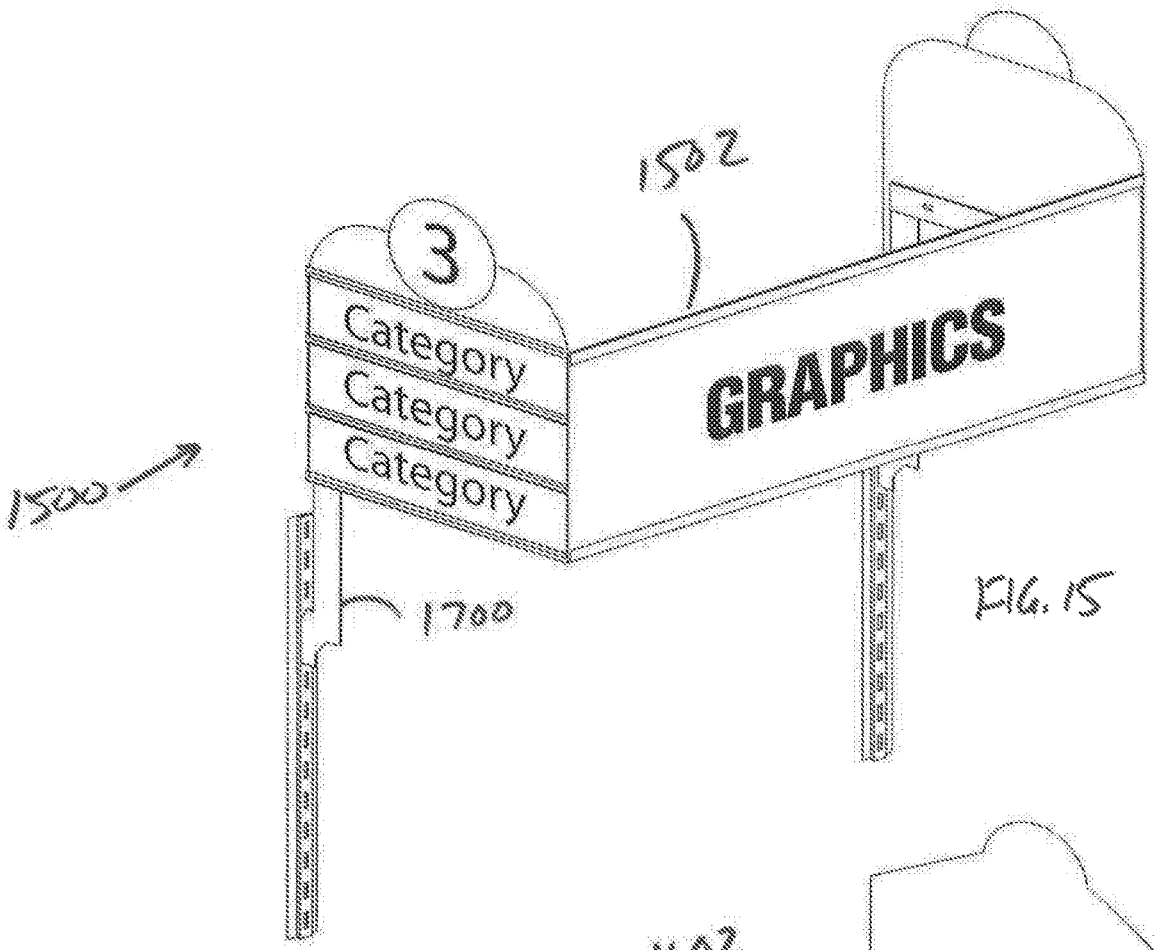
FIG. 15 is a perspective view of another signage system in accordance with the present teachings.

Turning to FIG. 15 another merchandising display in accordance with the present teachings is illustrated and generally identified at reference character 1500. Again, the merchandising display 1500 generally includes a sign holding member 1502 similar to the sign holding members described above but incorporates an alternate frame 1700 for mounting the sign holding member 1502 to uprights of a gondola 10.

Again, the merchandising display 1500 generally includes a sign holding member 1502 similar to the sign holding members described above but incorporates an alternate frame 1700 for mounting the sign holding member 1502 to uprights of a gondola 10.

Figure 16:
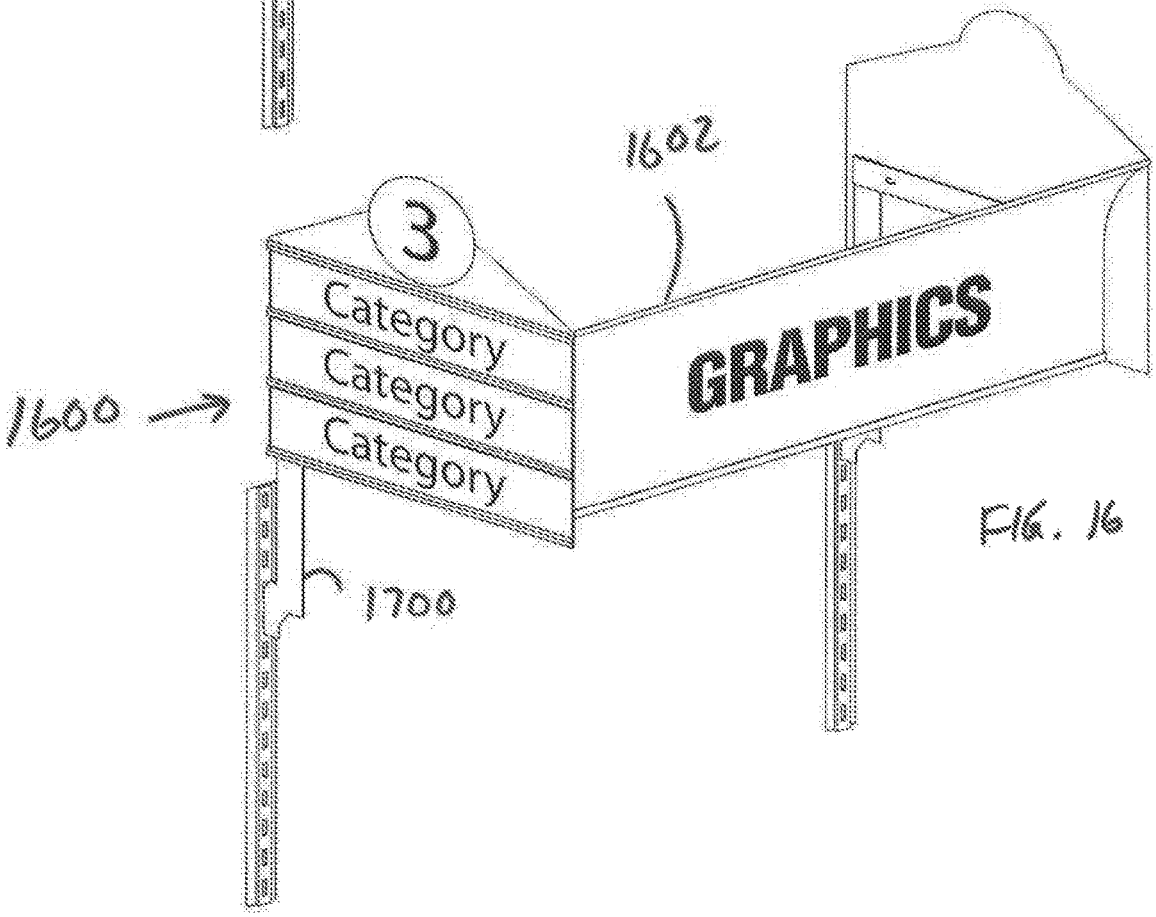
FIG. 16 is a perspective view of another signage system in accordance with the present teachings.
Figure 17A:
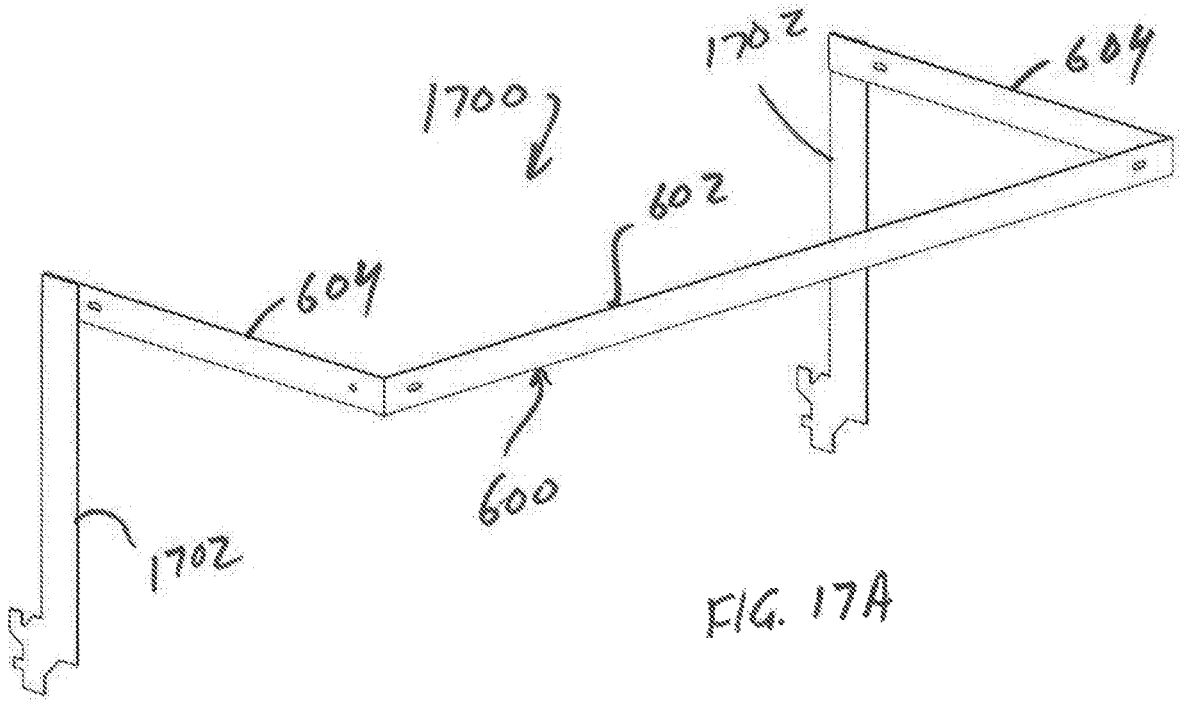
FIG. 17A is a perspective view of bracket for use with the signage systems of FIGS. 13 through 16.
Figure 17B:
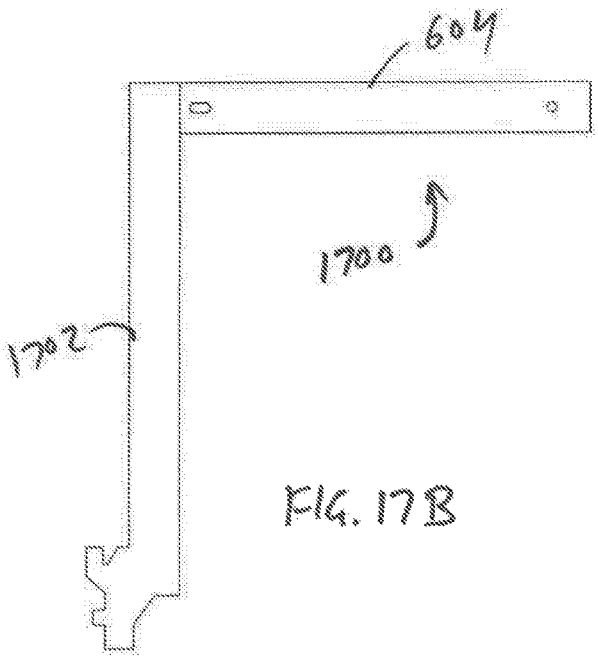
FIG. 17B is a left side view of the bracket of FIG. 17A.
Figure 17C:
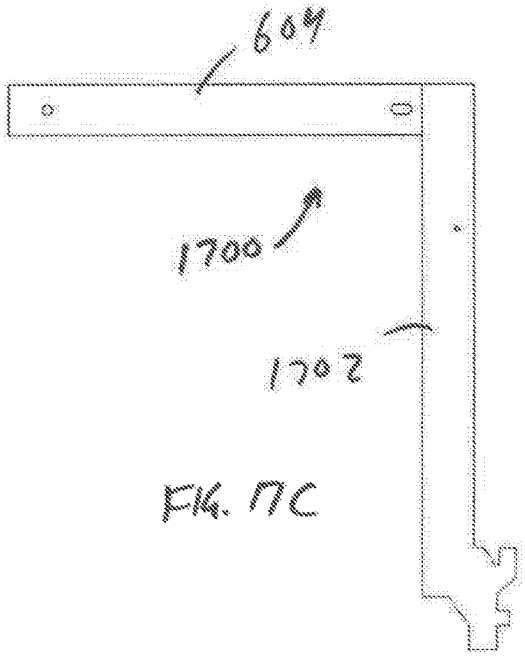
FIG. 17C is a right side view of the bracket of FIG. 17A.
Figure 17D:
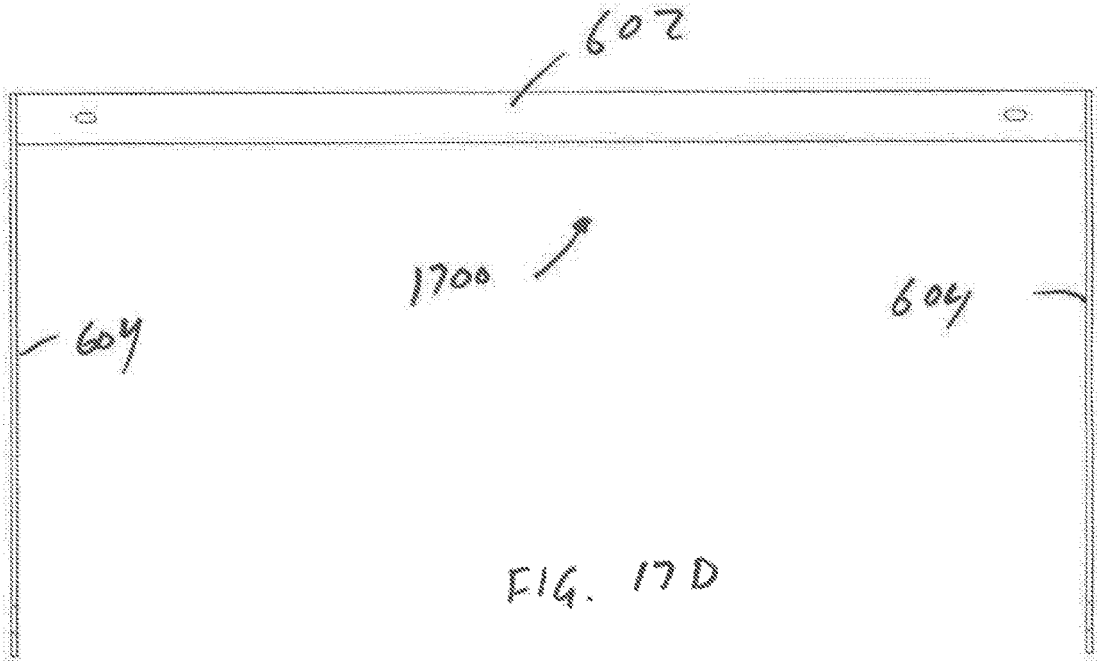
FIG. 17D is front view of the bracket of FIG. 17A.
Figure 17E:
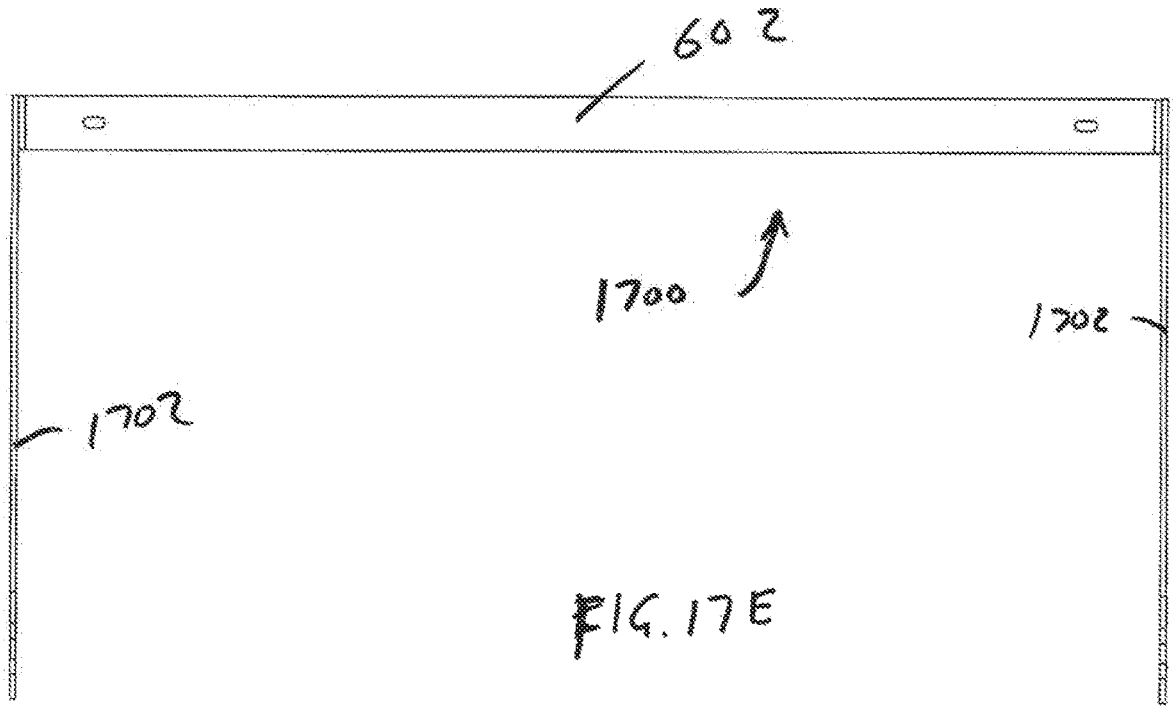
FIG. 17E is rear view of the bracket of FIG. 17A.
Figure 17F:
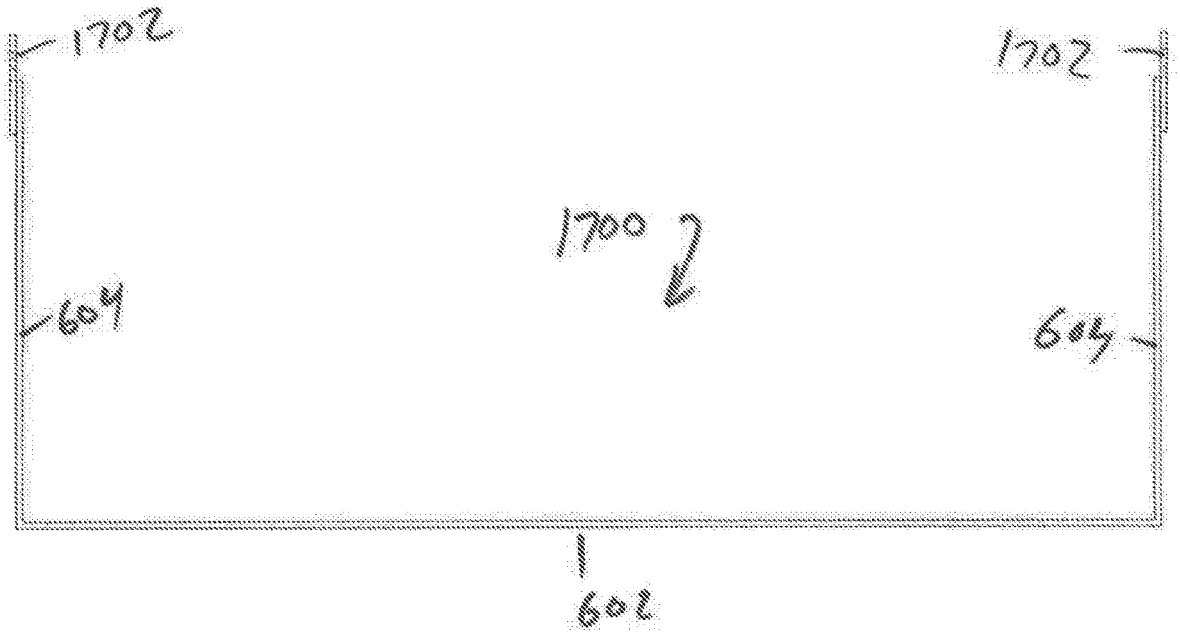
FIG. 17F is a top view of the bracket of FIG. 17A.
Figure 17G:
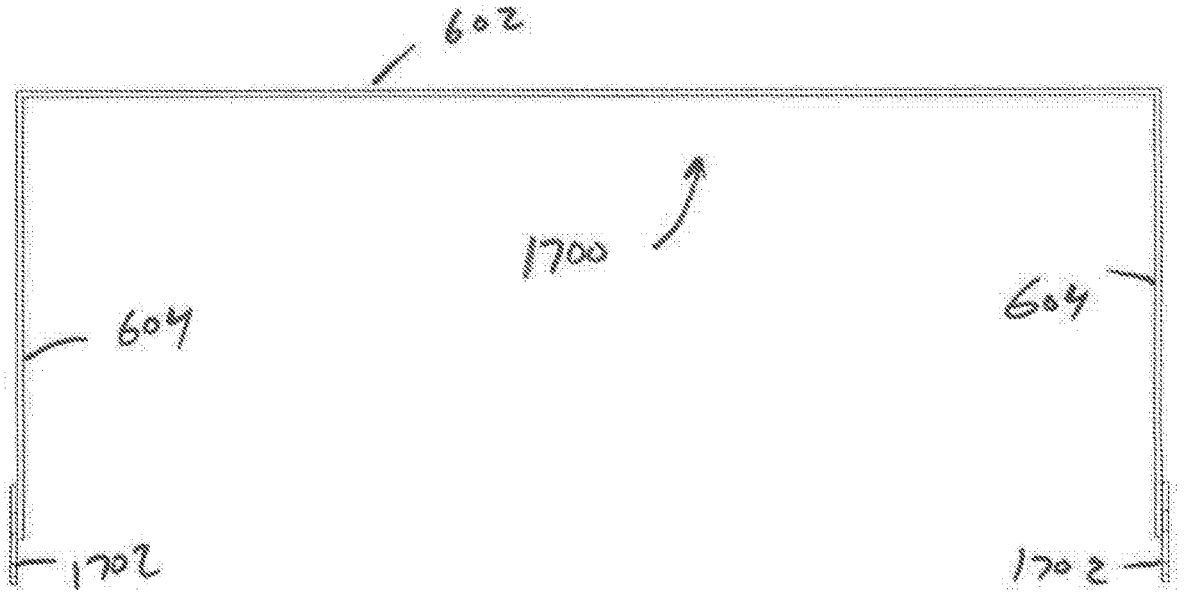
FIG. 17G is a bottom view of the bracket of FIG. 17A.
Figure 18A:
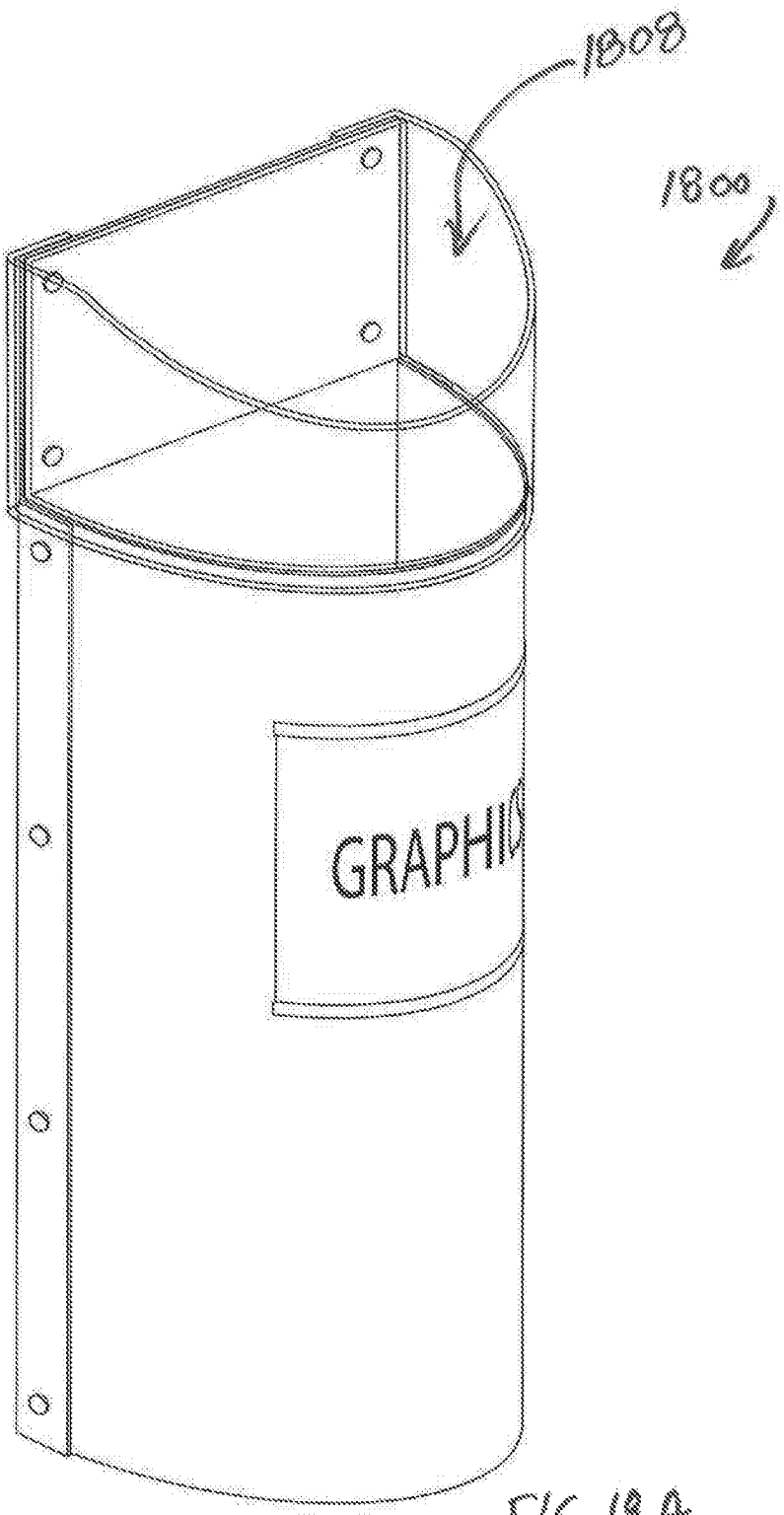
FIG. 18A is a perspective view of another merchandising display in accordance with the present teachings.
Figure 18B:
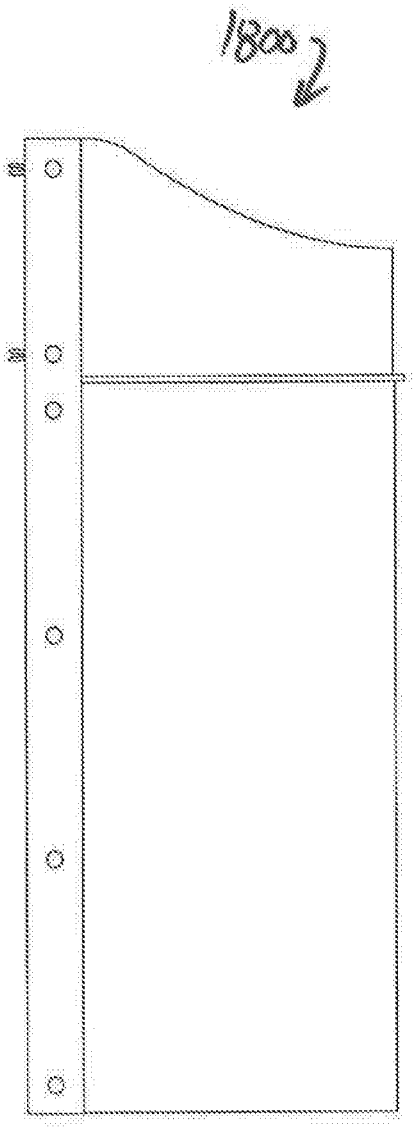
FIG. 18B is a left side view of the merchandising display of FIG. 18A.
Figure 18C:
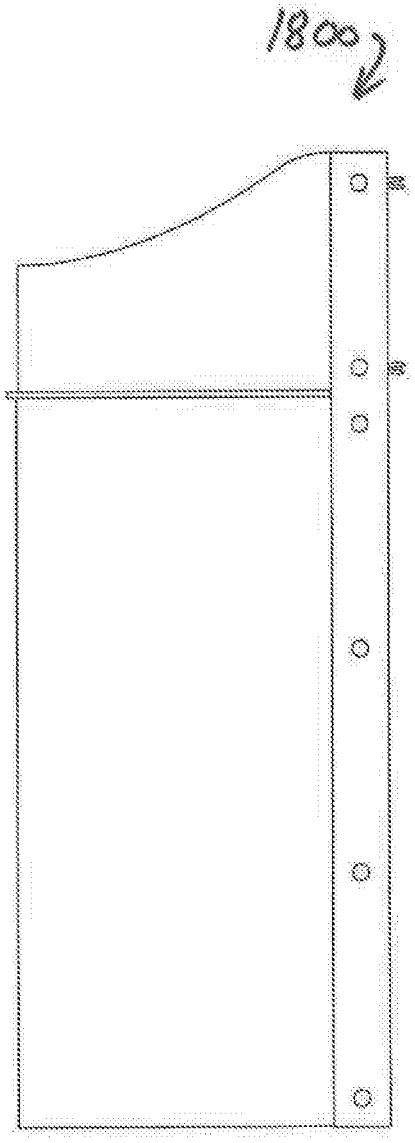
FIG. 18C is a right side view of the merchandising display of FIG. 18A.
Figure 18D:
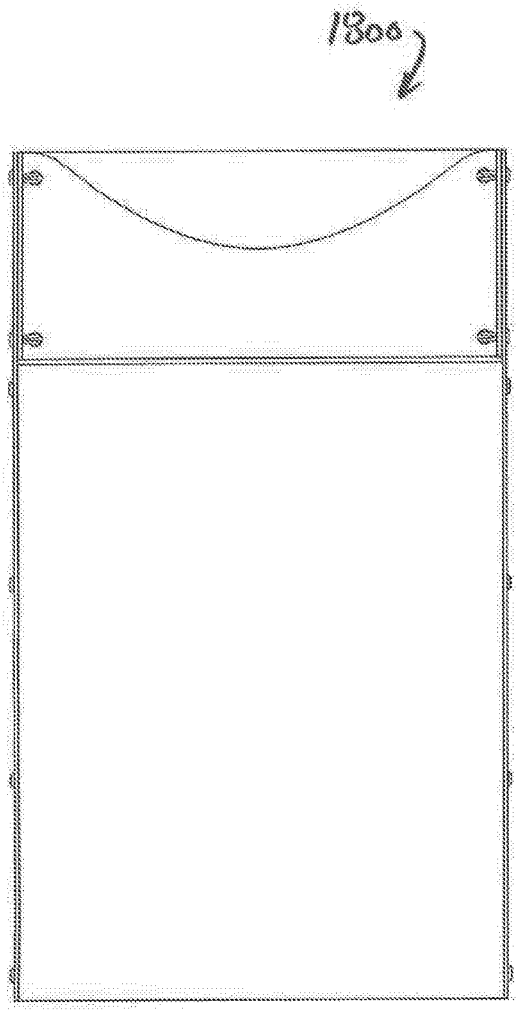
FIG. 18D is a front view of the merchandising display of FIG. 18A.
Figure 18E:
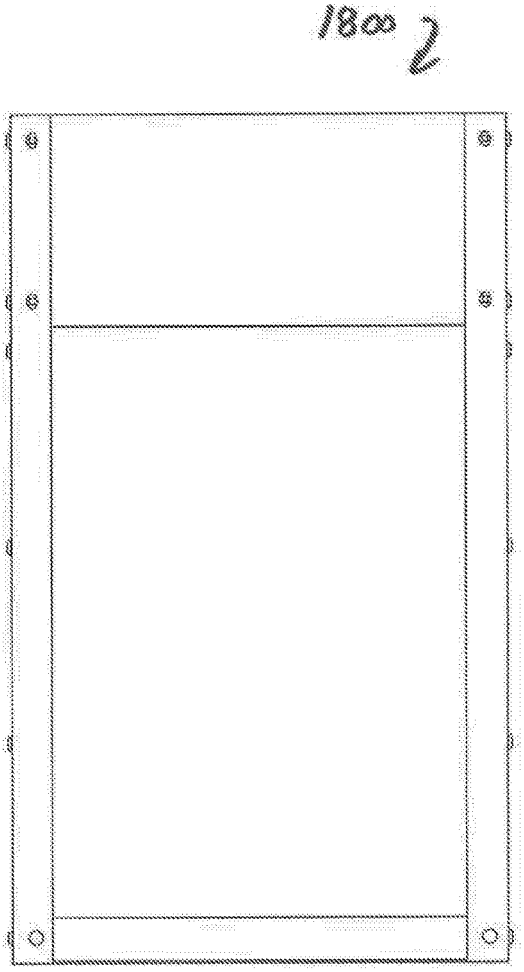
FIG. 18E is a rear view of the merchandising display of FIG. 18A.
Figure 18F:
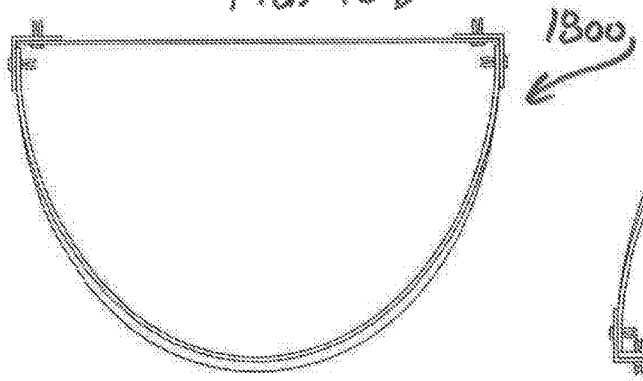
FIG. 18F is a top view of the merchandising display of FIG. 18A.
Figure 18G:
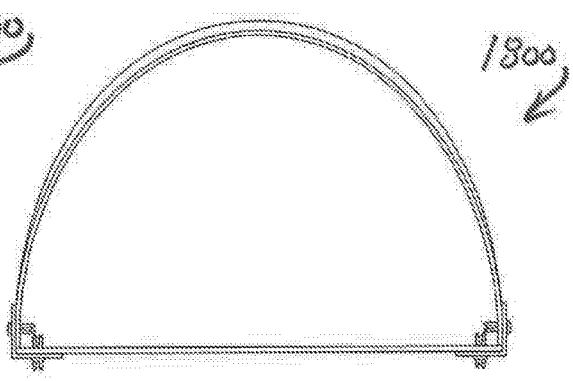
FIG. 18G is a bottom view of the merchandising display of FIG. 18A.
Figure 18H:
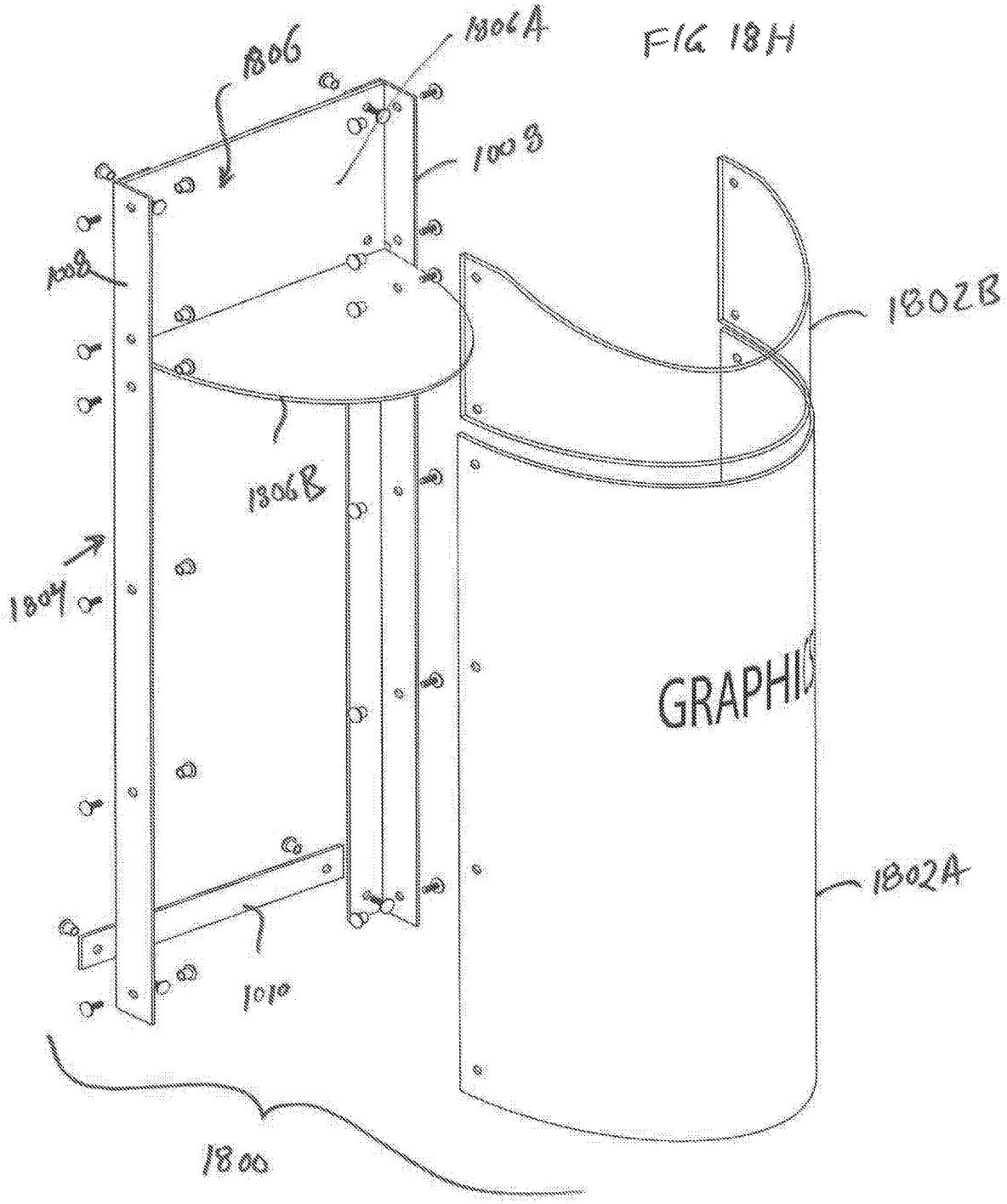
FIG. 18H is a perspective view of the merchandising display of FIG. 18A.

Turning to FIG. 16 another merchandising display in accordance with the present teachings is illustrated and generally identified at reference character 1600. Again, the merchandising display 1600 generally includes a sign holding member 1602 similar to the sign holding members described above but incorporates an alternate frame 1700 for mounting the sign holding member 1602 to uprights of a gondola 10.

Turning to FIGS. 17A through 17G, frame or bracket for use with the signage systems of FIGS. 13 through 16 is illustrated and generally identified at reference character 1700. The frame 1700 of metal or other suitable material. The frame may include a first piece similar to the frame 600. The first piece 600 may be formed of a single piece of metal or other suitable material and may be bent to include a front portion 602 and a pair of side portions 604. The front and side portions 602 and 604 may be formed with holes to receive the conventional fasteners for attachment of the sign holding members. The frame 1700 may additionally include a pair of uprights 1702 formed of metal or other suitable material. The free ends of both side portions 604 may be configured to conventionally engage uprights of a gondola 10. The opposite ends of the uprights 1702 may be welded or otherwise securely fastened to the frame 1700.

Turning to FIGS. 18A through 18H, another merchandising display in accordance with the present teachings is illustrated and generally identified at reference character 1800. It will be understood that the merchandising display 1800 may be a freestanding structure or may be secured to a structure such as a conventional gondola 10 (shown in FIG. 10A, for example). The merchandising display 1800 is shown to generally include one or more panels 1802. The one or more panels may include a lower panel 1802A and an upper panel 1802B. The panels 1802A and 1802B may be constructed of a flexible plastic material. In one application, the lower panel 1802A may be printed with graphics or may carry graphics or product information. The upper panel 1802B may be clear. Upon assembly, the upper and lower panels 1802B and 1802A may be curved in a horizontal direction.

The merchandising display 1800 may additionally include a frame 1804. The frame 1006 may generally include a pair of vertically extending members 1008 and one or more horizontally extending members 1010. The pair of vertically extending members 1008 may be L-shaped and may be secured along vertically extending edges of the display panels 1802A and 1802B with conventional fasteners. The one or more horizontally extending members 1010 may be secured to the vertically extending members 1008 with conventional fasteners.

At an upper end of the frame 1804, the merchandising display 1800 may include a panel 1806 coupled to both of the vertically extending members 1008 of the frame 1804 with conventional fasteners. The panel 1806 may include an upper portion 1806A and a lower portion 1806B parallel thereto. The lower portion 1806B of the panel 1806 may be horizontally oriented and positioned between the display panels 1802A and 1802B so as to partially define an upper bin 1808. Explaining further, the upper bin 1808 may be defined by the lower portion 1806B of the panel 1806, the upper portion 1806A and the upper panel 1802B.

In use, the merchandising display 1800 may be secured back-to-back with a substantially identical display. Alternatively, the merchandising display 1800 may be secured to a gondola 10 in a manner similar to the mounting discussed about with respect to the merchandising display 1000.

The merchandising display 1000 may be secured to the gondola 10 with clips 1012. The clips 1012 may be inserted into holes in the gondola 10. In the embodiment illustrated, the merchandising display 1000 may be secured to the gondola 10 with four clips 1012. The horizontally extending members 1010 of the frame 1006 may be placed over the clips 1012. The cap 1004 may be placed over the top of the display panel 1002 and secured thereto with conventional fasteners.

Figure 19A:
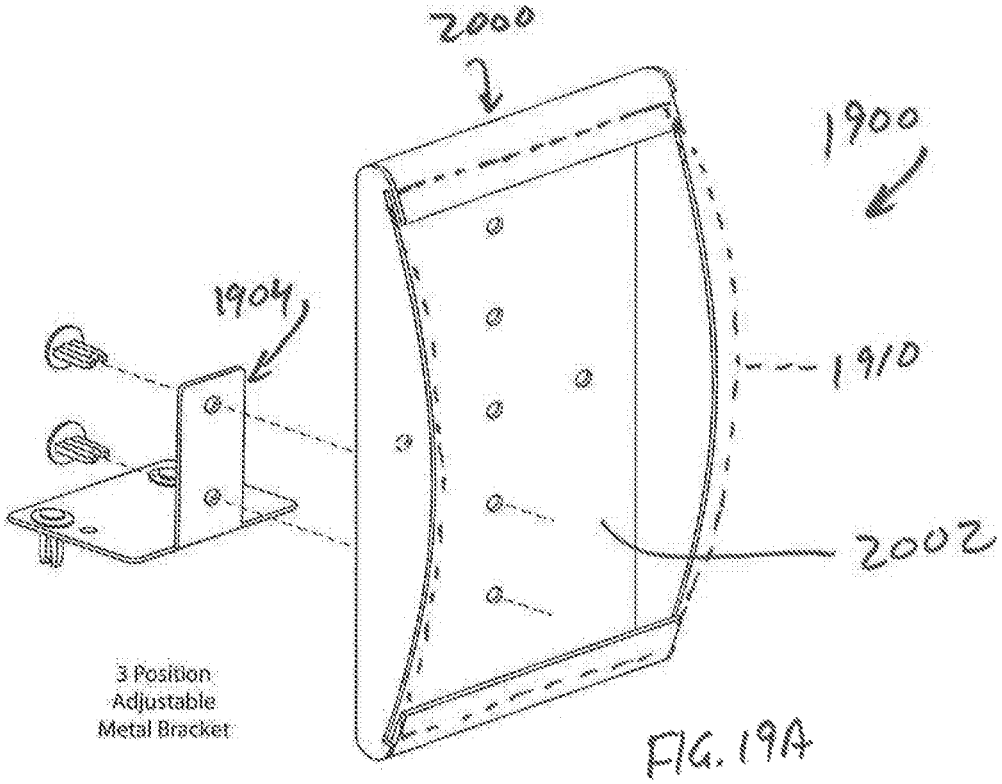
FIG. 19A is an exploded perspective view of a signage assembly in accordance with the present teachings.
Figure 19B:
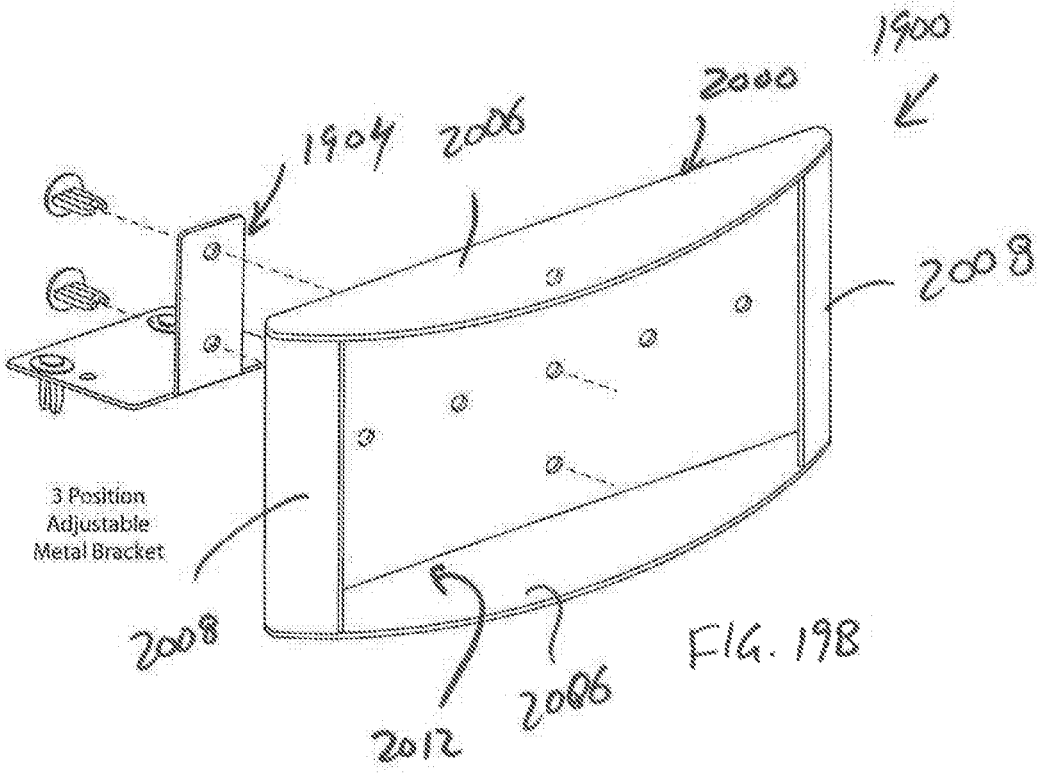
FIG. 19B is another exploded perspective view of the signage assembly of FIG. 19A.
Figure 19C:
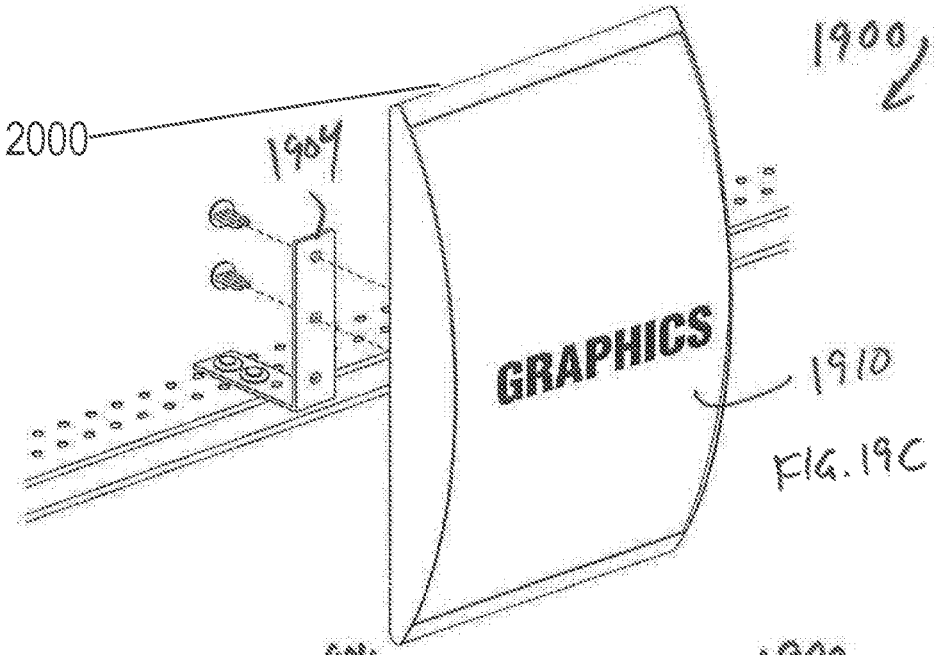
FIG. 19C is another exploded perspective view of the signage assembly of FIG. 19A.
Figure 19D:
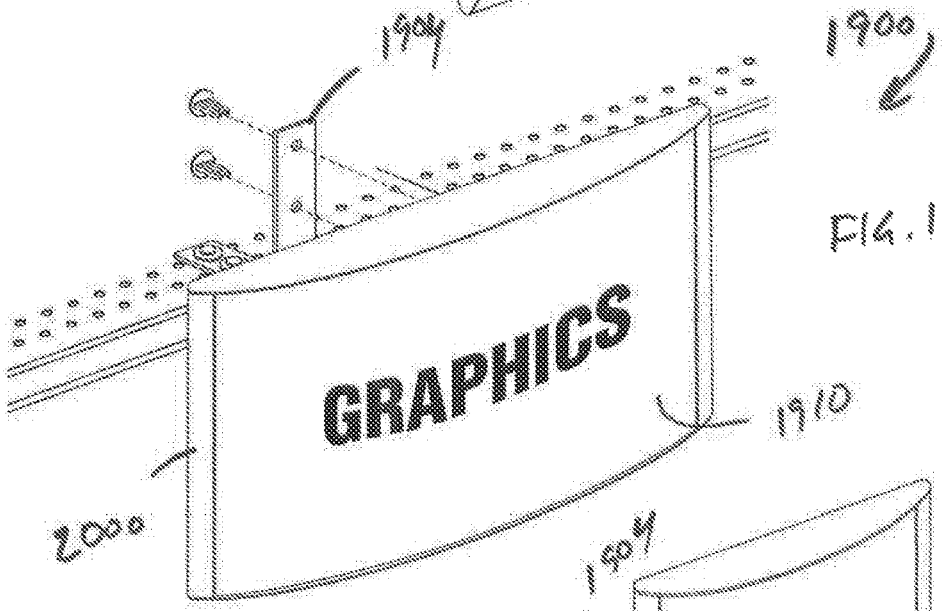
FIG. 19D is another exploded perspective view of the signage assembly of FIG. 19A.
Figure 19E:
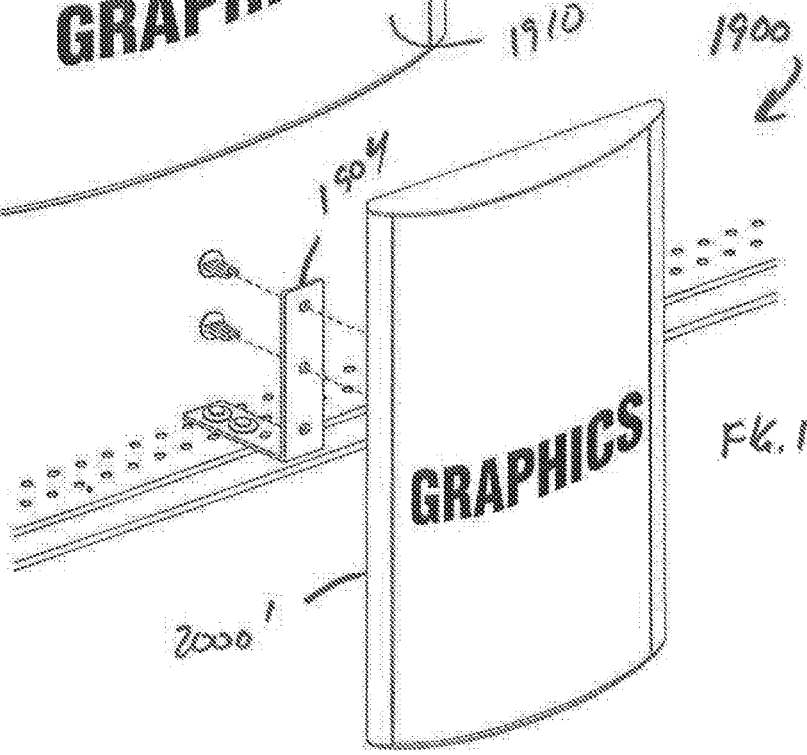
FIG. 19E is another exploded perspective view of the signage assembly of FIG. 19A.

Turning to FIGS. 19E through 19D and 20A through 21G, a sign holder in accordance with the present teachings is illustrated and generally identified at reference character 2000. An alternative sign holder is shown in FIG. 19E and generally identified at reference character 2000'. With particular reference to the exploded view of FIG. 19A, the sign holder 2000 is shown incorporated into a signage assembly 1900 further having a mounting bracket 1904. The sign holder 2000 shown attachable to the mounting bracket 1904 in a first orientation.

Figure 21A:
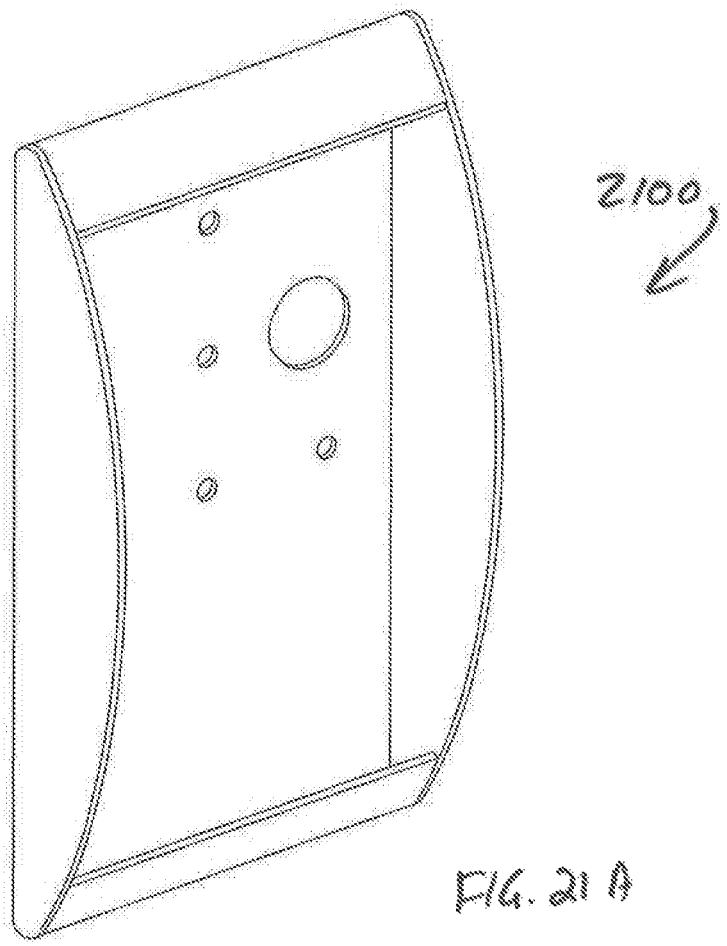
FIG. 21A is a perspective view of another bracket of a signage assembly according to the present teachings.
Figure 21B:
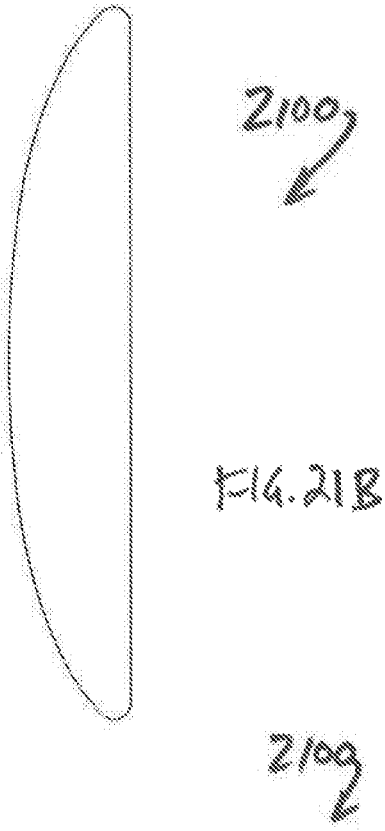
FIG. 21B is a right side view of the bracket of FIG. 21A.
Figure 21C:
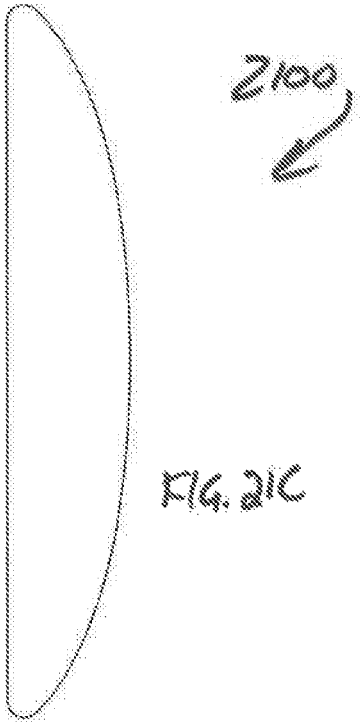
FIG. 21C is a left side view of the bracket of FIG. 21A.
Figure 21D:
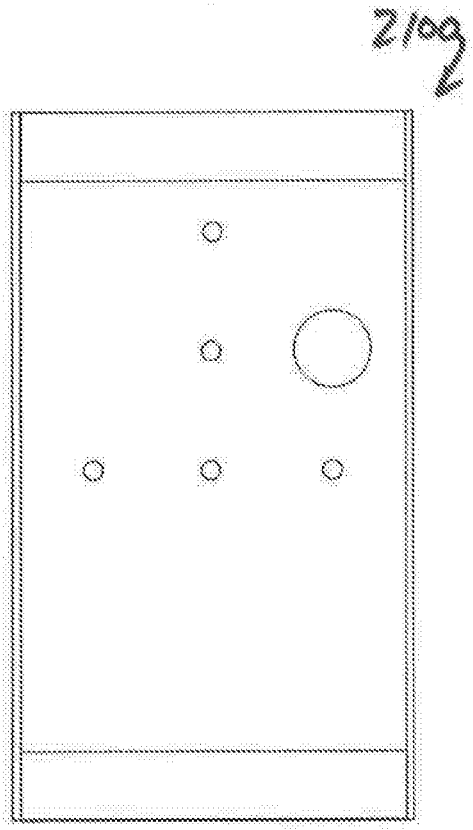
FIG. 21D is a front view of the bracket of FIG. 21A.
Figure 21E:
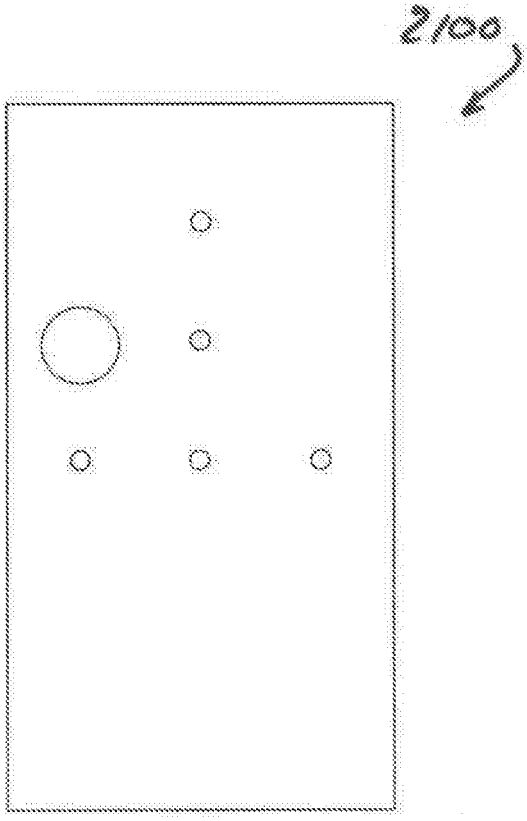
FIG. 21E is a rear view of the bracket of FIG. 21A.
Figure 21F:
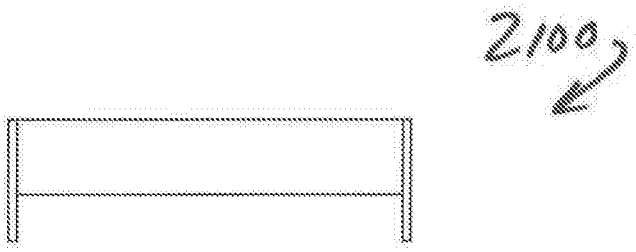
FIG. 21F is a top view of the bracket of FIG. 21A.
Figure 21G:
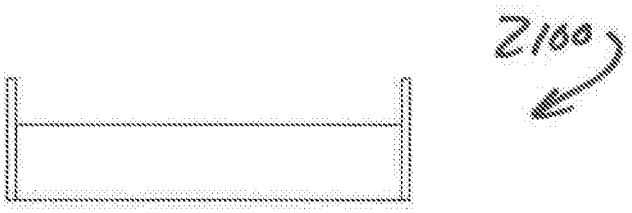
FIG. 21G is a bottom view of the bracket of FIG. 21A.
Figure 22A:
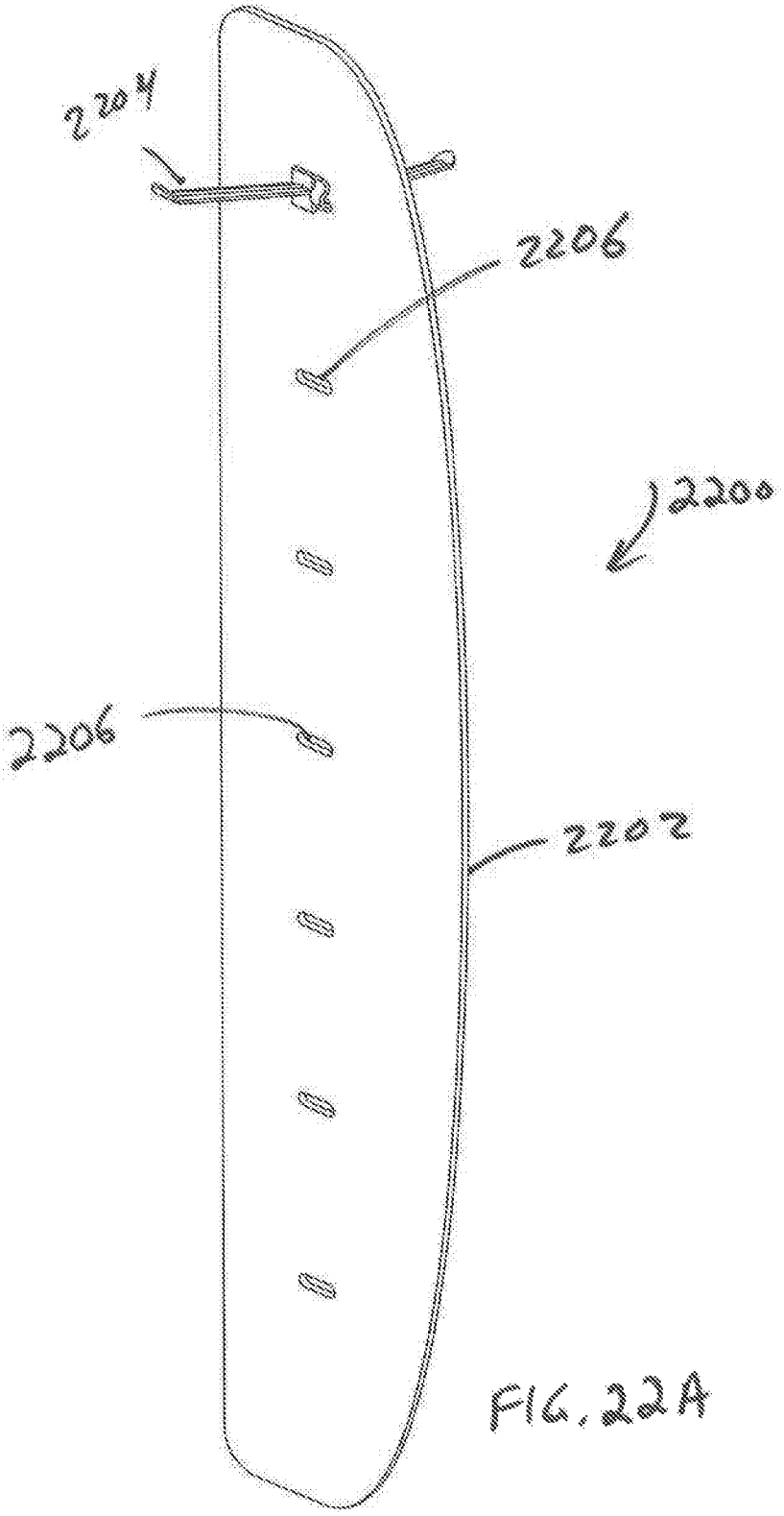
FIG. 22A is a perspective view of another merchandising display in accordance with the present teachings.
Figure 29B:
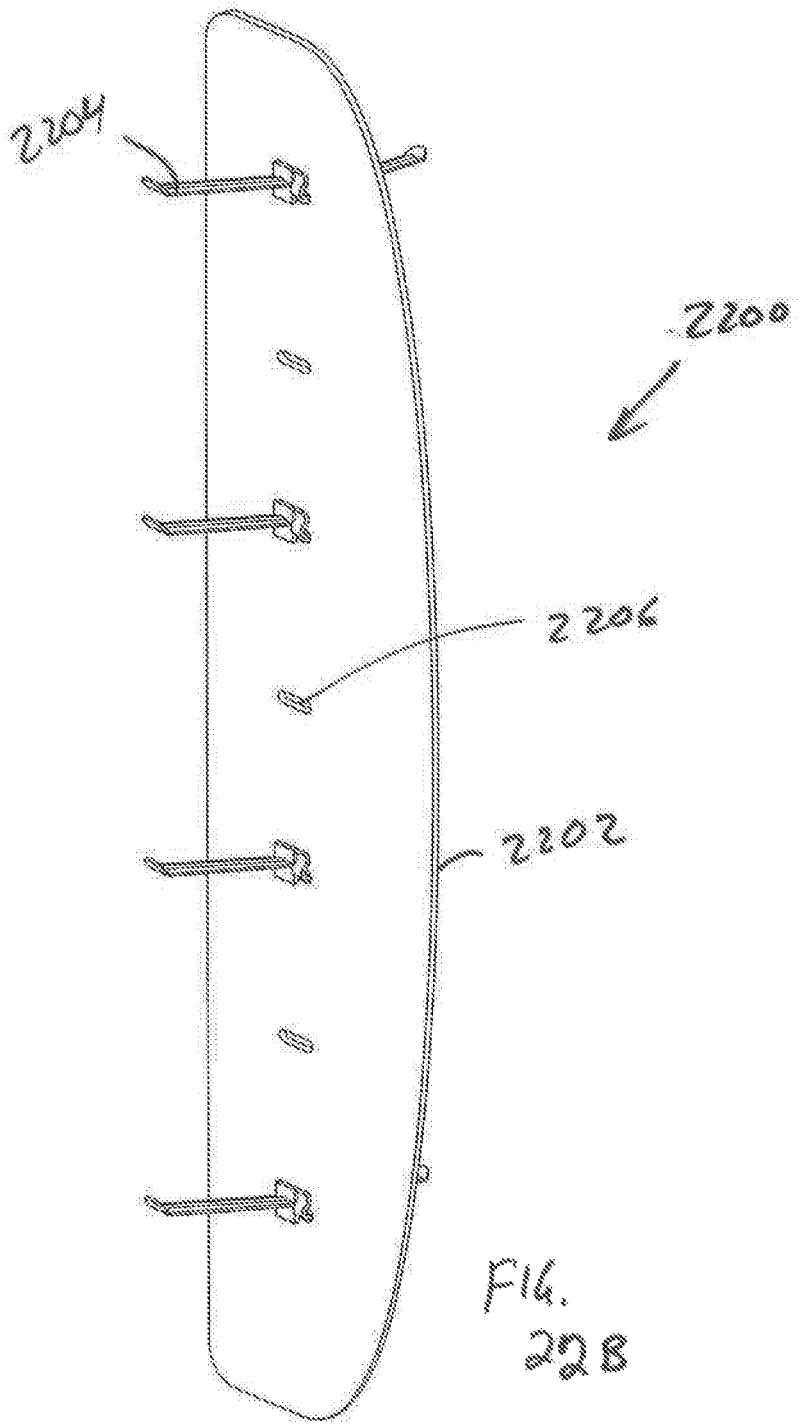
Figures 22C, 22D, 22E, 22F, 22G, 22H:
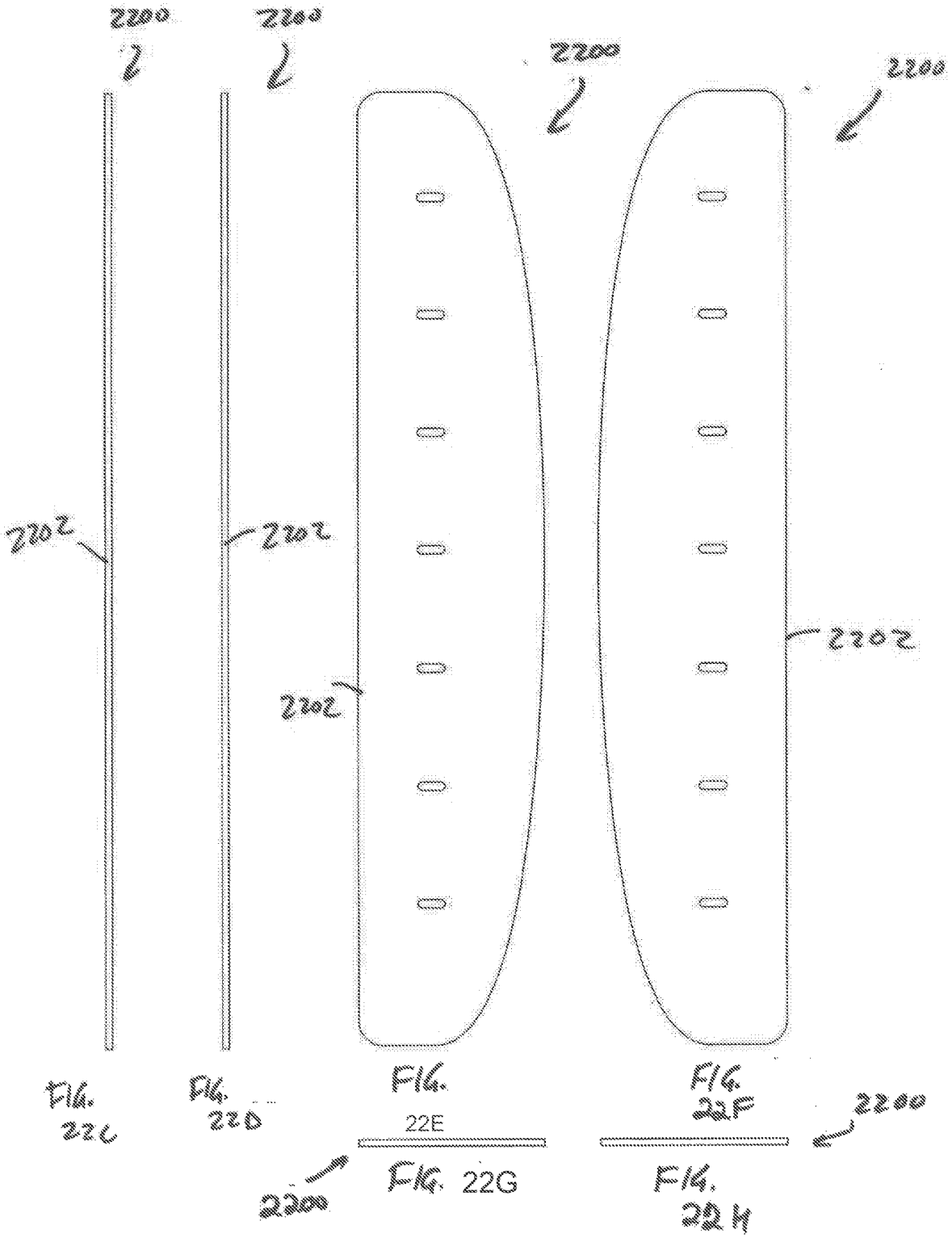
FIG. 22C is a front view of the panel of the merchandising display of FIG. 22A.
FIG. 22D is a rear view of the panel of FIG. 22C.
FIG. 22E is a left side view of the panel of FIG. 22C.
FIG. 22F is a right side view of the panel of FIG. 22C.
FIG. 22G is a top view of the panel of FIG. 22C.
FIG. 22H is a bottom view of the panel of FIG. 22C.
Figure 23A:
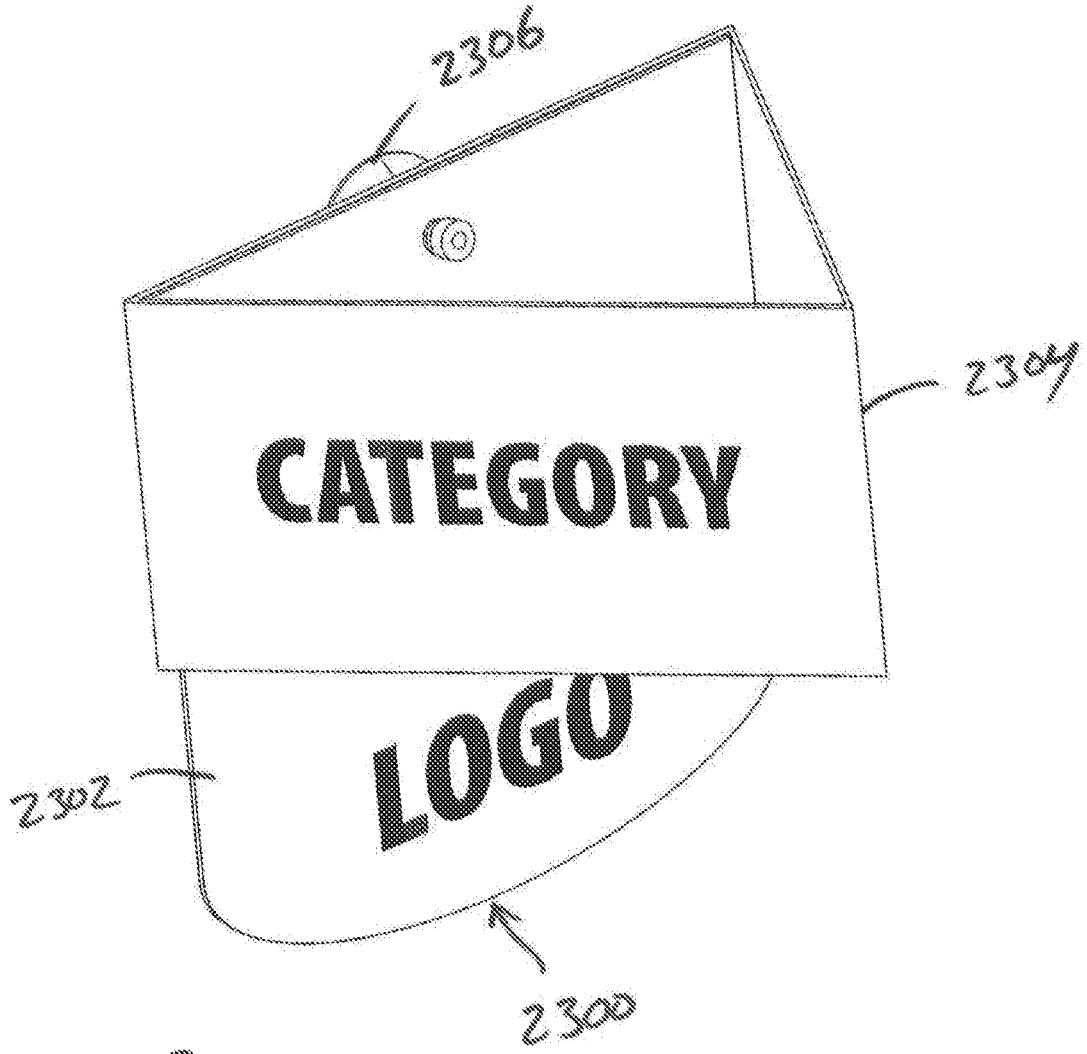
FIG. 23A is a perspective view of another signage assembly in accordance with the present teachings.
Figure 23B:
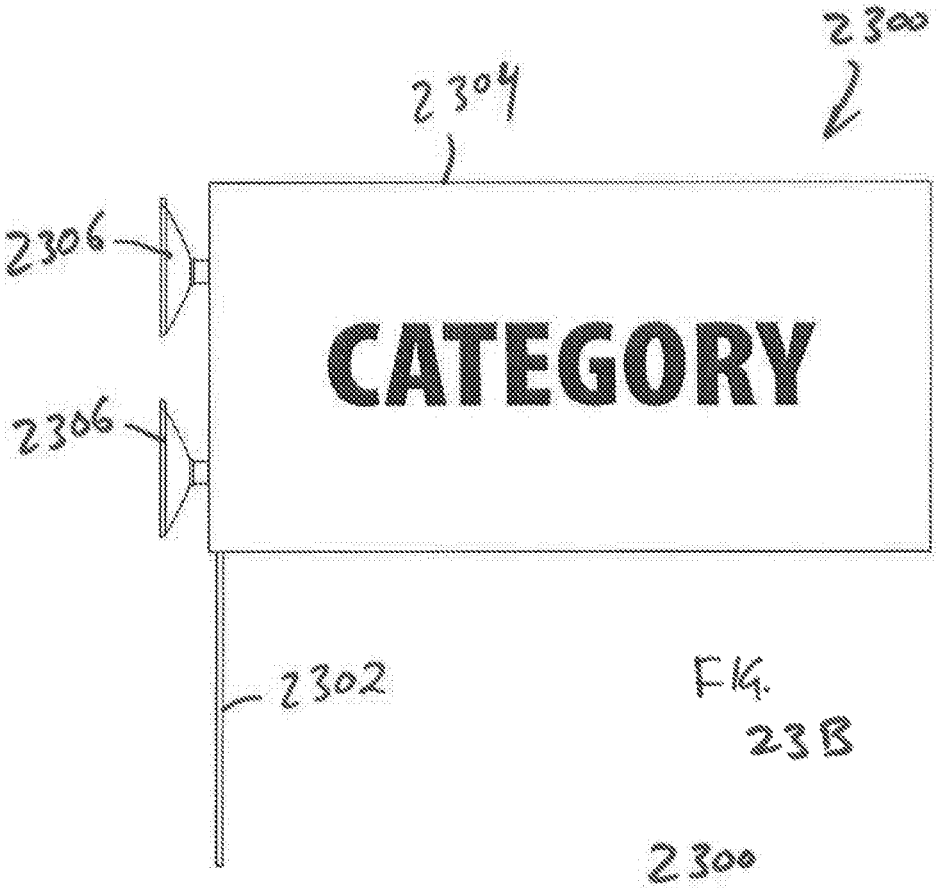
FIG. 23B is a left side view of the signage assembly of FIG. 23A.
Figure 23C:
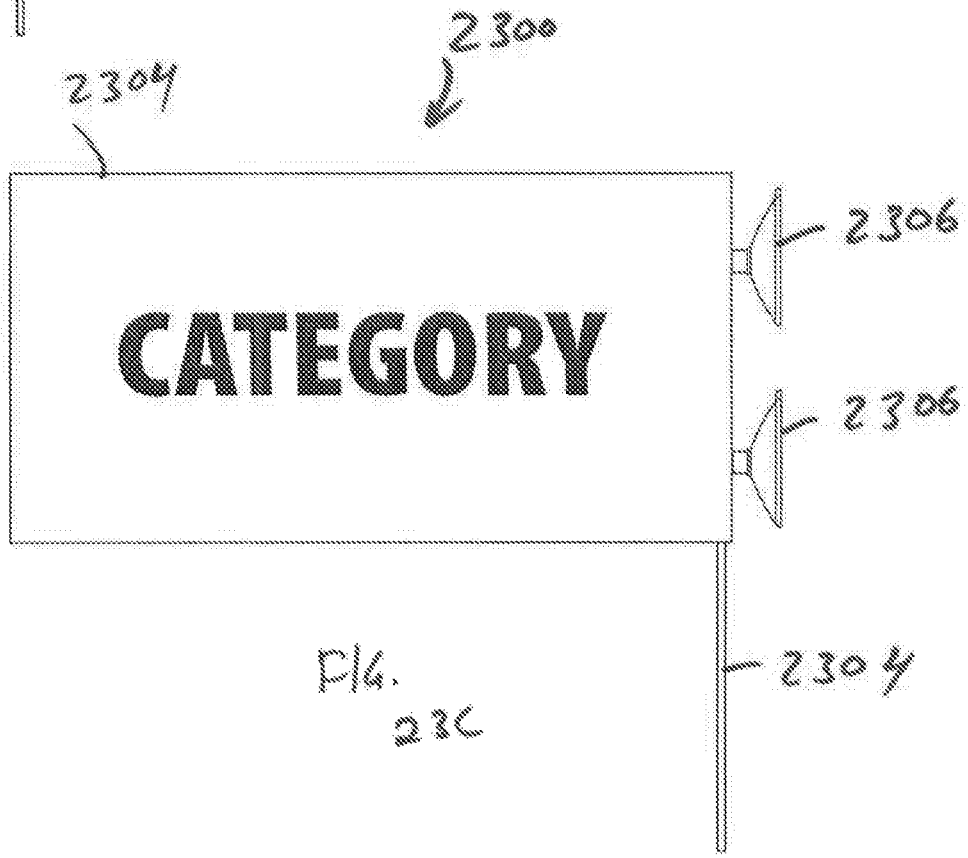
FIG. 23C is a right side view of the signage assembly of FIG. 23A.
Figure 23D:
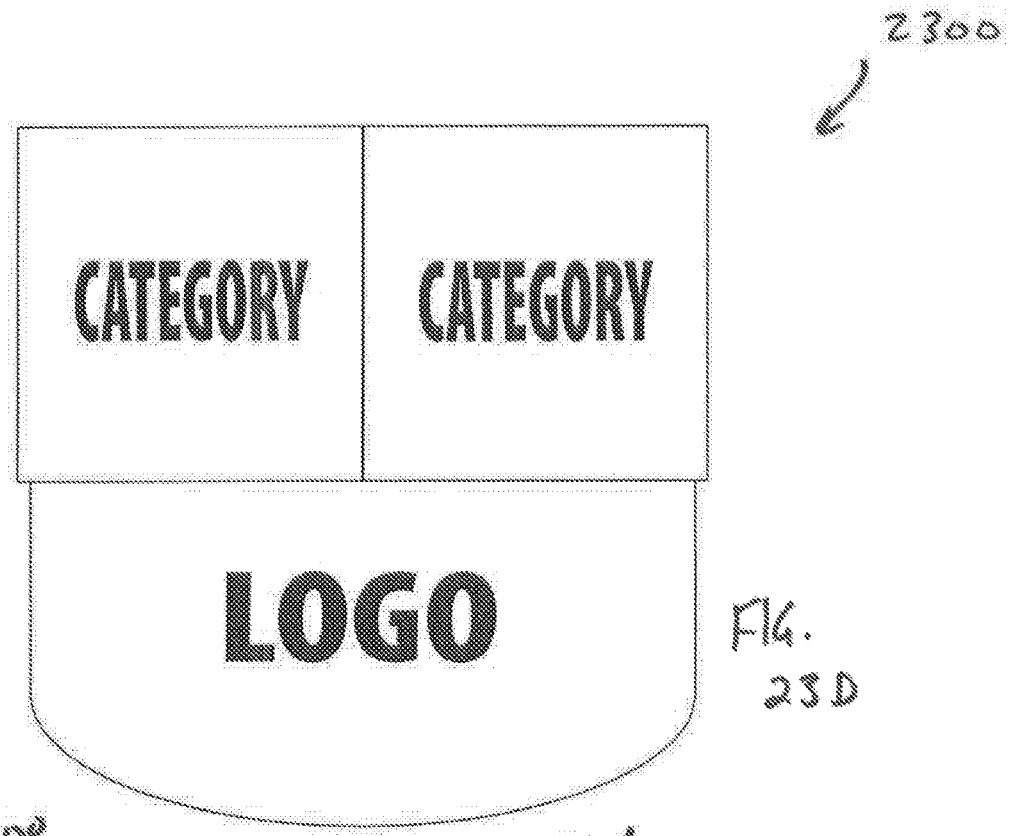
FIG. 23D is a front view of the signage assembly of FIG. 23A.
Figure 23E:
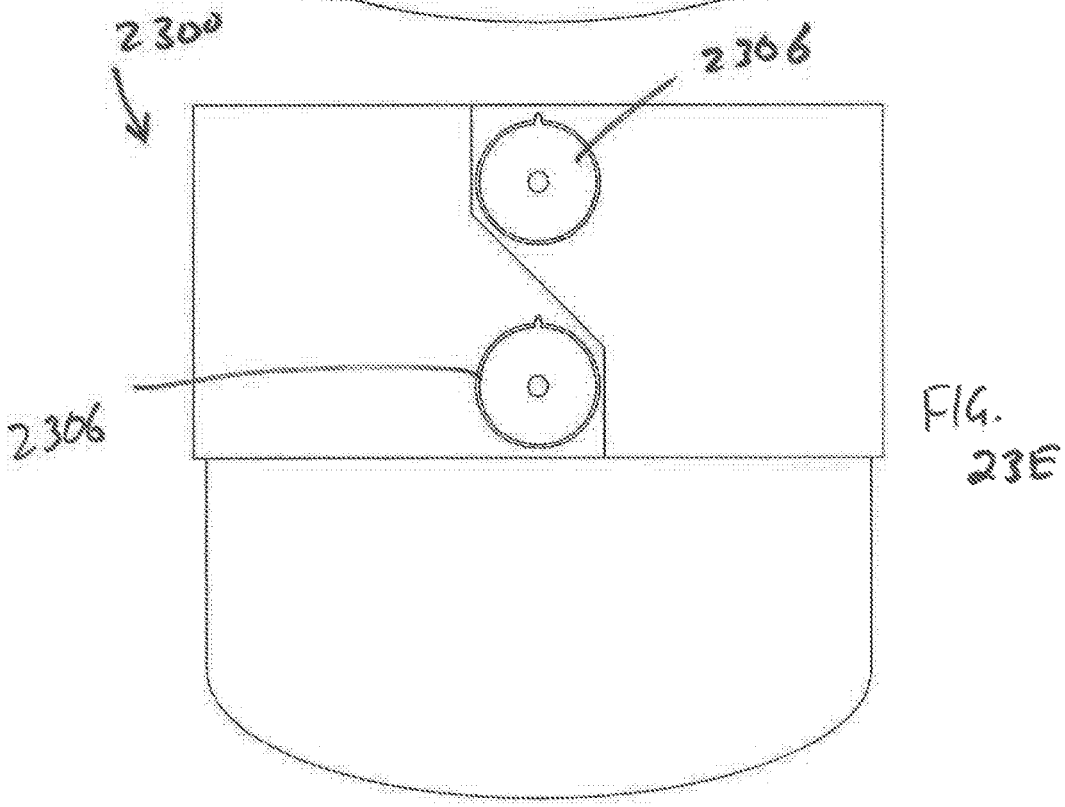
FIG. 23E is a rear view of the signage assembly of FIG. 23A.
Figure 23F:
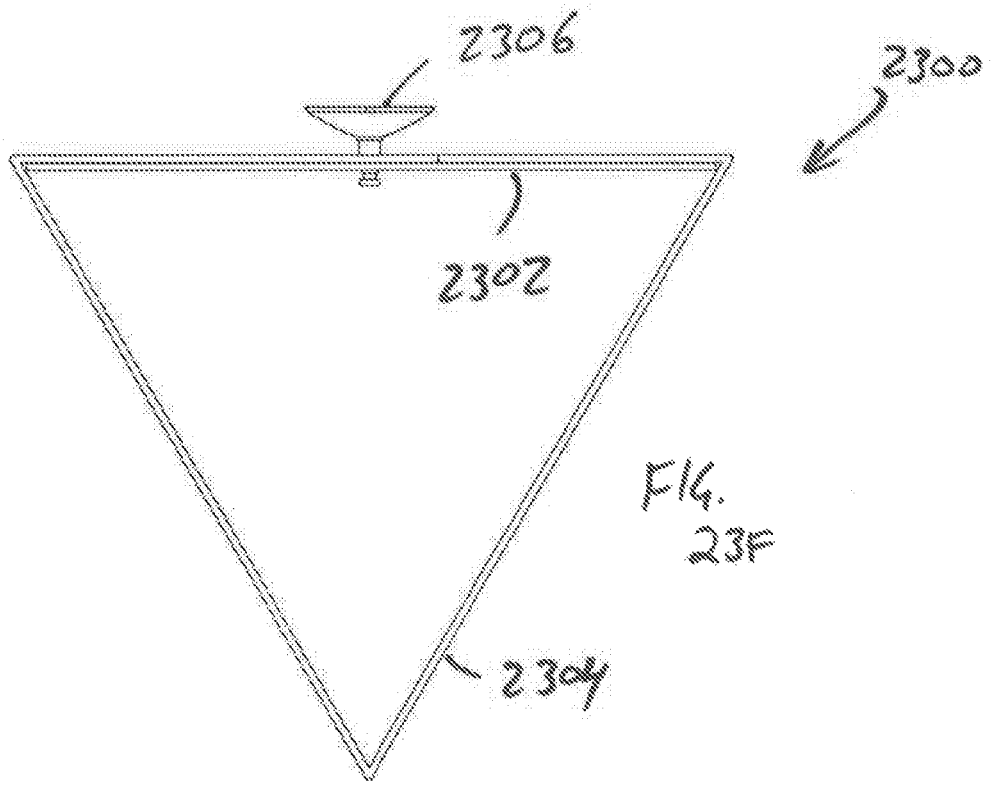
FIG. 23F is a top view of the signage assembly of FIG. 23A.
Figure 23G:
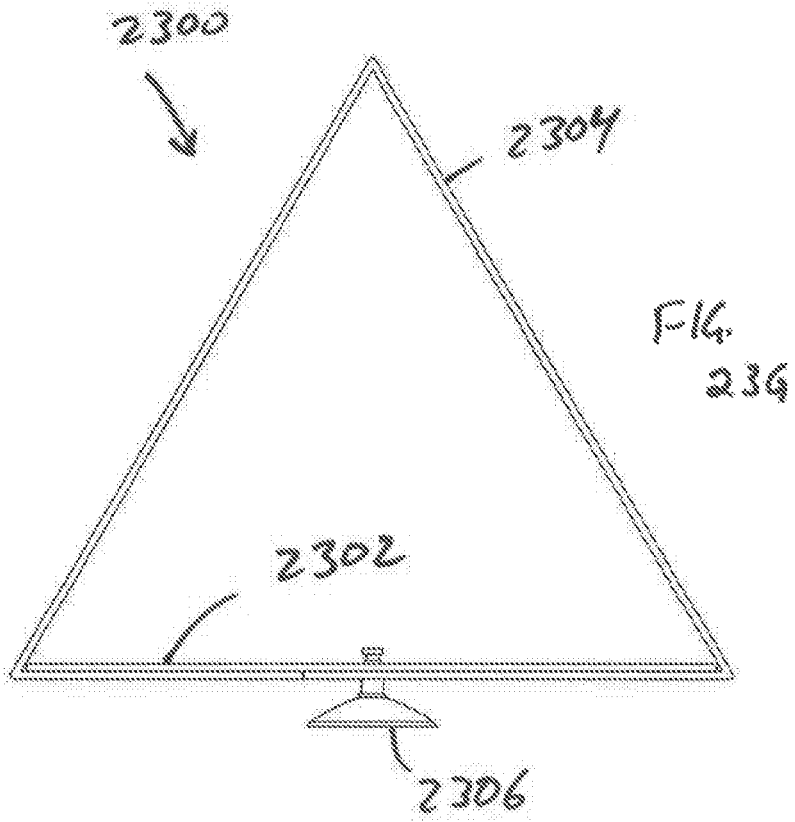
FIG. 23G is a bottom view of the signage assembly of FIG. 23A.
Figure 24A:
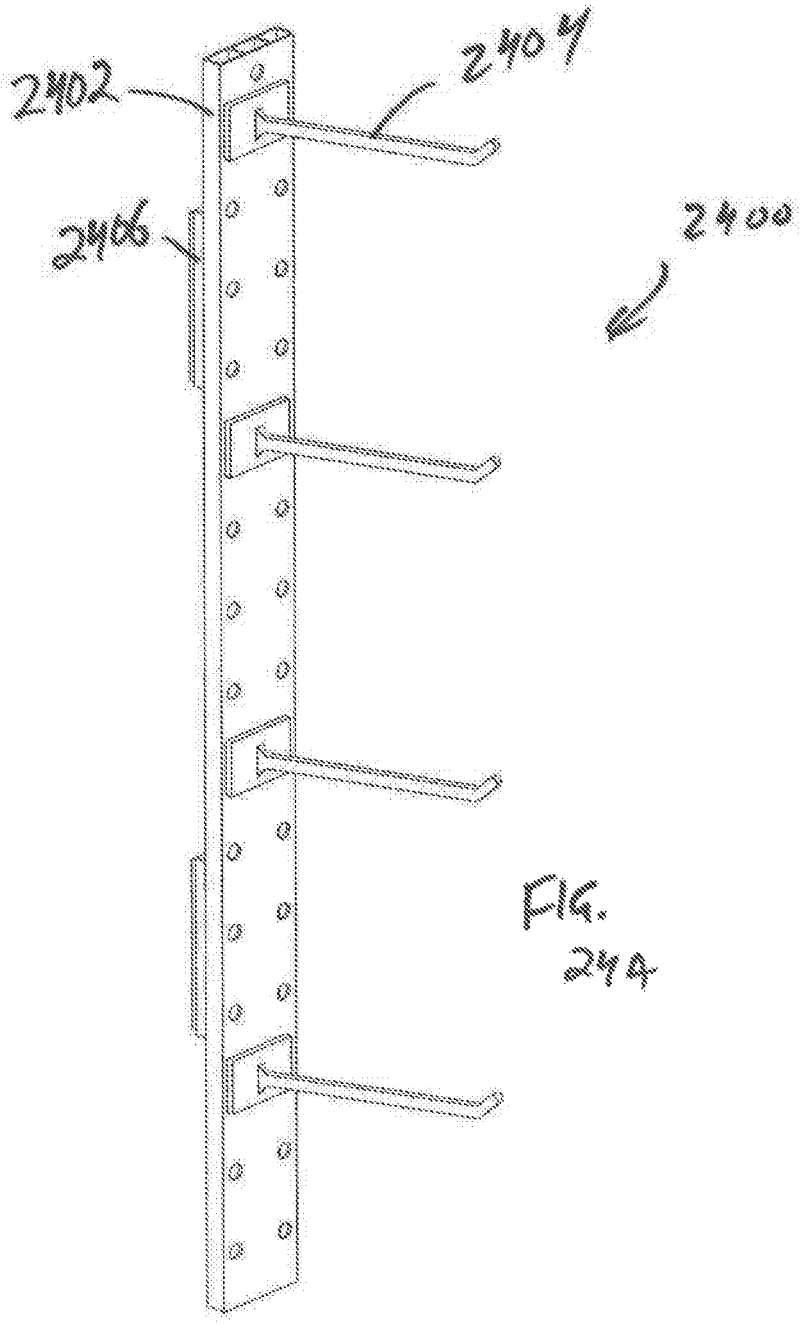
FIG. 24A is a perspective view of another merchandising display assembly in accordance with the present teachings.
Figures 24B, 24C, 24D, 24E, 24F, 24G:
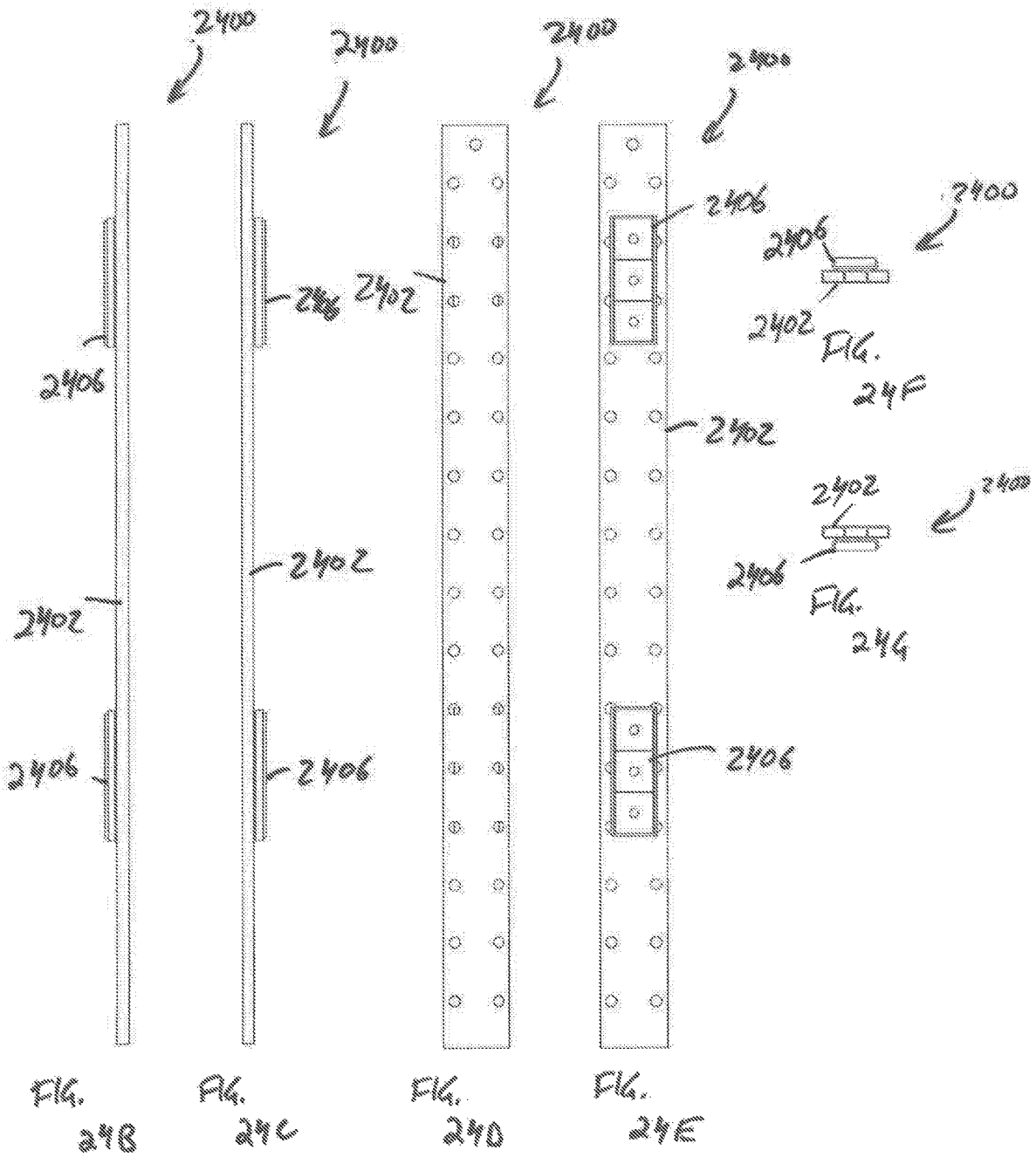
FIG. 24B is a left side view of the merchandising display assembly of FIG. 24A.
FIG. 24C is a right side view of the merchandising display assembly of FIG. 24A.
FIG. 24D is a front view of the merchandising display assembly of FIG. 24A.
FIG. 24E is a rear view of the merchandising display assembly of FIG. 24A.
FIG. 24F is a top view of the merchandising display assembly of FIG. 24A.
FIG. 24G is a bottom view of the merchandising display assembly of FIG. 24A.

The sign holder 2000 may be unitarily constructed of plastic or other similar material. The sign holder 2000 may include a planar back panel 2002. The back panel 2002 may be provided with a plurality of apertures that selectively align with corresponding apertures of the mounting bracket 1904 to facilitate attachment of the sign holder 2000 to the mounting bracket 1904 with conventional fasteners. As shown in FIG. 19A, the sign holder 2000 may be attached to the bracket 1904 with two of the lowermost apertures (when the sign holder 2000 is oriented with a long axis extending vertically). As shown in FIG. 21A, for example, the sign holder 2000 may be formed to include a larger hole 2004 in the back panel 2002 sized to receive a finger or thumb, the purpose of which will be described below.

Figure 20A:
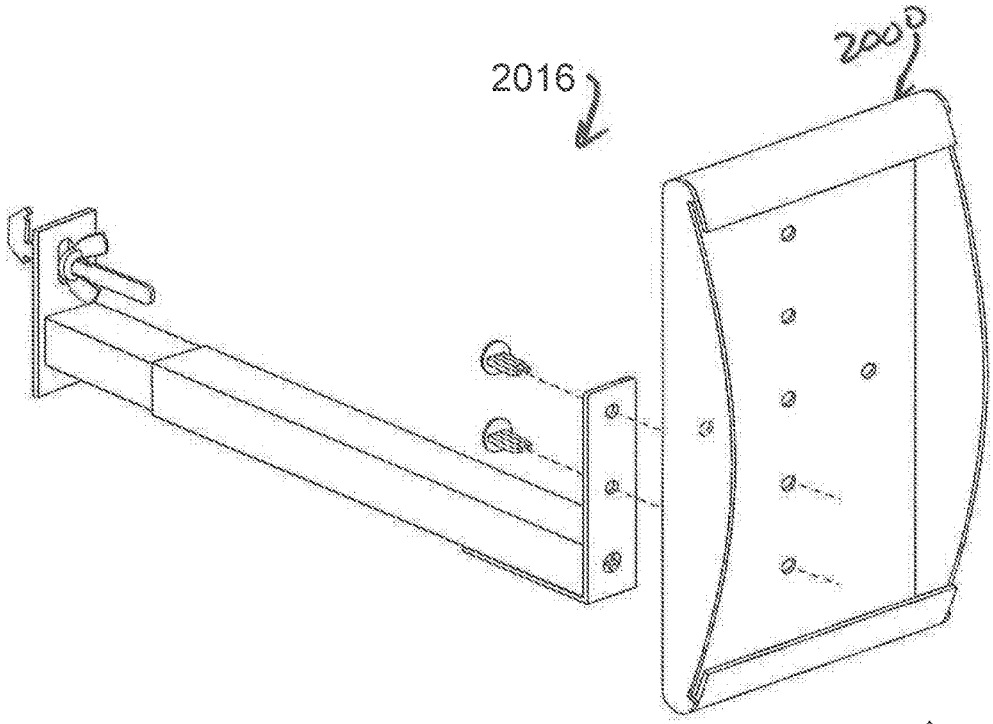
FIG. 20A is an exploded perspective view of another signage assembly of the present teachings.
Figure 20B:
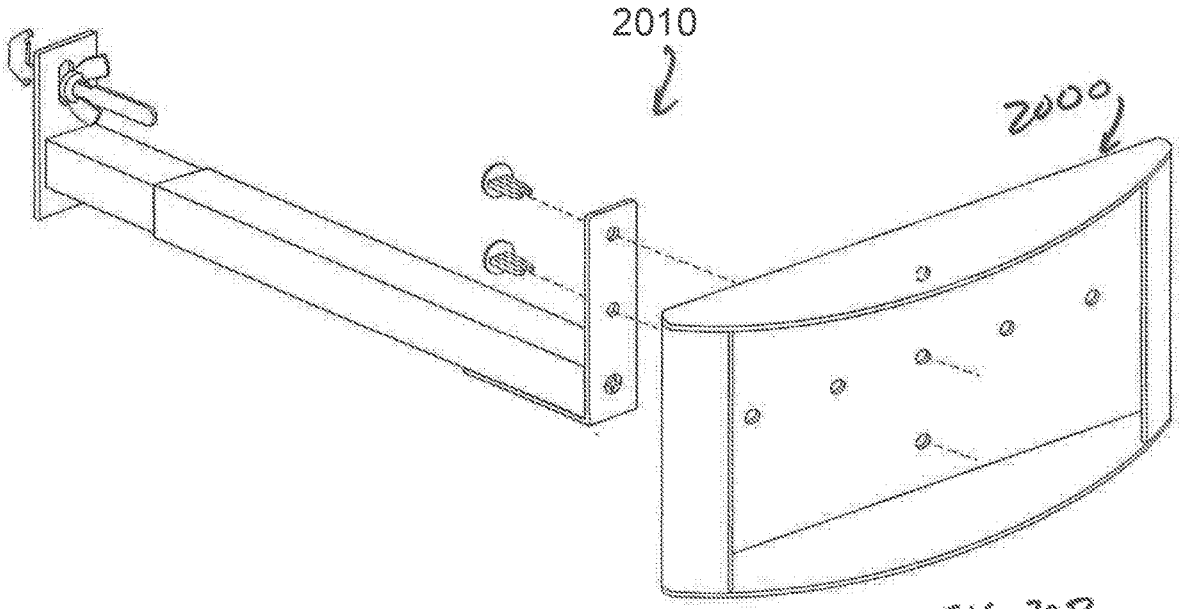
FIG. 20B is another exploded perspective view of the signage assembly of FIG. 20A.
Figure 20C:
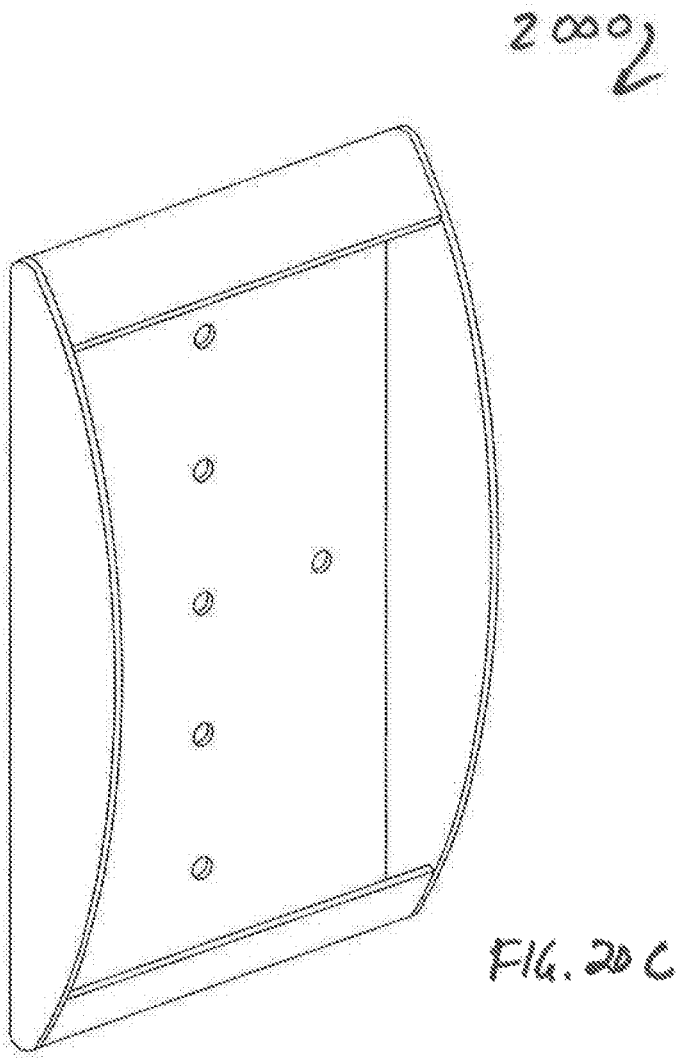
FIG. 20C is a perspective view of the bracket of the signage assembly of FIG. 20A.
Figure 20D:
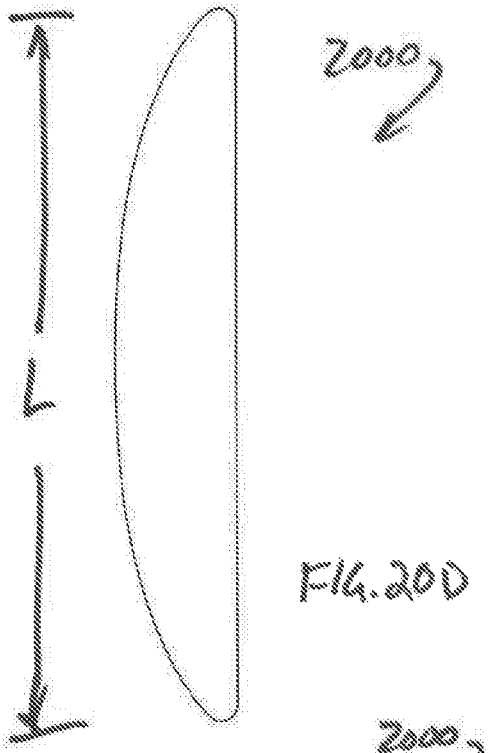
FIG. 20D is a right side view of the bracket of FIG. 20C.
Figure 20E:
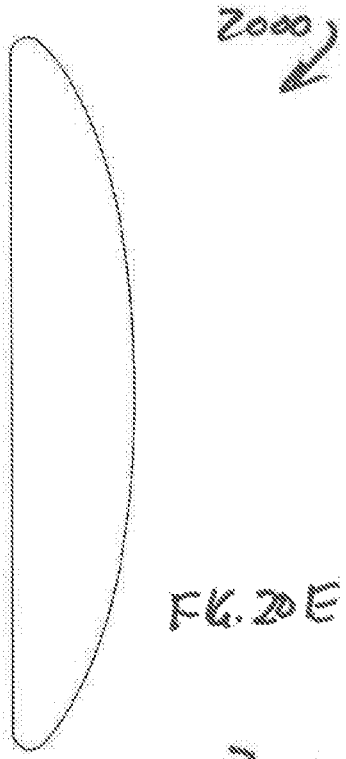
FIG. 20E is a left side view of the bracket of FIG. 20C.
Figure 20F:
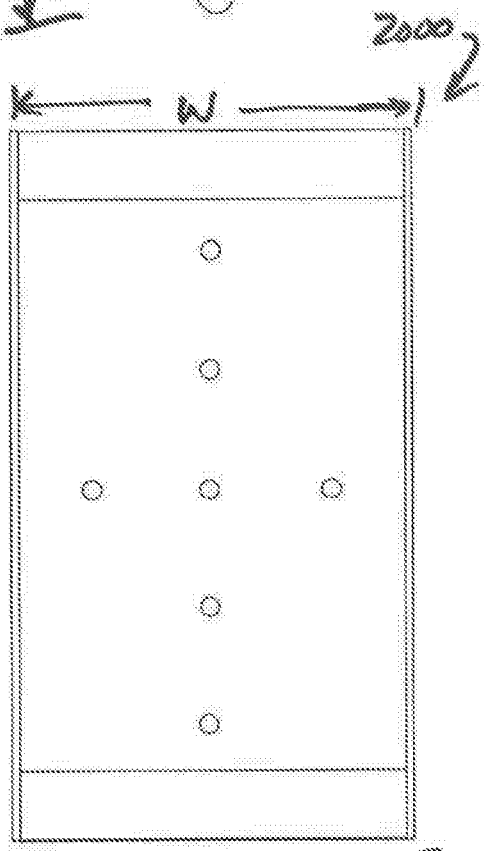
FIG. 20F is a front view of the bracket of FIG. 20C.
Figure 20G:
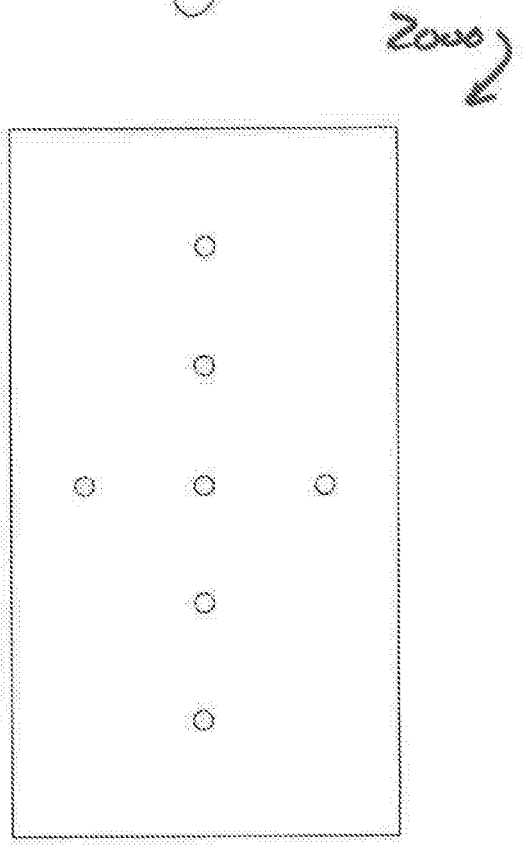
FIG. 20G is a rear view of the bracket of FIG. 20C.
Figure 20H:
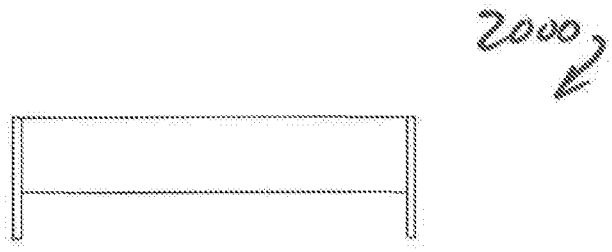
FIG. 20H is a top view of the bracket of FIG. 20C.
Figure 20I:
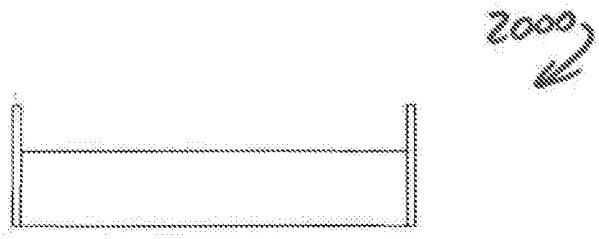
FIG. 20I is a bottom view of the bracket of FIG. 20C.

The sign holder 2000 may include a length L (see FIG. 20D) and a width W (see FIG. 20F). In the embodiment illustrated, the length is greater than the width. The sign holder 2000 may include a first pair of sides 2006 along the length L and a second pair of sides 2008 along the width W. As illustrated, the first pair of sides 2006 may be parallel to one another. Additionally, the edges of the first pair of sides 2006 may be convexly curved. The second pair of sides 2008 may extend upwardly and inwardly. Explaining further, the second pair of sides 2008 may each follow the convex curvature of the first pair of sides 2006.

The sign holder 2000 is adapted to receive a sign 1910 (shown in FIG. 19A in dashed lines). The sign 1910 may be constructed of cardstock, plastic or other suitably flexible material and may be printed with graphics. The sign 1910 may have length slightly greater than a length of the inner side of the back panel 2002. In this manner, the sign 1910 may be attached to the sign holder 2000 by first inserting a first end of the sign (e.g., the top end in FIG. 19A) into an upper portion an opening 2012 defined by the sides 2006 and 2008 and the back panel 2002. Next, the second end (e.g., the lower end in FIG. 19A) of the sign 1910 may be inserted into the open 2012 by elastically bending the sign 1910 to a curved shape. The sign 1910 may generally follow the convex curvature of the sides 2006. The hole 2004 may allow a user to remove the sign 1910 from the sign holder 2002 by poking out the sign 1910 from the back of the sign holder 2002.

The mounting bracket 1904 may have a L-shape with a upwardly extending leg and a horizontally extending leg. The horizontally extending leg may be attached to a shelf, for example, with conventional fasteners.

In FIG. 19E, an alternative sign holder 2000' is illustrated. In this embodiment, the short sides (along the width W) are parallel to one another and follow the convex curvature of the longer sides (along the length L).

With particular reference to the exploded view of FIG. 19B, the signage assembly 1900 is shown for alternatively mounting the sign holder 2000 to the mounting bracket 1904.

Turning to FIGS. 21A through 21G, a sign holder in accordance with the present teachings is illustrated and generally identified at reference character 2100. The sign holder 2100 will be understood to be identical to the sign holder 2000 except that the rear panel 2002 incorporates a different aperture/hole pattern.

Turning to FIGS. 22A through 22H, another merchandising display in accordance with the present teachings is illustrated and generally identified at reference character 2200. The merchandising display 2200 is shown to generally include a planar panel 2202 and a plurality of hooks 2204 for the suspension of product for retail sale. The panel 2202 may be printed with graphics and includes a plurality of apertures 2206 for receiving the hooks 2204. The plurality of apertures 2206 are elongated in a horizontal direction.

Turning to FIGS. 23A through 23G, another signage assembly in accordance with the present teachings is illustrated and generally identified at reference character 2300. The signage assembly 2300 is shown to generally include a first panel 2302, a second panel 2304 and one or more attachment members 2306. The first panel 2302 may be a planar panel. The second panel 2304 may also be a planar panel, but the second panel 2304 may be folded into a triangular shape.

As shown in the drawings, the one or more attachment members 2306 may include two attachment members 2306. The attachment members 2306 may include a suction cup. The attachment members 2306 may extend through aligning holes in the first and second panels 2302 and 2304 and be secured thereto in a conventional manner. In certain applications, the first and second panels 2302 and 2304 may be additional glued or otherwise secured to one another.

Turning to FIGS. 24A through 24G, another merchandising display in accordance with the present teachings is illustrated and generally identified at reference character 2400. The merchandising display 2400 is illustrated to include an elongated strip member 2402, a plurality of hooks 2404 for the suspension of product for retail sale and one or more mounting members 2406. The elongated strip member 2402 may be formed on opposite sides with a plurality of apertures for receiving the hooks 2404.

As shown in the drawings, the one or more mounting members 2406 may include two mounting members 2406. Each of the mounting 2406 may include a magnet. The attachment members 2406 engage one or more of the plurality of apertures of the elongated strip member 2402 for engagement thereto. In this manner, the attachment members 2406 may be secured to the elongated strip member 2402 selectively along the length thereof.

Figures 25A, 25B:
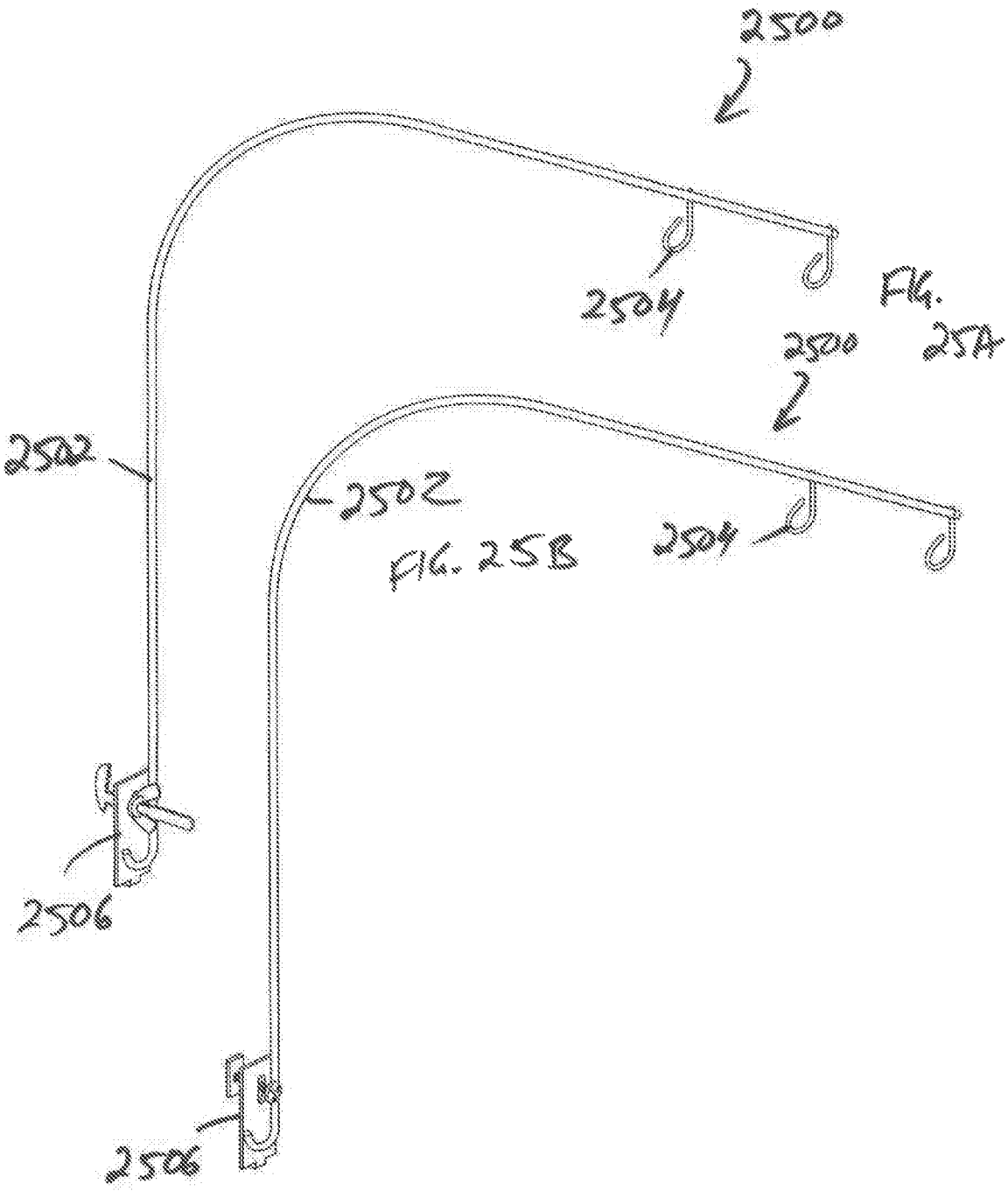
FIG. 25A is a perspective view of another merchandising display assembly in accordance with the present teachings.
Figures 25C, 25D:
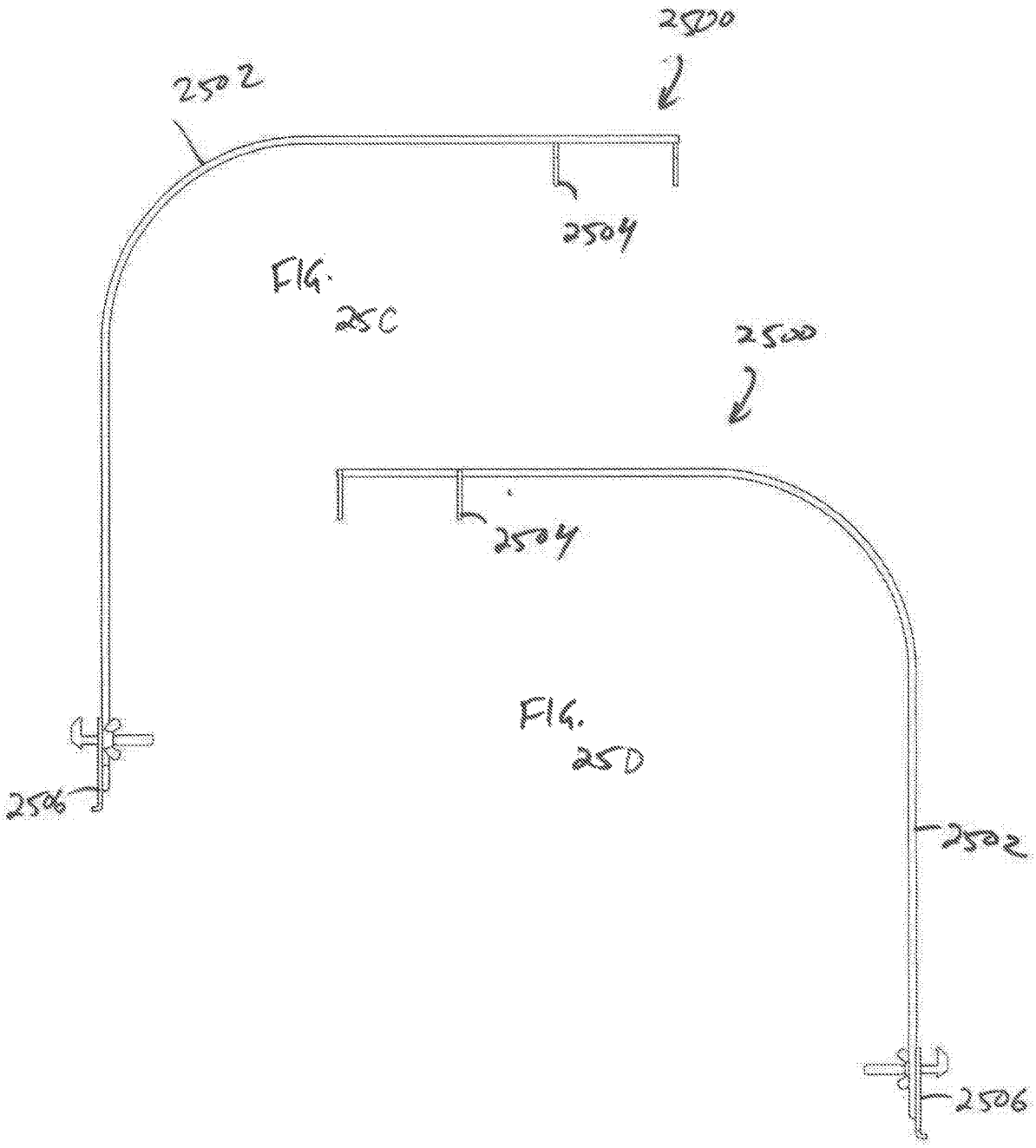
Figure 25E:
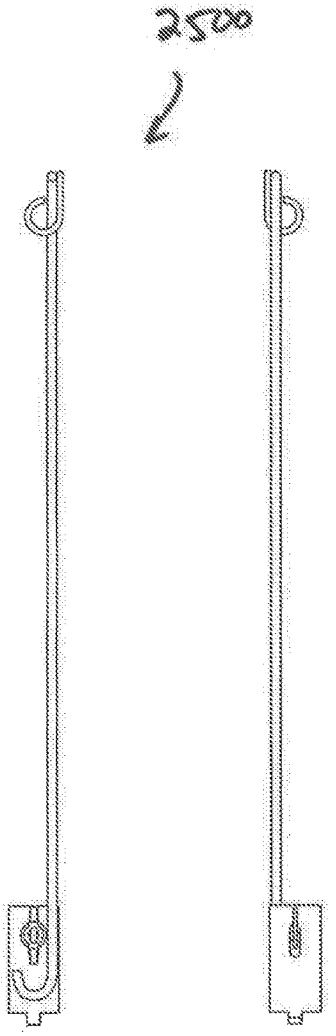
Figure 25F:
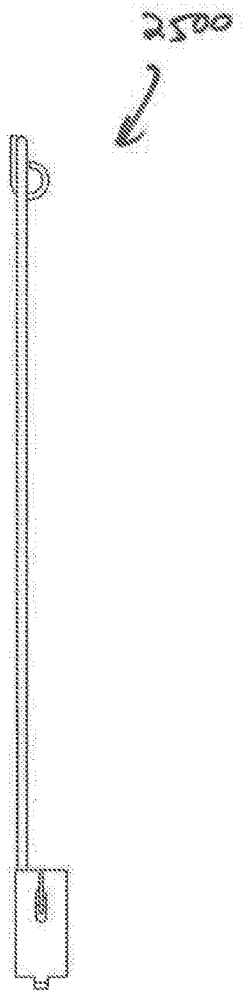
Figure 25G:
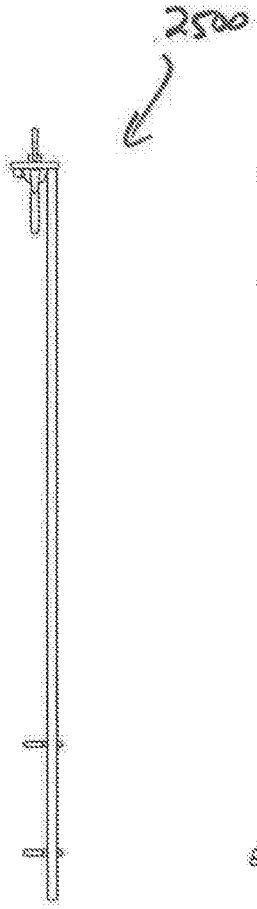
Figure 25H:
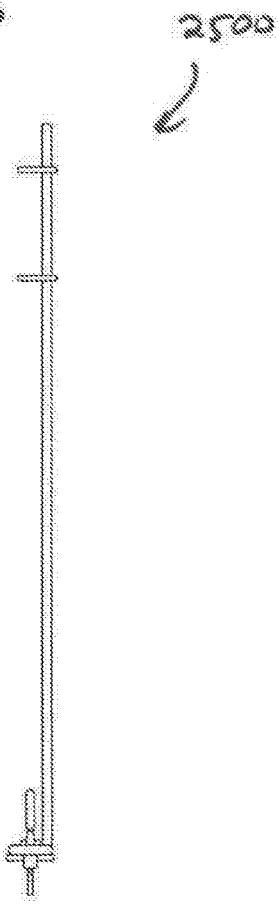

Turning to FIGS. 25A through 25H, another signage assembly in accordance with the present teachings is illustrated and generally identified at reference character 2500. FIG. 25B shows an alternative mounting structure. The signage assembly 2500 is illustrated to include a rod 2502 including a horizontally extending portion, a vertically extending portion and a curved portion therebetween. The signage assembly 2500 additionally includes one or more hooks 2504 for the suspension of a sign. The hooks 2504 may be welded or otherwise securely attached to the rod 2502. The signage assembly 2500 further includes a mounting plate 2506. An end of the rod 2502 may be bent to a J-shape and welded or otherwise securely attached to the mounting plate 2506.

Turning to FIGS. 26A through 26H, another signage assembly in accordance with the present teachings is illustrated and generally identified at reference character 2600. The signage assembly 2600 is illustrated to generally include a sign holder 2602 and a mounting arm 2604. The sign holder 2602 may be unitarily formed of a plastic or other suitable material and may include a pair of jaws for receiving a sign or a panel carrying products for retail sale. The sign holder 2602 may be further formed to include a channel.

The mounting arm 2604 may have a rectangular cross section and may include first and second segments 2604A and 2604B. The first and second segments 2604A and 2604B may be telescopically coupled to one another. The telescopic coupling may provide for an adjustable length of the arm 2604.

The signage assembly 2600 may include a first mounting flange 2606 at a free end of the first segment 2604A. The first mounting flange 2606 may be used to engage a channel. The first mounting flange 2606 may be welded or otherwise securely fastened to the arm 2604. The signage assembly 2600 may further include a second mounting flange 2608 at a free end of the second segment 2604B. The second mounting flange 2608 may be welded or otherwise securely fastened to the arm 2604. The second mounting flange 2608 may be slidably received within the channel defined by the sign holder 2602.

Turning to FIGS. 27A through 27H, another signage assembly in accordance with the present teachings is illustrated and generally identified at reference character 2700. The signage assembly 2700 is identical to the signage assembly 2600 with the exceptions that the signage assembly 2700 includes a differently attachment of the second mounting flange 2608 to the arm 2602 and the sign holder 2602 is adhesively attached to the second mounting flange 2608.

Turning to FIGS. 28A through 28H, another signage assembly in accordance with the present teachings is illustrated and generally identified at reference character 2800. The signage assembly 2800 differs from the signage assembly 2700 in that the signage assembly 2800 includes a cylindrical rod 2702 rather than a rectangular arm 2604.

With reference to FIGS. 29, 30 and 31, three related signage assemblies are illustrated and generally identified at reference characters 2900, 3000 and 3100, respectively. The signage assemblies 2900, 3000 and 3100 include a common base or mounting bracket 2902 and a common signage portion 2904. The signage assemblies 2900, 3000 and 3100 differ by incorporating different vertically extending members. The signage assembly 2900 includes a non-adjustable vertically extending member 2904 having a rectangular cross section. The signage assembly 3000 includes a vertically extending member 3004 constructed of flat stock material. The signage assembly 3100 includes an adjustable vertically extending member 3104 including first and second telescopically associated parts.

The signage assembly 3100 is further in FIGS. 31B through G. The mounting bracket 2902 common among the signage assemblies 2900, 3000 and 3100 may be formed of metal or other suitable material. The mounting bracket 2902 may be u-shaped and may define a mounting channel 3106 for engaging a rail. The mounting bracket 2902 may be stamped of metal and bent to the u-shape. As illustrated, a portion 3108 of the bracket 2902 may upwardly extend from the u-shape and define an arcuate slot 3110.

The vertically extending member 3104 may be pivotally coupled to the mounting bracket 2902 at a pin 3112. A threaded fastener 3114 may pass through the vertically extending member 3104 and the arcuate slot 3110. The threaded fastener 3114 may be threadably engaged by a wing nut 3116, for example. Until the wing nut 3116 is tightened, the fastener 3114 may ride in the arcuate slot 3110 for pivotally adjusting the vertically extending member 3104 relative to the mounting bracket 2902. After tightening, the relative orientations between the vertically extending member 3104 and the mounting bracket 2902 may be fixed.

The mounting bracket 2902 may include thumb screws that may be tightened for securing the signage assembly 3100 to a rail.

The common signage portion 2904 may include a rod bent to include first and second horizontally extending portions. The first portion may carry a sign or sign holder. The second portion may receive product for retail sale. The rod may be welded or otherwise secured to the vertically extending member 3104.

Turning to FIGS. 32A through 32G, additional merchandising displays in accordance with the present teachings are illustrated. The merchandising displays of FIGS. 32A through 32G differ from the merchandising displays of FIGS. 30 and 30 by incorporating a vertically extending member 3200 having a rectangular cross section. In the embodiments illustrated, the vertically extending member 3200 is telescopically adjustable and includes a first lower element 3200A and a second or upper element 3200B.

Prior to telescopic engagement of the lower and upper elements 3200A and 3200B, the upper element 3200B may be rotated relative to the lower element 3200A about its vertically extending axis. In this manner, the upper element 3200B may be coupled to the lower element 3200A in four orientations. A first orientation is shown in FIG. 32A, for example. A second orientation is shown in FIG. 32B, for example.

In the embodiment of FIGS. 32A and 32B, the mounting bracket 2902 may be formed similar to the mounting bracket of FIG. 31 to include u-shape and define a mounting channel 3106 for engaging a rail. The mounting bracket 2902 may be stamped of metal and bent to the u-shape. As illustrated, a portion 3108 of the bracket 2902 may upwardly extend from the u-shape and define an arcuate slot 3110.

The vertically extending member 3104 may be pivotally coupled to the mounting bracket 2902 at a pin 3112. A threaded fastener 3114 may pass through the vertically extending member 3104 and the arcuate slot 3110. The threaded fastener 3114 may be threadably engaged by a wing nut 3116, for example. Until the wing nut 3116 is tightened, the fastener 3114 may ride in the arcuate slot 3110 for pivotally adjusting the vertically extending member 3104 relative to the mounting bracket 2902. After tightening, the relative orientations between the vertically extending member 3104 and the mounting bracket 2902 may be fixed.

The mounting bracket 2902 may include thumb screws that may be tightened for securing the signage assembly 3100 to a rail.

The embodiment of FIGS. 32C and 32D includes a u-shaped bracket 2902 similar to the embodiment of FIGS. 32A and 32B. The lower element 3200A is adjustably attached to the bracket 2902 through an L-shaped bracket 3202, for example. The vertically extending member 3200 may be pivotally coupled to the L-shaped bracket 3202 at a pin 3204. A fastener 3206 passing through the lower element 3200A and one of various holes in the L-shaped bracket 3202 may secure the vertically extending member 3200 relative to the mounting bracket 2902 in select orientations. In this manner, the angle of the vertically extending member 3200 may be adjusted depending on the mounting of the display.

In the embodiment of FIGS. 32E and 32F also includes a u-shaped bracket 2902 similar to the embodiment of FIGS.

32A and 32B. In this embodiment, however, the lower element 3200A is fixedly attached to the bracket 2902. Attachment may be accomplished through welding or in any other manner well known in the art.

In the embodiment of FIG. 32G, a lower end of the lower element 3200A may be welded or otherwise suitably attached to a plate 3208. In this manner, the display may be free standing.

Turning to FIGS. 33A through 31H, another signage assembly in accordance with the present teachings is illustrated and generally identified at reference character 3300. The signage assembly may be a bracket assembly 3300 for an overhead sign system. The bracket assembly 3300 may include a main body portion 3302 unitarily constructed of a rectangular tube to include a horizontally extending portion 3302A, a vertically extending portion 3302B and a curved intermediate portion 3302C.

The signage assembly 3300 may further include a first mounting member 3304 carried at a free end of the horizontally extending portion 3302A and a second mounting member 3306 carried at a free end of the vertically extending portion 3302B. The first mounting member 3304 may include a central, planar portion 3304A. The central planar portion 3304A may include a plurality of holes for selectively receiving a fastener that engages a corresponding hole in an end of the horizontally extending portion 3302A. In this manner, the first mounting member 3304 may be attached to the main body portion 3302 in distinct positions. A first position is shown in FIG. 33A. A second position is shown in FIG. 33B. A third position is shown in FIG. 33B.

The second mounting member 3306 may be a plate. The plate 3306 may be welded or otherwise suitable attached to the main body portion 3302. Conventional hardware may be carried by the second mounting portion for attaching the bracket assembly 3300 to uprights of a gondola 10.

Turning to FIGS. 34A through 34G, another merchandising display in accordance with the present teachings is illustrated and generally identified at reference character 3400. The merchandising display 3400 is illustrated to include an elongated strip member 3402, a plurality of hooks 3404 for the suspension of product for retail sale and one or more mounting members 3406. The elongated strip member 3402 may be formed on opposite sides with a plurality of apertures for receiving the hooks 3404.

As shown in the drawings, the one or more mounting members 3406 may include two mounting members 3406. Each of the mounting 3406 may include a suction cup 3408. The attachment members 3406 engage one or more of the plurality of apertures of the elongated strip member 3402 for engagement thereto. The attachment members 3406 are shown secured to the elongated strip member 3402 near the top and the bottom. Alternatively, the mounting members 3406 may be secured anywhere along the length thereof of the elongated strip member 3402. The attachments members 3406 may be secured to the elongated strip member 3402 in any manner well known in the art.

Turning to FIGS. 35A through 35G, another merchandising display in accordance with the present teachings is illustrated and generally identified at reference character 3500. The merchandising display 3500 is illustrated to include an elongated strip member 3502, a plurality of hooks 3504 for the suspension of product for retail sale and one or more mounting members 3506. The elongated strip member 3502 may be formed on opposite sides with a plurality of apertures for receiving the hooks 3504.

As shown in the drawings, the one or more mounting members 3506 may include two mounting members 3506. Each of the mounting 3506 may include a magnet 3508. The attachment members 3506 engage one or more of the plurality of apertures of the elongated strip member 3502 for engagement thereto. The attachment members 3506 are shown secured to the elongated strip member 3502 near the top and the bottom. Alternatively, the mounting members 3506 may be secured anywhere along the length thereof of the elongated strip member 3502. The attachments members 3506 may be secured to the elongated strip member 3502 in any manner well known in the art.

While specific examples and alternatives have been described in the specification and illustrated in the drawings, it will be understood by those skilled in the art that various further changes may be made by and equivalence may be substituted for elements thereof without departing from the scope of the present teachings as defined in the claims. Furthermore, the mixing and matching of features, elements and/or functions between various examples may be expressly contemplated herein so that one skilled in the art would appreciate from the present teachings that features, elements and/or functions of one example may be incorporated into another example as appropriate, unless described otherwise above. Moreover, many modifications may be made to adapt a particular situation or material to the present teachings without departing from the essential scope thereof. Therefore, it may be intended that the present teachings not be limited to the particular examples illustrated by the drawings and described in the specification as the best mode of presently contemplated for carrying out the present teachings but that the scope of the present disclosure will include any embodiments following within the foregoing description and any appended claims.

What is claimed is:

1. An overhead signage system comprising:

first and second uprights of a gondola;

a frame for engaging the first and second uprights of the gondola, the frame including first and second laterally spaced apart side portions and a front portion connecting the first and second laterally spaced apart side portions; and a sign holding member having a front panel attached to the front portion of the frame and a first and second side panels attached to the first and second laterally spaced apart side portions of the frame, respectively, wherein the sign holding member has a height greater than the frame, the frame is mounted to the sign holding member proximate a lower end of the sign holding member and the sign holding member upwardly extends from the frame.

2. The overhead signage system of claim 1, wherein the front panel defines a single channel for receiving a single sign and the side panels define a plurality of channels for receiving a plurality of signs.

3. The overhead signage system of claim 1, wherein the side panels of the pair of side panels are coupled to the front panel through a pair of vertically extending braces.

4. The overhead signage system of claim 3, wherein the braces are L-shaped.

5. The overhead signage system of claim 1, wherein the frame is formed of a single piece of metal bent to include the front portion and the first and second laterally spaced apart side portions.

6. The overhead signage system of claim 5, wherein the single piece of metal is unitarily formed to include first and second ends defining first and second mounting portions for engaging the first and second uprights, respectively.

7. The overhead signage system of claim 1, wherein the sign holding member is continuous and bent to include the front panel and pair of side panels.

8. The overhead signage system of claim 1, wherein the frame includes first and second vertically extending portions and a horizontally extending portion formed from a single piece of metal bent to include a front portion and a pair of side portions.

9. The overhead signage system of claim 1, wherein the sign holder member is secured to the frame with fasteners.

10. The overhead signage system of claim 9, wherein each of the first and second laterally spaced apart side portions and the front portion of the frame includes a plurality of holes for securing the sign holder member to the frame.

* * * * *